US011129244B2

(12) United States Patent
Hoare et al.

(10) Patent No.: US 11,129,244 B2
(45) Date of Patent: Sep. 21, 2021

(54) MICROWAVE OVEN

(71) Applicant: Breville Pty Limited, Alexandria (AU)

(72) Inventors: Richard Hoare, Lane Cove (AU); Keith James Hensel, Lane Cove (AU)

(73) Assignee: BREVILLE PTY LIMITED, Alexandria (AU)

( * ) Notice: Subject to any disclaimer, the term of this patent is extended or adjusted under 35 U.S.C. 154(b) by 230 days.

(21) Appl. No.: 14/440,074

(22) PCT Filed: Nov. 1, 2013

(86) PCT No.: PCT/AU2013/001266
§ 371 (c)(1),
(2) Date: May 1, 2015

(87) PCT Pub. No.: WO2014/066949
PCT Pub. Date: May 8, 2014

(65) Prior Publication Data

US 2015/0282257 A1 Oct. 1, 2015

(30) Foreign Application Priority Data

Nov. 1, 2012 (AU) ..... 2012904773

(51) Int. Cl.
*H05B 6/64* (2006.01)

(52) U.S. Cl.
CPC ..... *H05B 6/6438* (2013.01); *H05B 6/6411* (2013.01); *H05B 6/6414* (2013.01); *H05B 6/6435* (2013.01)

(58) Field of Classification Search
CPC .. H05B 6/6438; H05B 6/6414; H05B 6/6411; H05B 6/6435
See application file for complete search history.

(56) References Cited

U.S. PATENT DOCUMENTS 5,345,067 A * 9/1994 Ohta ..... F24C 7/08 219/506
5,365,959 A * 11/1994 Favaro ..... A47L 15/4257 134/113

(Continued)

FOREIGN PATENT DOCUMENTS

CN 1293882 A 5/2001
CN 101263344 A 9/2008

(Continued)

OTHER PUBLICATIONS

First Office Action for Chinese Patent Application No. 201380069064, dated Jul. 5, 2016.

(Continued)

*Primary Examiner* — Thien S Tran
(74) *Attorney, Agent, or Firm* — Marshall, Gerstein & Borun LLP

(57) ABSTRACT

A user interface for a microwave oven. The user interface including: a power input element for receiving user input to adjust a cooking power setting; a time input element for receiving user input to adjust a cooking time setting; a display element for displaying the cooking power setting and the cooking time setting; and a processor module that receives a first signal from the power input element that is indicative of an adjustment to a cooking power setting and a second signal from the time input element that is indicative of an adjustment to a cooking time setting; the processor being coupled to the display element to cause the display to present the user selected cooking power setting and the user selected cooking time setting; wherein: upon commencing a cooking cycle, user input applied to the power input module caused the user selected cooking power setting to be adjusted. The user interface can further include: a plurality of shortcut selection elements, each shortcut selection element is associated with a predetermined cooking profile (Continued)

having predetermined cooking settings. The user interface can further include: an "a bit more" selection element that causes calculation of a supplemental cooking setting.

20 Claims, 70 Drawing Sheets

(56) References Cited

U.S. PATENT DOCUMENTS

| | | | | |
|---|---|---|---|---|
| 6,337,469 | B1 | 1/2002 | Chung | |
| 6,525,301 | B1 | 2/2003 | Graves et al. | |
| 6,624,395 | B2 * | 9/2003 | Kishimoto | H05B 6/666 219/491 |
| 6,815,644 | B1 * | 11/2004 | Muegge | F24C 1/04 126/332 |
| 2003/0024925 | A1 * | 2/2003 | Graves | H05B 6/6473 219/681 |
| 2006/0047344 | A1 * | 3/2006 | Head | F24C 7/082 700/1 |
| 2006/0102624 | A1 | 5/2006 | Ryu et al. | |
| 2007/0045284 | A1 | 3/2007 | Balk et al. | |

FOREIGN PATENT DOCUMENTS

| | | | |
|---|---|---|---|
| DE | 19606115 | A1 | 8/1996 |
| DE | 102007013138 | A1 | 10/2007 |
| JP | H04161779 | A | 6/1992 |
| JP | H04177022 | A | 6/1992 |
| RU | 2019068 | C1 | 8/1994 |

OTHER PUBLICATIONS

Second Office Action for Chinese Patent Application No. 201380069064, dated Mar. 29, 2017.
Extended European Search Report for European Patent Application No. 13850287.7, dated May 18, 2016.
Patent Examination Report No. 1 for Australian Patent Application No. 2013337610, dated Nov. 21, 2016.
Patent Examination Report No. 2 for Australian Patent Application No. 2013337610, dated Jul. 12, 2016.
Patent Examination Report No. 3 for Australian Patent Application No. 2013337610, dated Feb. 1, 2017.
Office Action for Russian Patent Application No. 2015120572, dated Nov. 10, 2017.
International Search Report and Written Opinion for PCT/AU2016/001266, dated Jan. 17, 2014.
International Preliminary Report on Patentability for PCT/AU2013/001266, dated May 5, 2015.
Office Action received for Chinese Application No. 201711422778.1, dated Apr. 20, 2020.

* cited by examiner

MICROWAVE OVEN

FIELD OF THE INVENTION

The technology relates to microwave ovens and more particularly to the user interface of a microwave oven. The technology also relates to roller support mechanisms and food covers with adjustable vents.

The invention has been developed primarily for use as a microwave oven and will be described hereinafter with reference to this application. However, it will be appreciated that the invention is not limited to this particular field of use.

BACKGROUND OF THE INVENTION

Any discussion of the prior art throughout the specification should in no way be considered as an admission that such prior art is widely known or forms part of the common general knowledge in the field.

Microwave ovens are well known. The user interfaces of many microwave ovens are difficult to use or confusing. Some microwave ovens have glass platters that are supported by roller mechanisms. However, locating the platter on the roller mechanism can be problematic. Some foods need to be covered, or covered and vented during microwave cooking. A cover with vents would make a desirable stand for use in a microwave oven if the closeable vents did not interfere with the stacking function.

OBJECTS OF THE INVENTION

It is an object of the present invention to overcome or ameliorate at least one of the disadvantages of the prior art, or to provide a useful alternative.

It is an object of the technology in a preferred form to provide a microwave oven with an improved user interface.

It is another object of the technology in a preferred form to provide an improved roller support for a microwave oven's platter.

It is yet another object of the technology in a preferred form to provide an improved cover and stand for microwave cooking.

SUMMARY OF THE INVENTION

According to an aspect of the invention there is provided a user interface for a microwave oven, the user interface including:

a power input element for receiving user input to adjust a cooking power setting;

a time input element for receiving user input to adjust a cooking time setting;

a display element for displaying the cooking power setting and the cooking time setting; and a processor module that receives a first signal from the power input element that is indicative of an adjustment to a cooking power setting and a second signal from the time input element that is indicative of an adjustment to a cooking time setting; the processor being coupled to the display element to cause the display to present the user selected cooking power setting and the user selected cooking time setting;

wherein:

upon commencing a cooking cycle, user input applied to the power input module caused the user selected cooking power setting to be adjusted.

Preferably, upon commencing a cooking cycle, user input applied to the power input module caused the user selected cooking power setting to be adjusted.

Preferably, the user selected cooking power setting and the user selected cooking time setting can each be adjusted in real time during a cooking cycle.

Preferably, the display element displays the user selected cooking power setting and the user selected cooking time in real time during a cooking cycle.

Preferably, the user selected cooking power is displayed graphically or numerically.

Preferably, the user selected cooking time is displayed graphically or numerically.

Preferably, the user interface further includes: a plurality of shortcut selection elements, each shortcut selection element is associated with a predetermined cooking profile having predetermined cooking settings; wherein the processor module receives a shortcut signal from a respective one of the plurality of shortcut selection elements; the processor retrieves the respective cooking profile and causes the display to present the associated predetermined cooking settings.

Preferably the user interface further includes: an "a bit more" selection element; wherein the processor module receives an "a bit more" signal from the "a bit more" selection element; the processor retrieves the previous cooking setting, calculates a supplemental cooking setting for continuing cooking a proportional amount with respect to the previous cooking setting, and causes the display to present the supplemental cooking setting.

According to an aspect of the invention there is provided a user interface for a microwave oven, the user interface including:

a display element for displaying cooking settings; and a plurality of shortcut selection elements, each shortcut selection element is associated with a predetermined cooking profile having predetermined cooking settings;

a processor module that receives a shortcut signal from a respective one of the plurality of shortcut selection elements; the processor retrieves the respective cooking profile and causes the display to present the associated predetermined cooking settings.

Preferably, the cooking profile being specifically configured for a predetermined food or beverage type.

Preferably, the shortcut selection element is hidden from first view behind a door of the microwave.

Preferably, the cooking settings are user adjustable.

According to an aspect of the invention, there is provided a user interface for a microwave oven, the user interface including:

a display element for displaying cooking settings; and an "a bit more" selection element;

a processor module receives an "a bit more" signal from the "a bit more" selection element; the processor retrieves the previous cooking setting, calculates a supplemental cooking setting for continuing cooking a proportional amount with respect to the previous cooking setting, and causes the display to present the supplemental cooking setting.

Preferably, the supplemental cooking setting having a cooking time setting that is a percentage of a previously set cooking time setting.

Preferably, the supplemental cooking setting having a cooking power setting that is calculated from a previously set cooking power setting.

Preferably, the supplemental cooking setting having a cooking power setting that is equal to a previously set cooking power setting.

Preferably, the cooking settings are user adjustable.

According to an aspect of the invention, there is provided a soft close apparatus for microwave oven, the soft close mechanism including:

a slide element for receiving one or more finger elements of an elongate door retaining arm;

wherein upon receipt of the finger elements, the slide retracts toward a closed configuration;

a damping element act on the slide element to dampen the retraction of the slide element and to thereby dampen closure of the door.

Preferably, the slide element is retained by a pair of parallel opposing groves.

Preferably, the slide element is biased toward the closed configuration.

Preferably, the slide element is biased toward the closed configuration by a spring.

Preferably, the damping element operates to dampen the bias of the slide toward the closed configuration.

According to an aspect of the invention, there is provided a microwave oven apparatus comprising a user interface as herein described.

According to an aspect of the invention, there is provided a microwave oven apparatus comprising soft close mechanism as herein described.

According to an aspect of the invention, there is provided a microwave oven apparatus comprising any one or more: user interface as herein described; and a soft close mechanism as herein described.

BRIEF DESCRIPTION OF THE DRAWING FIGURES

In order that the invention be better understood, reference is now made to the following drawing figures in which:

FIG. 1A-FIG. 1B—are perspectives view of a microwave oven and platter;

Figure 66:
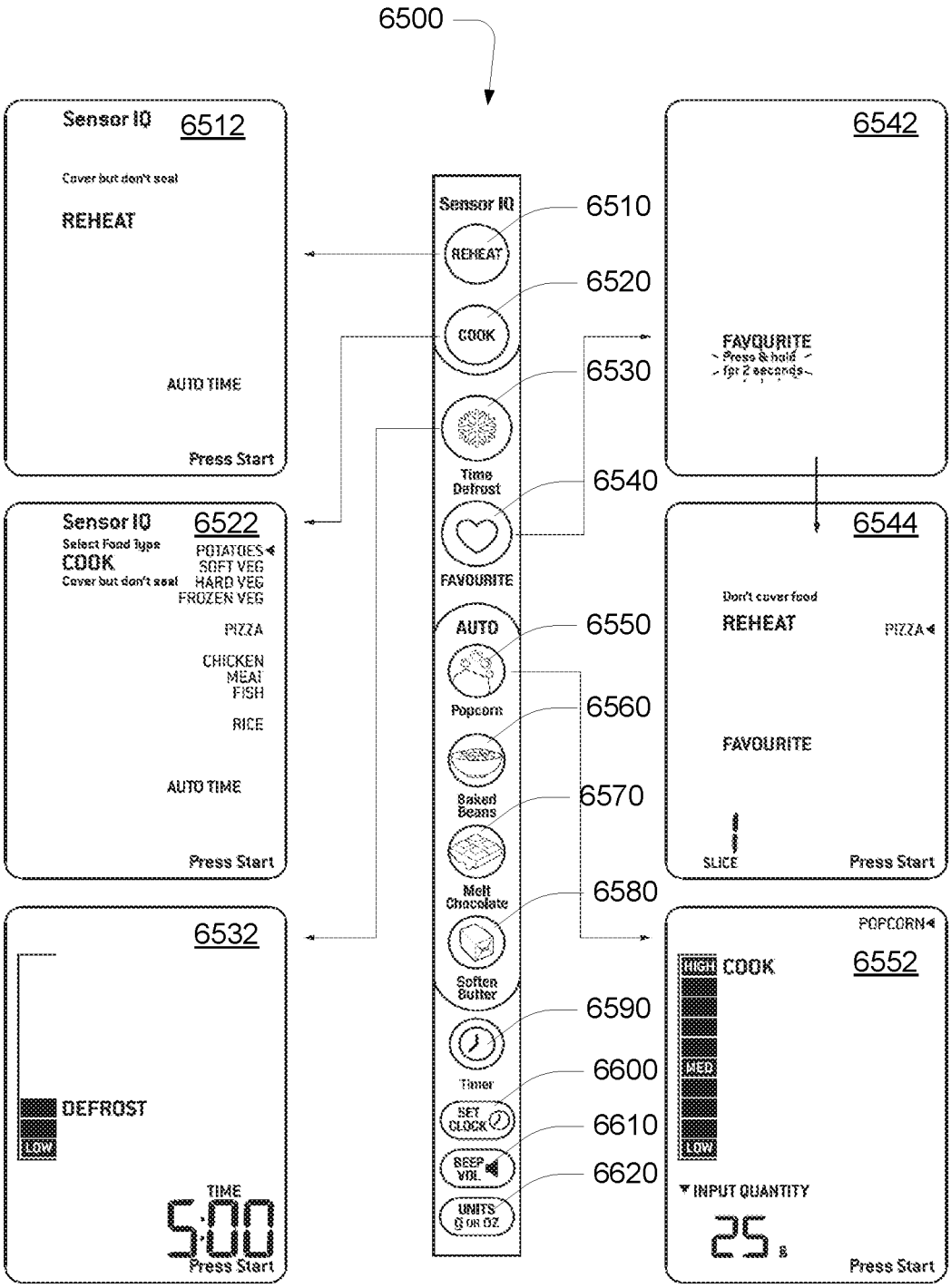
Figure 67:
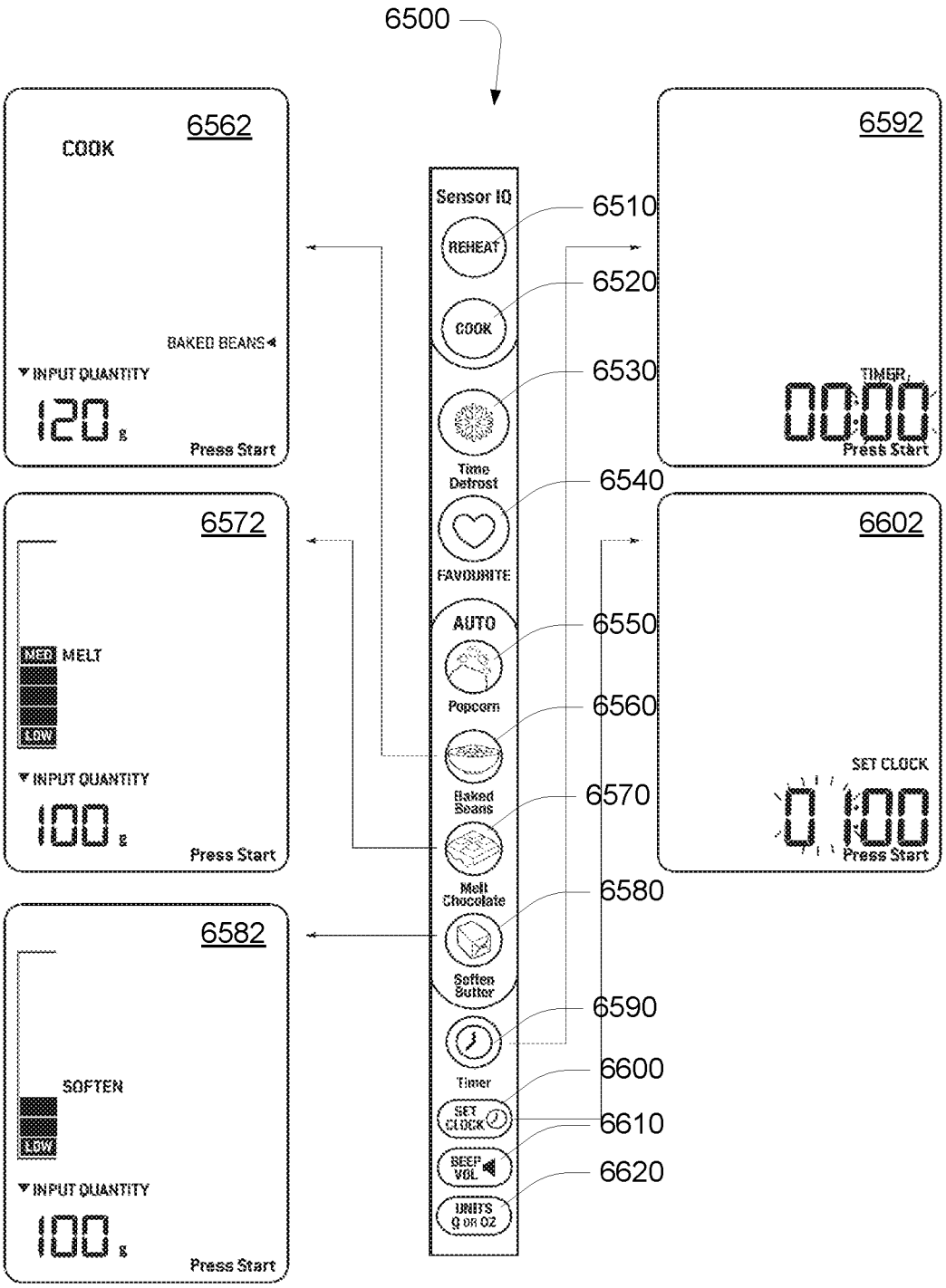
Figure 68:
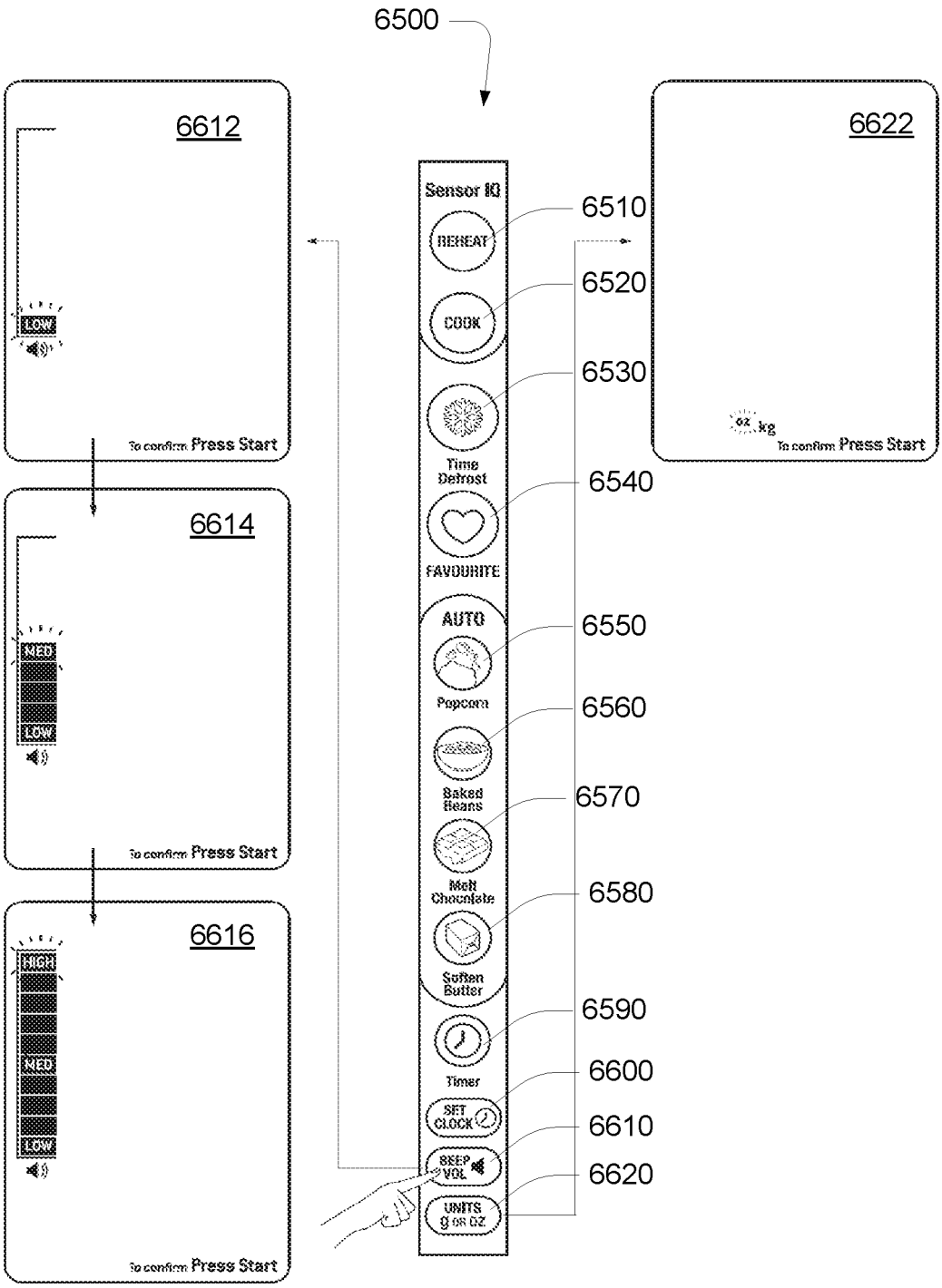
Figure 69:
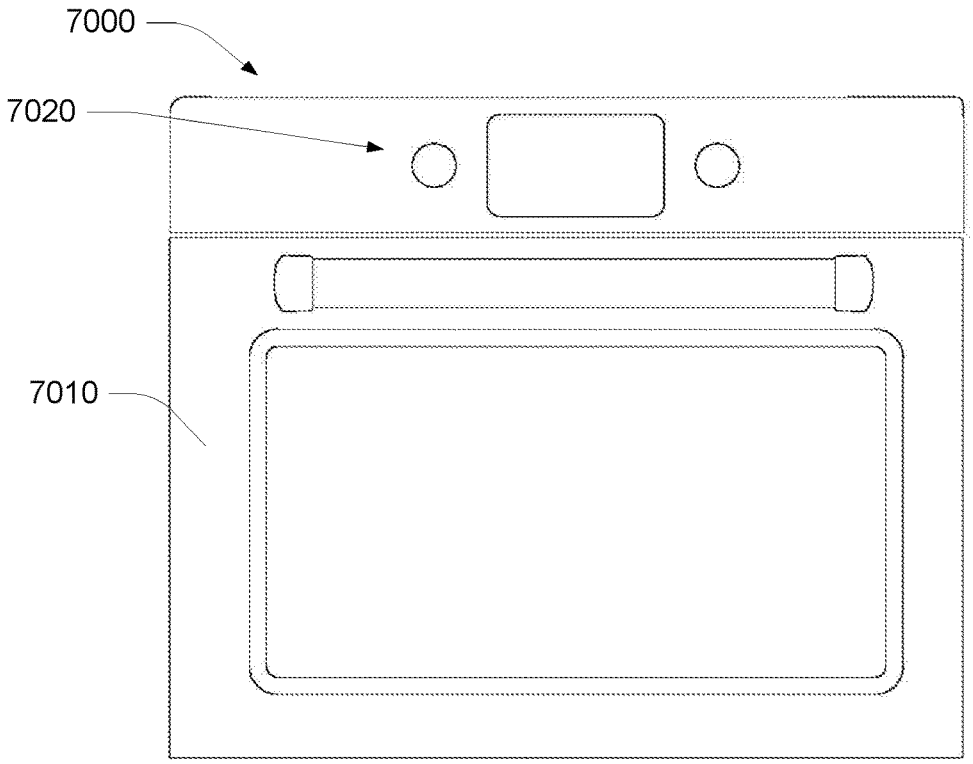
Figure 70:
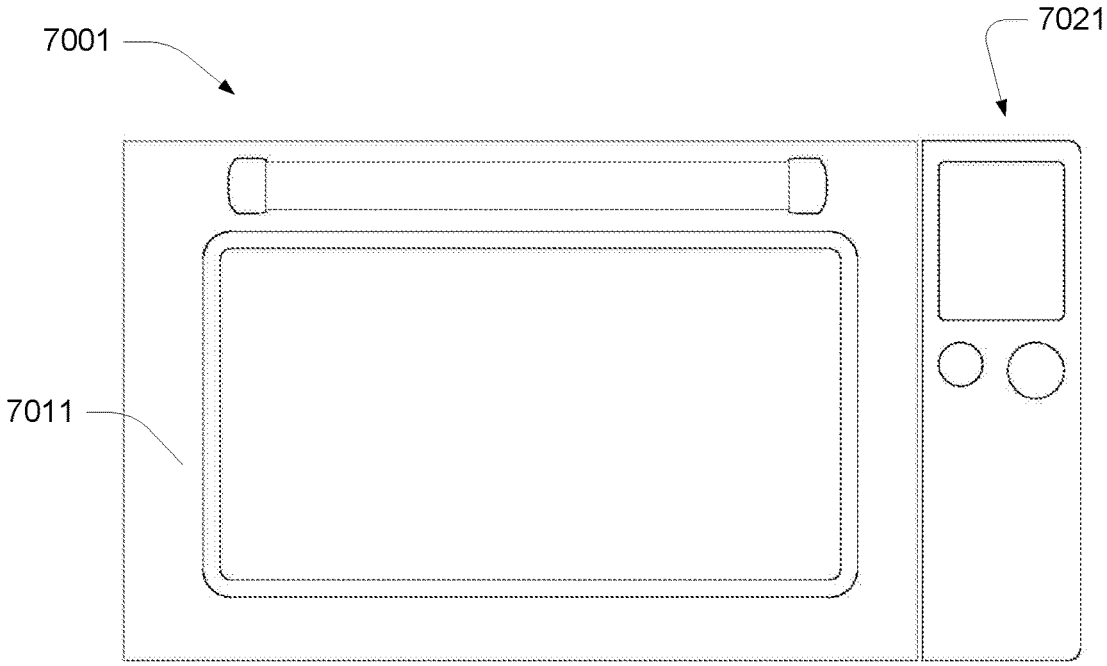
Figure 71:
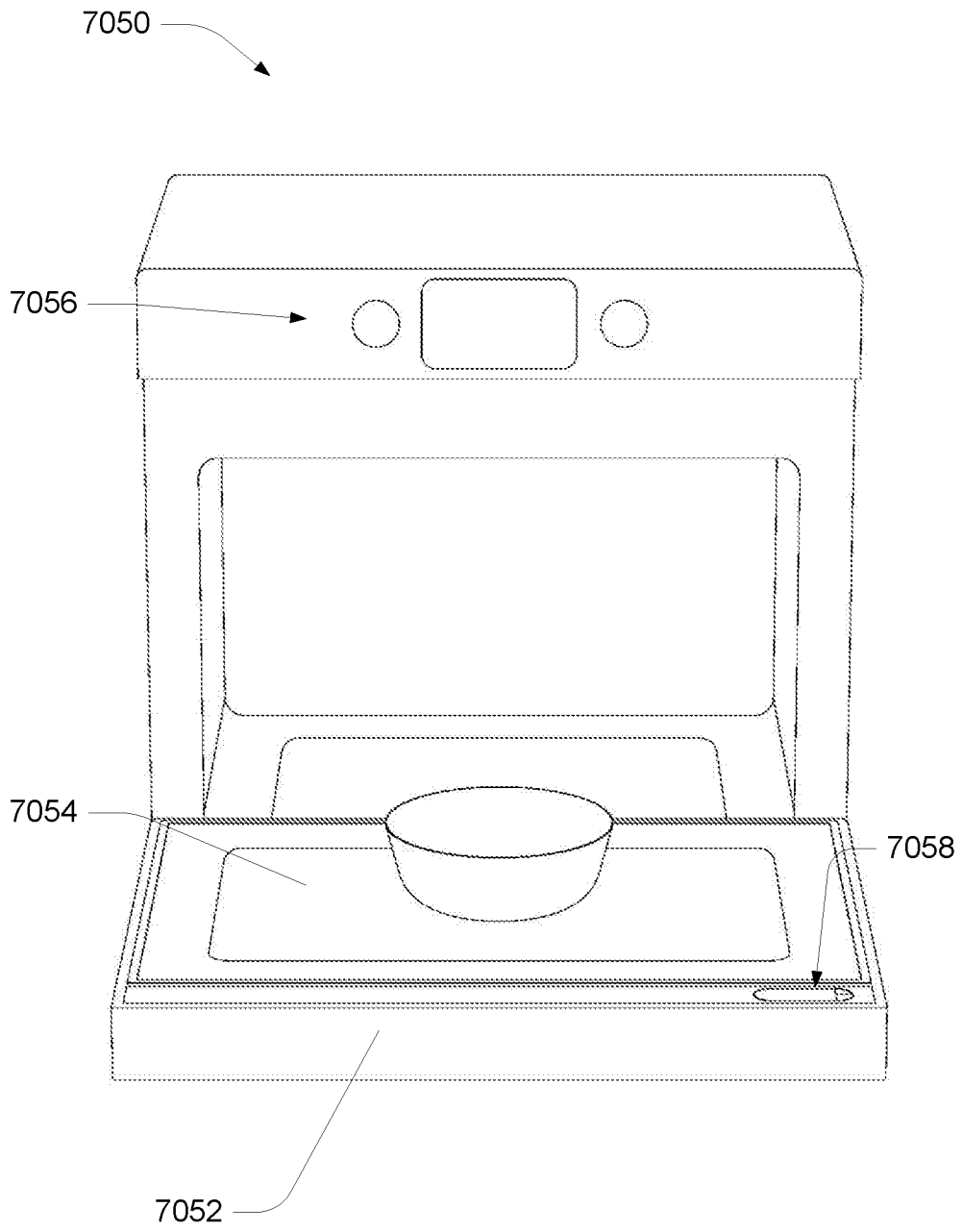
Figure 72:
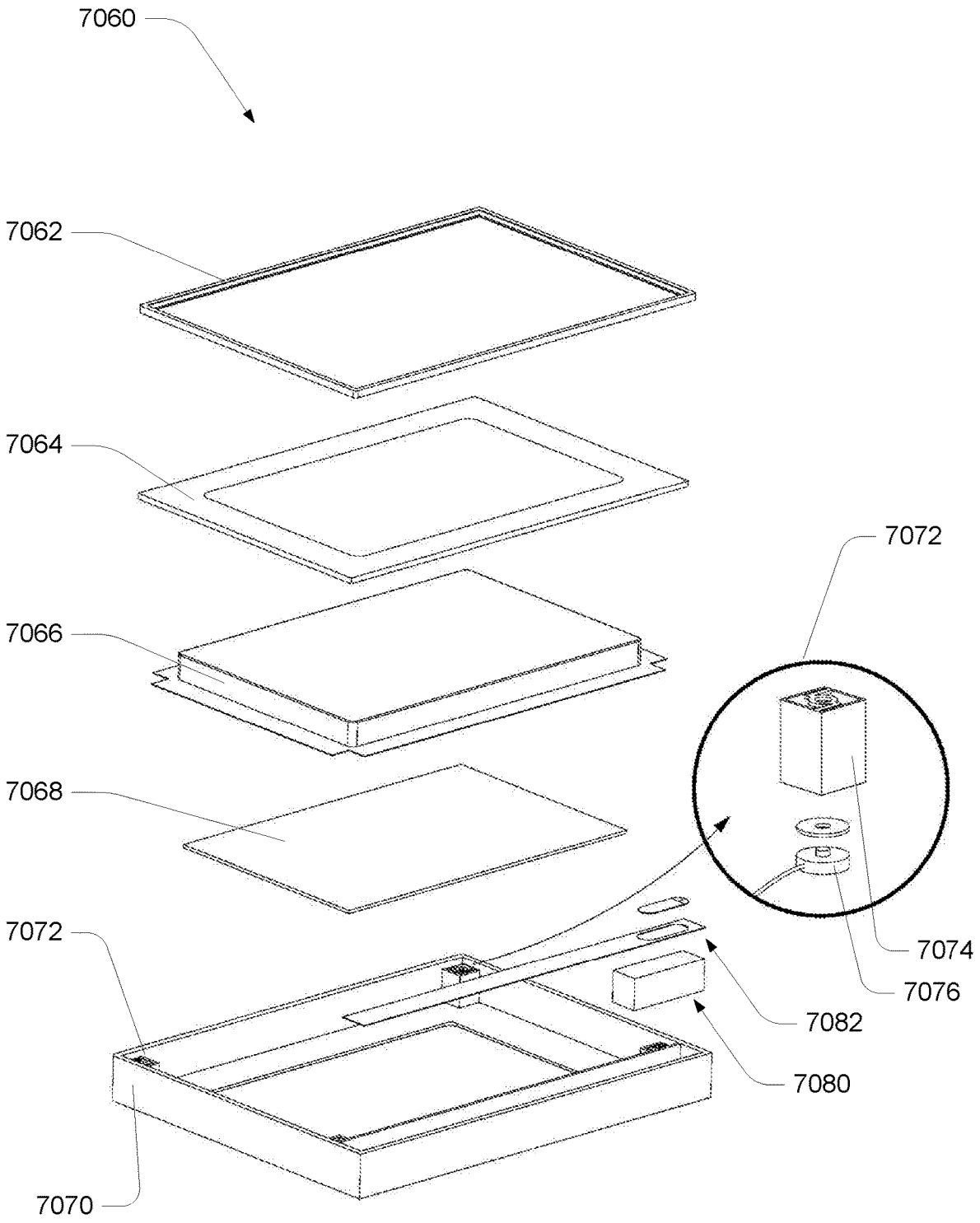
Figure 73:
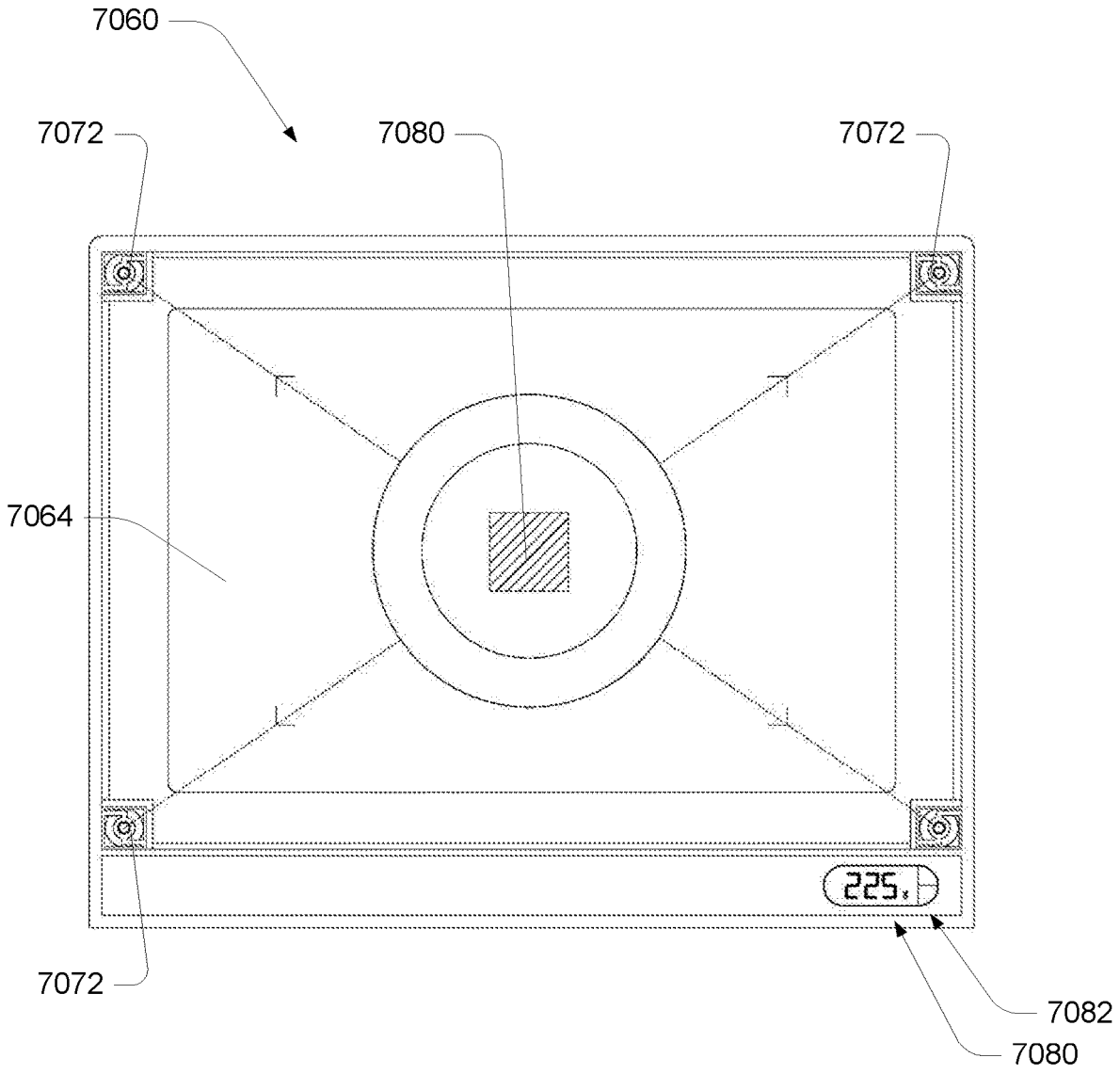
Figure 74:
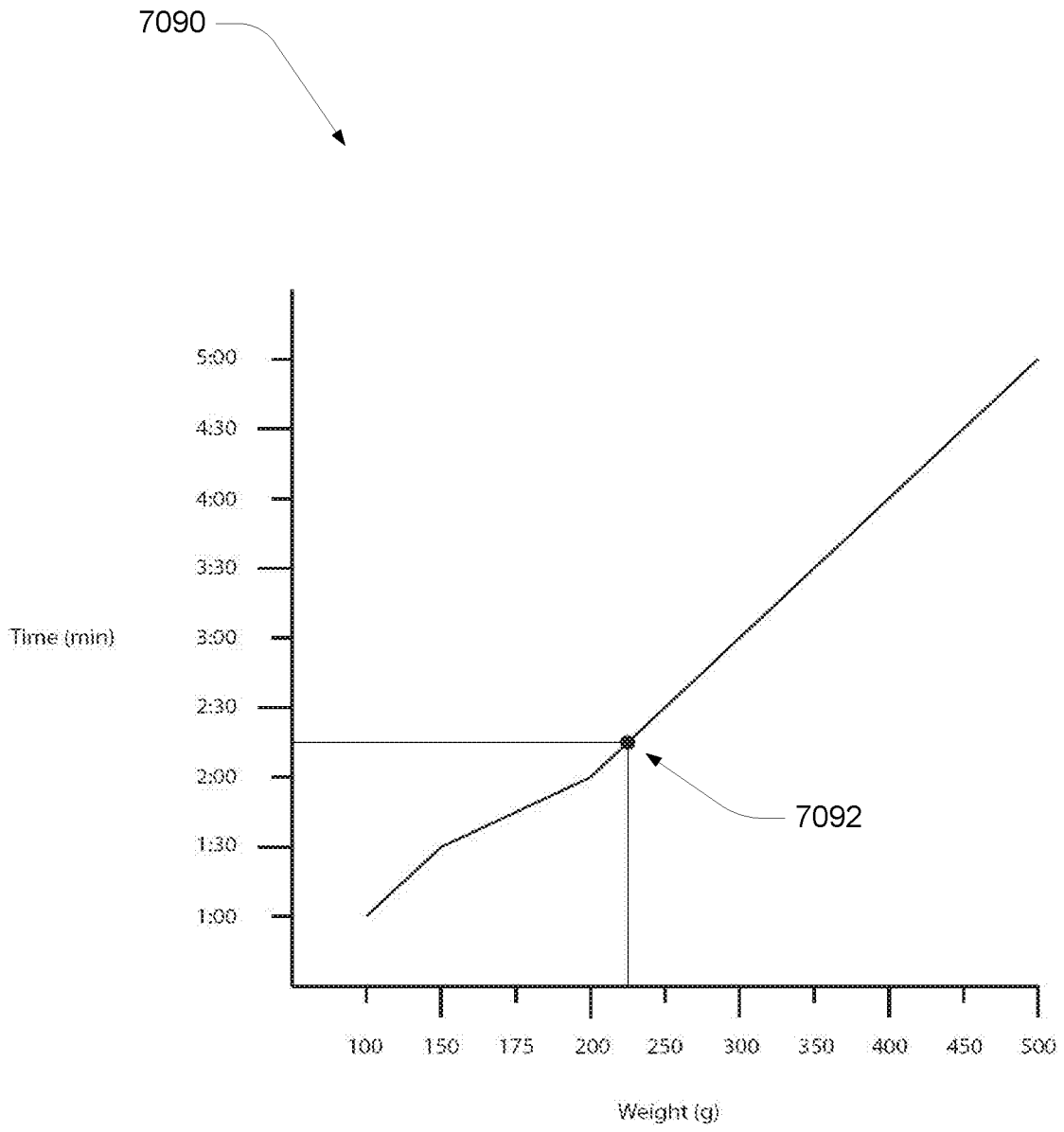
Figure 75:
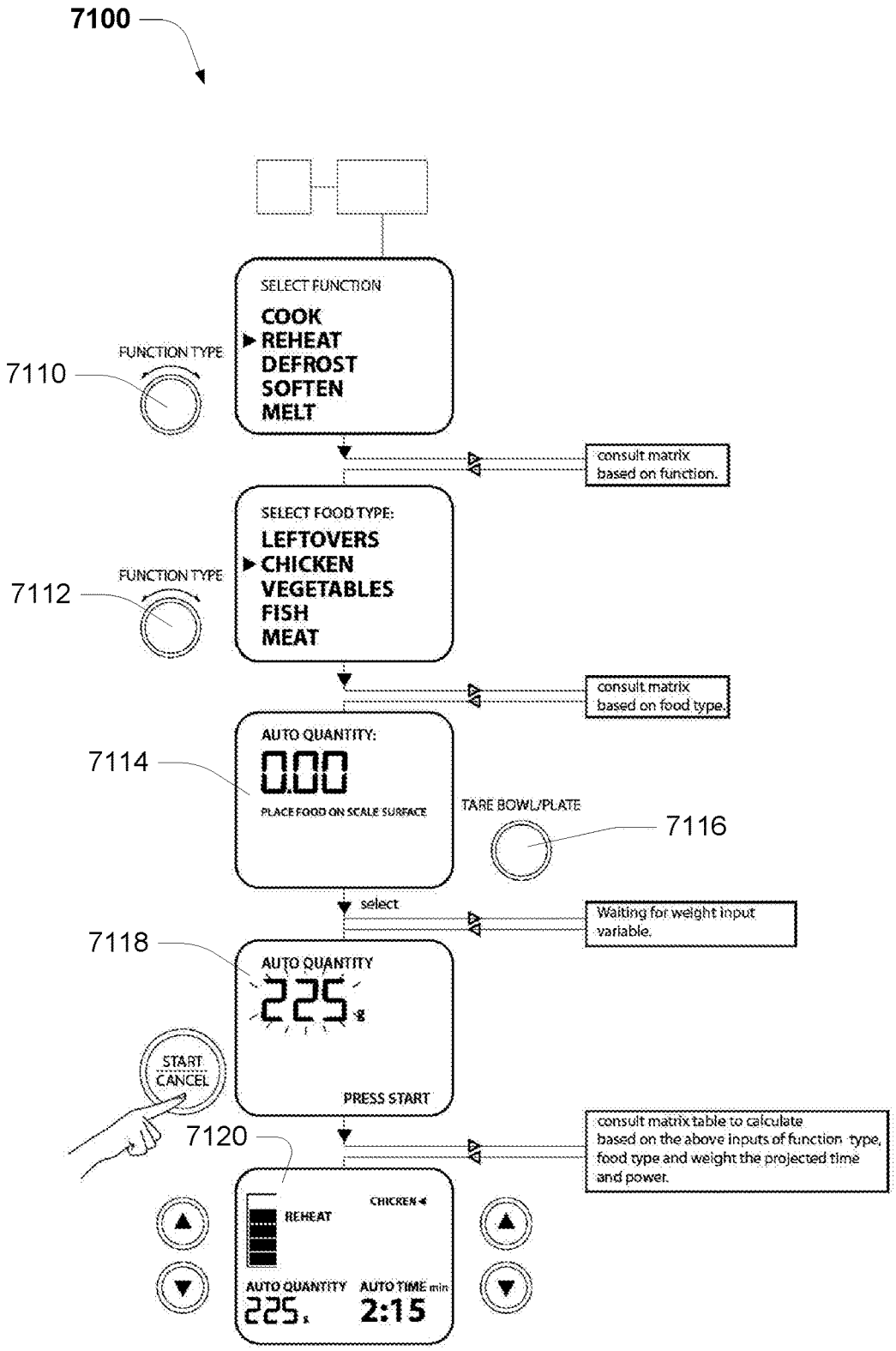
Figure 81:
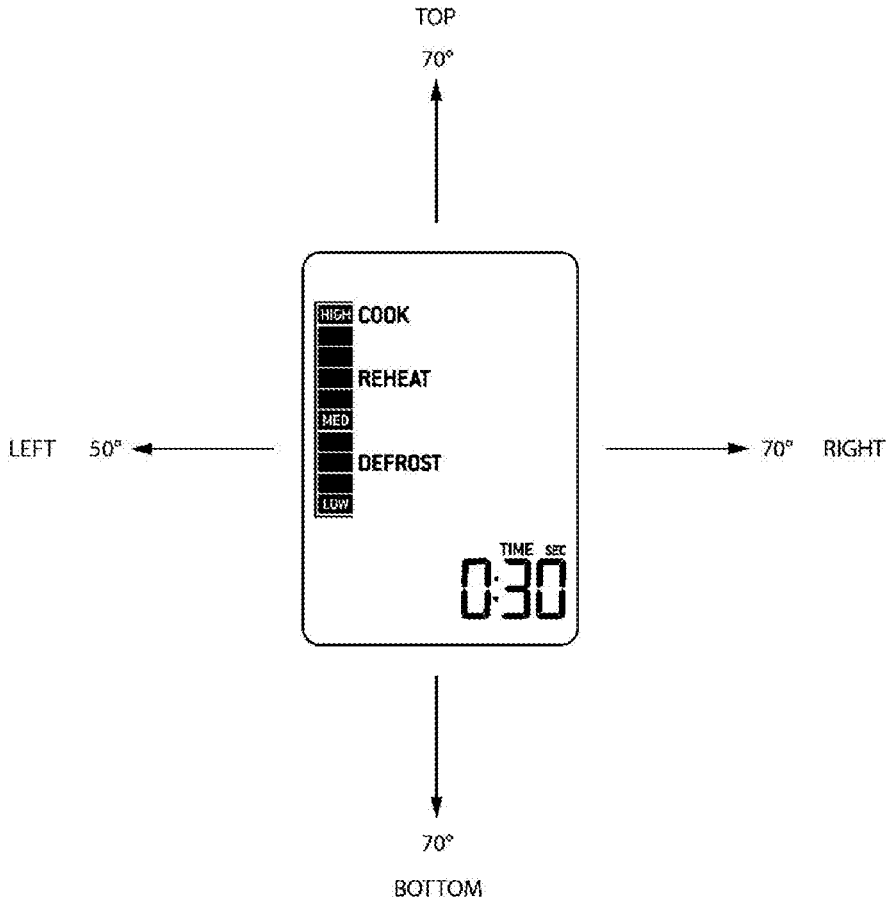
Figure 82A:
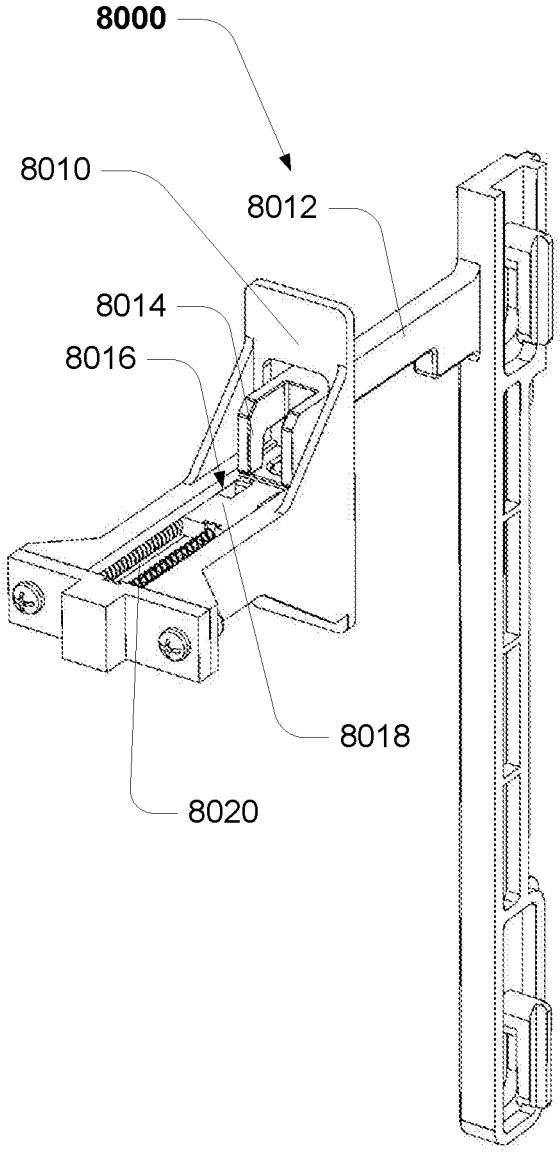
Figure 82B:
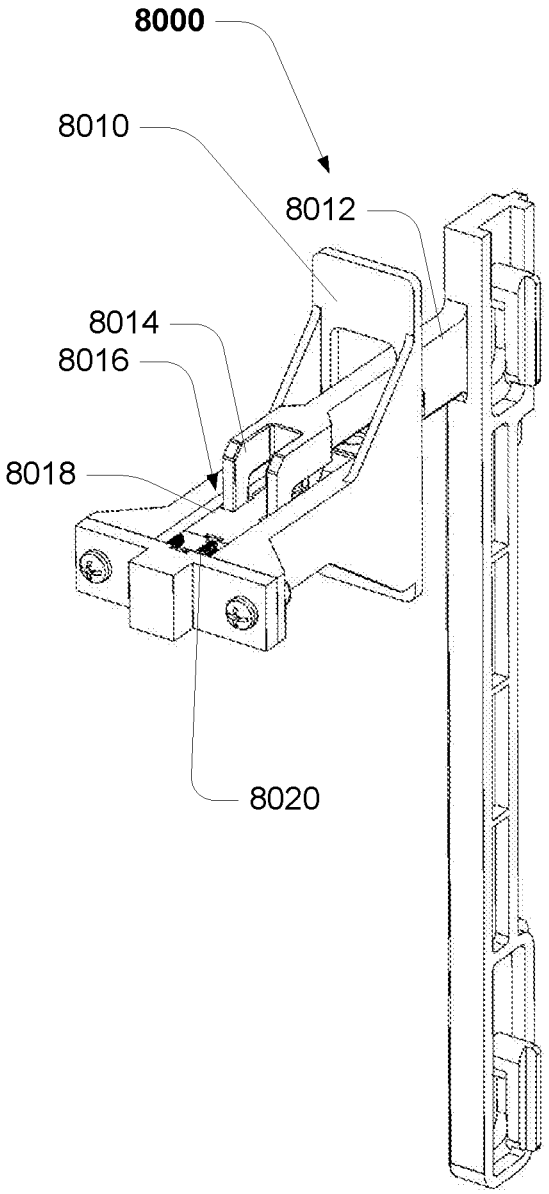
Figure 90:
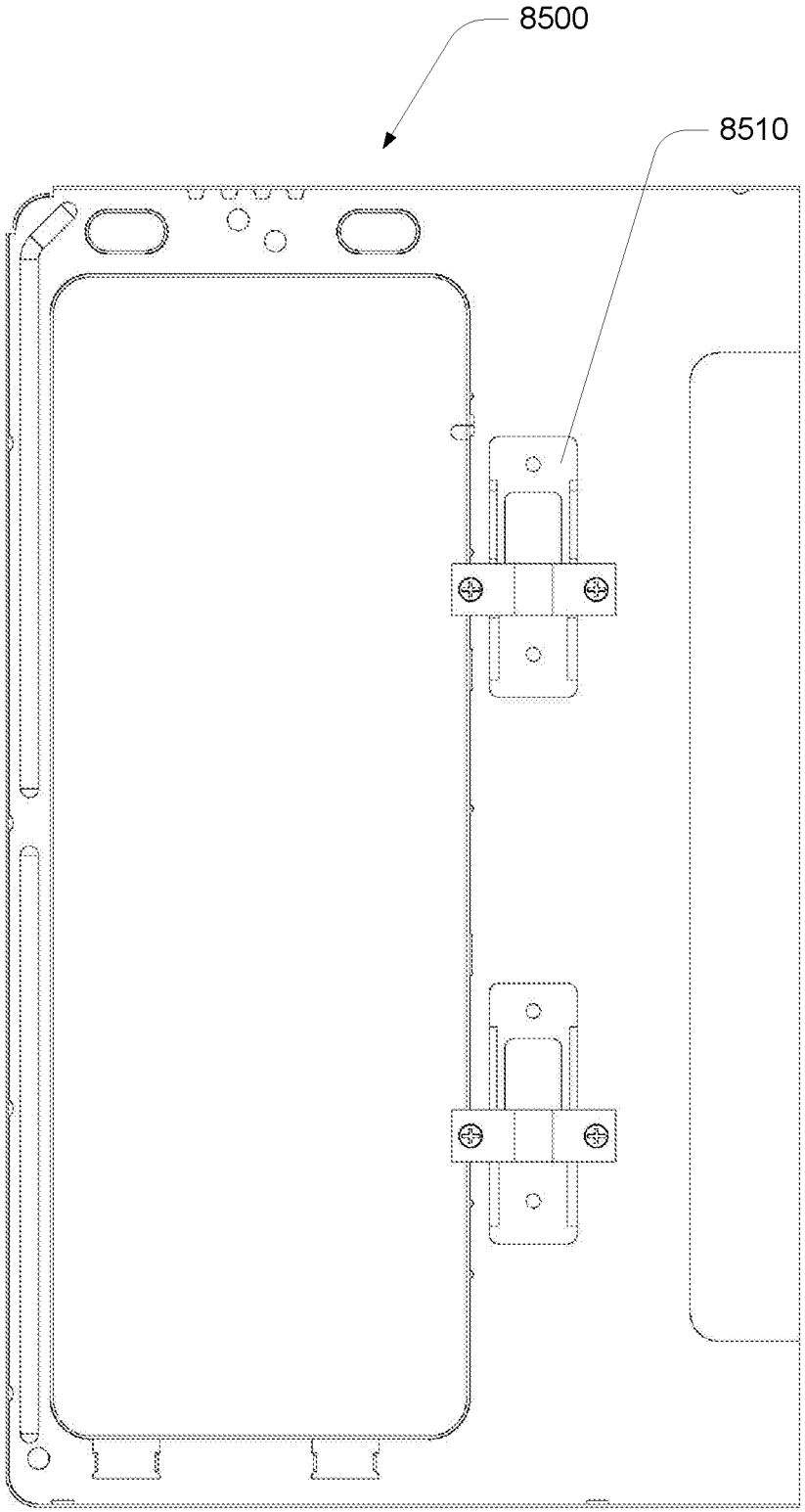
Figure 91:
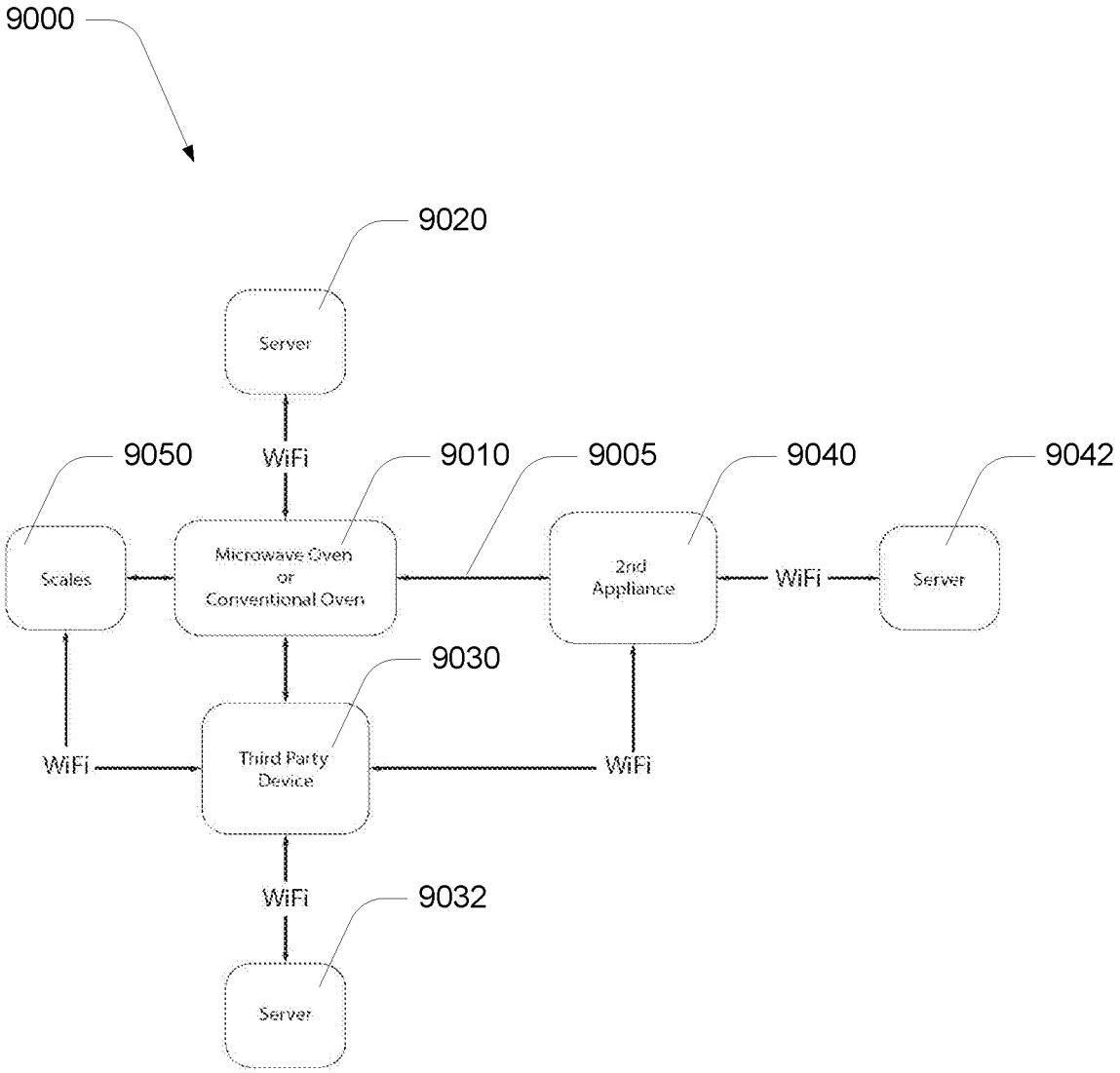

FIGS. 47-51 each show an alternative embodiment user interface;

FIGS. 52-65 show an embodiment user interface;

FIGS. 66-68 show an embodiment user interface including a plurality of shortcut selector elements;

FIGS. 69-71 show embodiment ovens having a scale module;

FIG. 72 is an in-line for assembly view of an oven door having a scale module;

FIG. 73 is a plan view of an oven door having a scale module;

FIG. 74 is a graph associating a food weight to a cooking time;

FIG. 75 show an embodiment user interface that is integrated with a scale module;

FIGS. 76-80 show an embodiment kitchen environment with associated viewing angles to oven locations;

FIG. 81 is an embodiment display element;

FIG. 82A is an embodiment soft close module, shown in a open configuration;

FIG. 82B is an embodiment soft close module, shown in a closed configuration;

FIGS. 83-89 show embodiment soft close modules;

FIG. 90 shows an inside rear view of a typical microwave metal body with fixture brackets; and FIG. 91 shows an embodiment configuration for an oven communicating within a wireless environment.

BEST MODE AND OTHER EMBODIMENTS

Figure 1A:
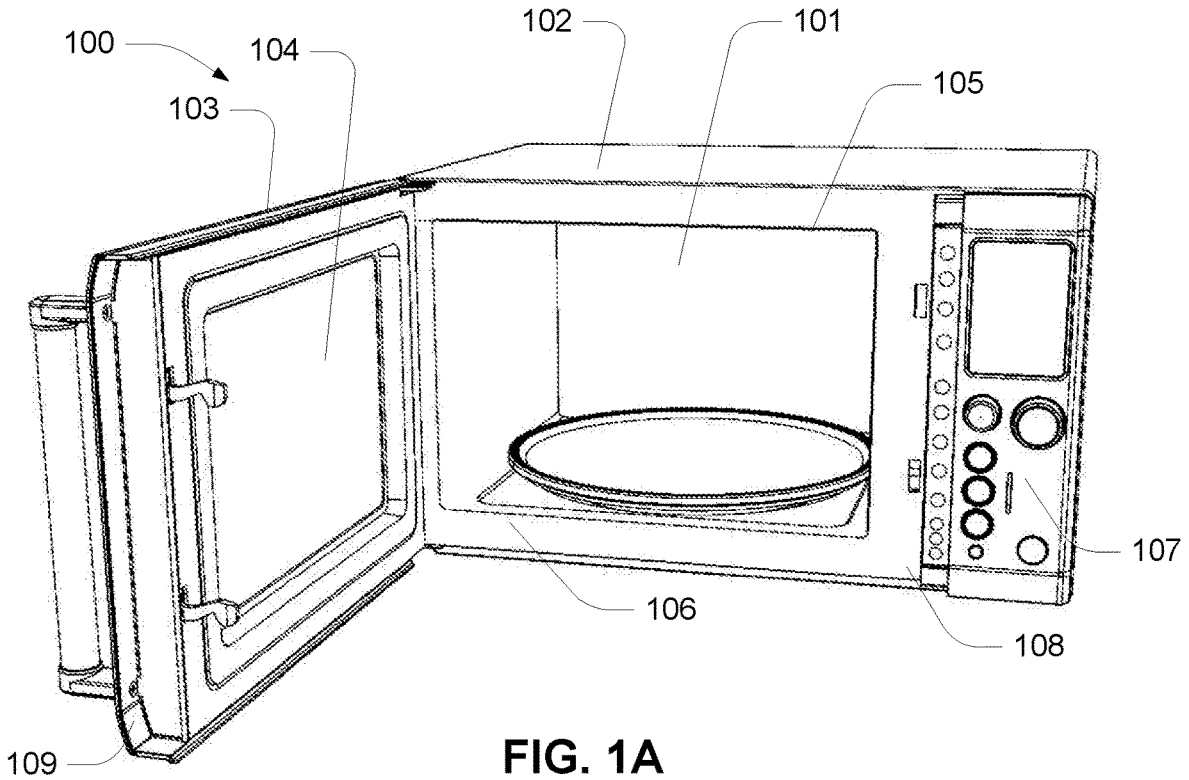
Figure 1B:
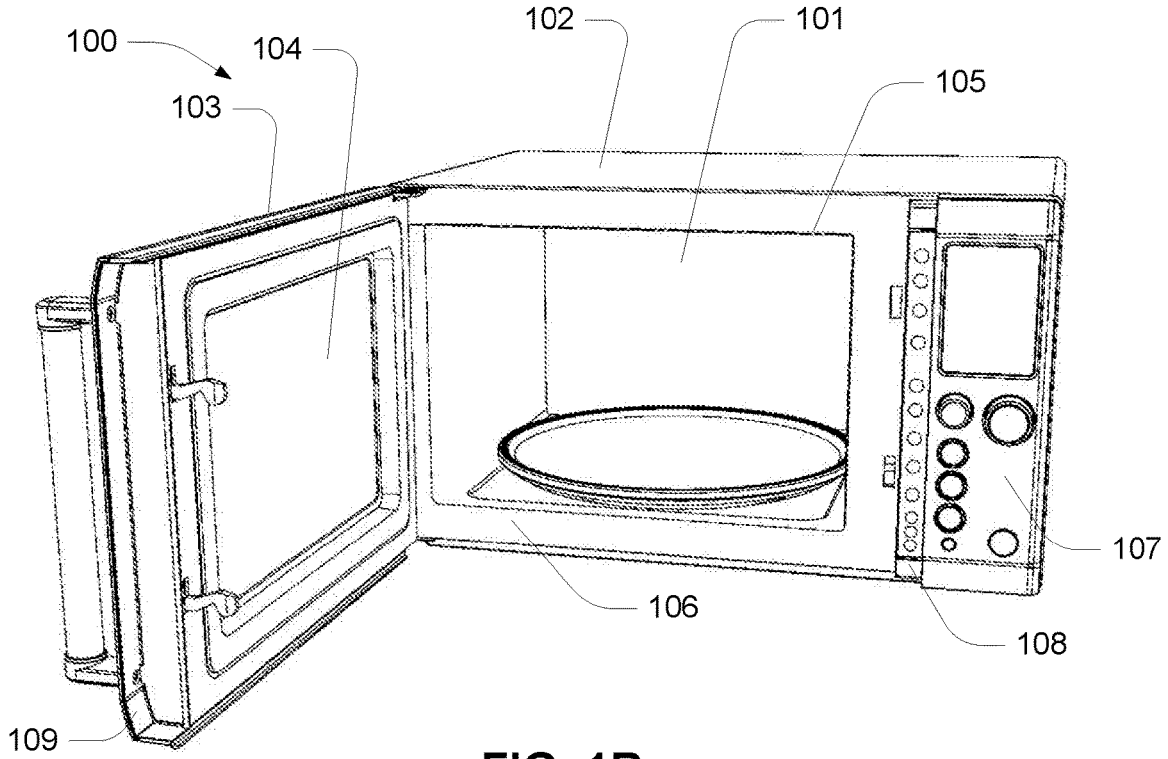

As shown in FIG. 1, a microwave oven 100 comprises a cooking chamber or cavity 101 that is contained within an enclosure or housing 102. The cavity 101 has a hinged door 103 with a central view window 104. The mouth opening 105 of the cavity 101 is surrounded by a flat landing 106 against which the door 103 closes and seals. The landing 106 is recessed with respect to the oven's user interface 107. When the oven door 103 is closed, the front surfaces of the door 103 and the interface 107 are generally flush. The oven 100 also provides an auxiliary controls 108 that are adjacent to the opening 105 and recessed with respect to the front surface of the user interface 107. The controls 108 are covered by a rim 109 of the free edge of the door 103, when the door is closed. As will be explained, the auxiliary control panel 108 comprises flush switches that provide enhanced control over the oven. In preferred embodiments, membrane type switches are used on the auxiliary panel 108.

Figure 2A:
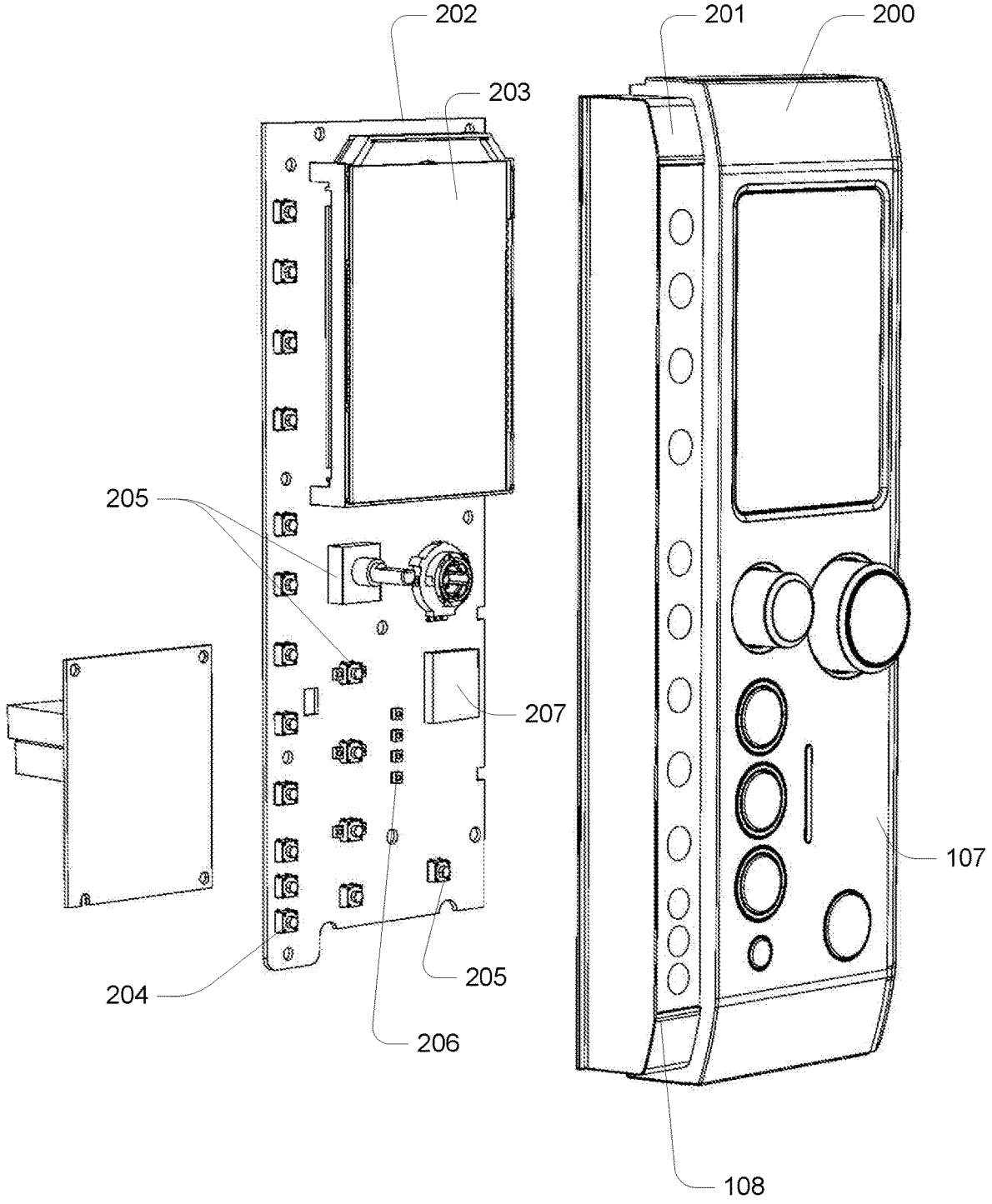
FIG. 2A-FIG. 2B is an exploded perspective view of a user interface, the printed circuit board and processor that governs the operation of the oven, its controls and display.
Figure 2B:
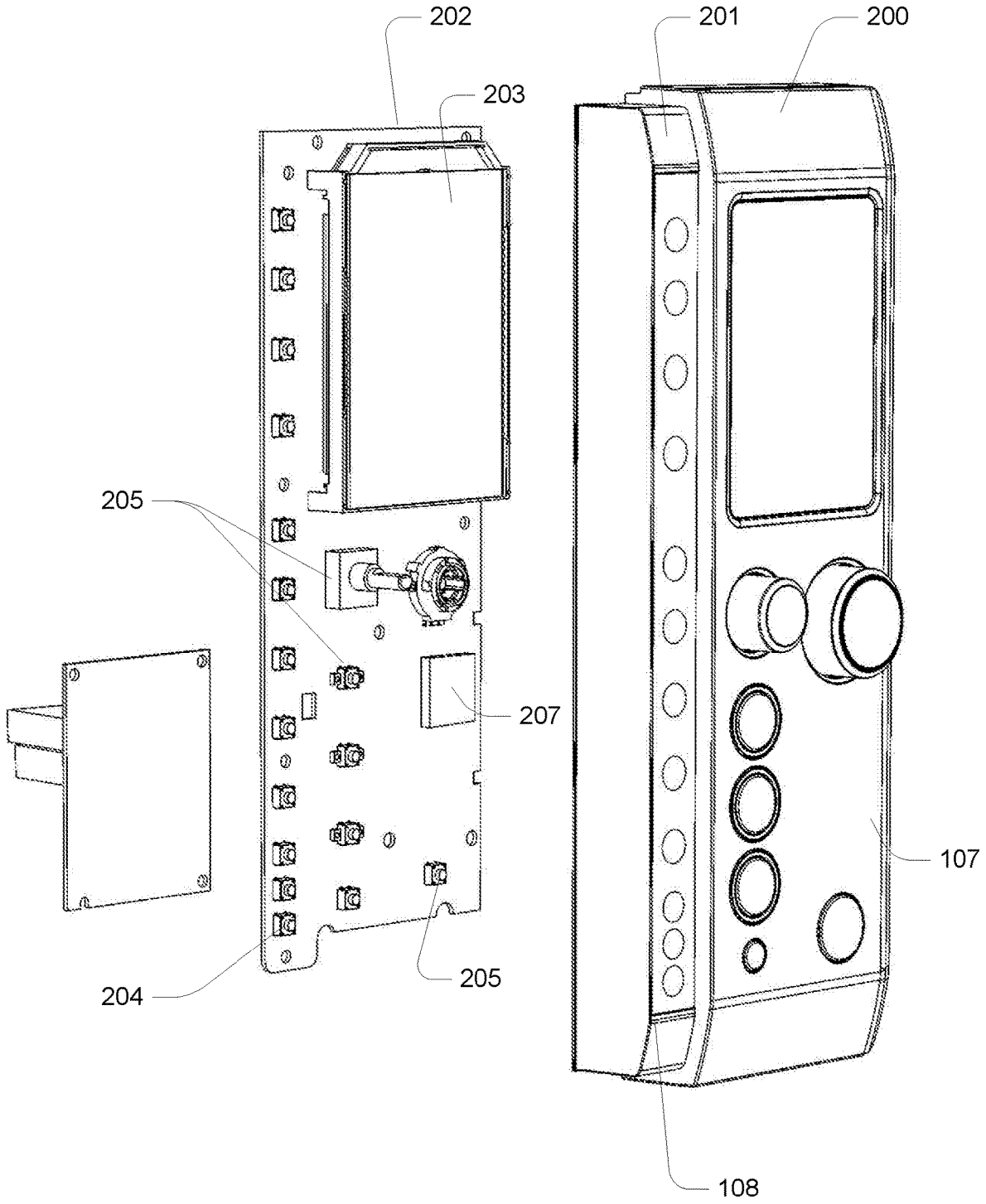

As shown in FIG. 2, the user interface 107 comprises a cover 200 that incorporates the recessed portion 201 onto which a membrane 108 is mounted. The electronic components required to execute the user interface and auxiliary controls are contained on (preferably) a single printed circuit board 202. The circuit board further comprises the oven's processor 207, a graphic display panel 203, the switches 204 that cooperate with the membrane 108, the switches and controls 205 that are required by the mechanical aspects of the interface 107 and indicators such as LED indicators 206 that are visible through the front surface of the user interface 107.

Figure 3:
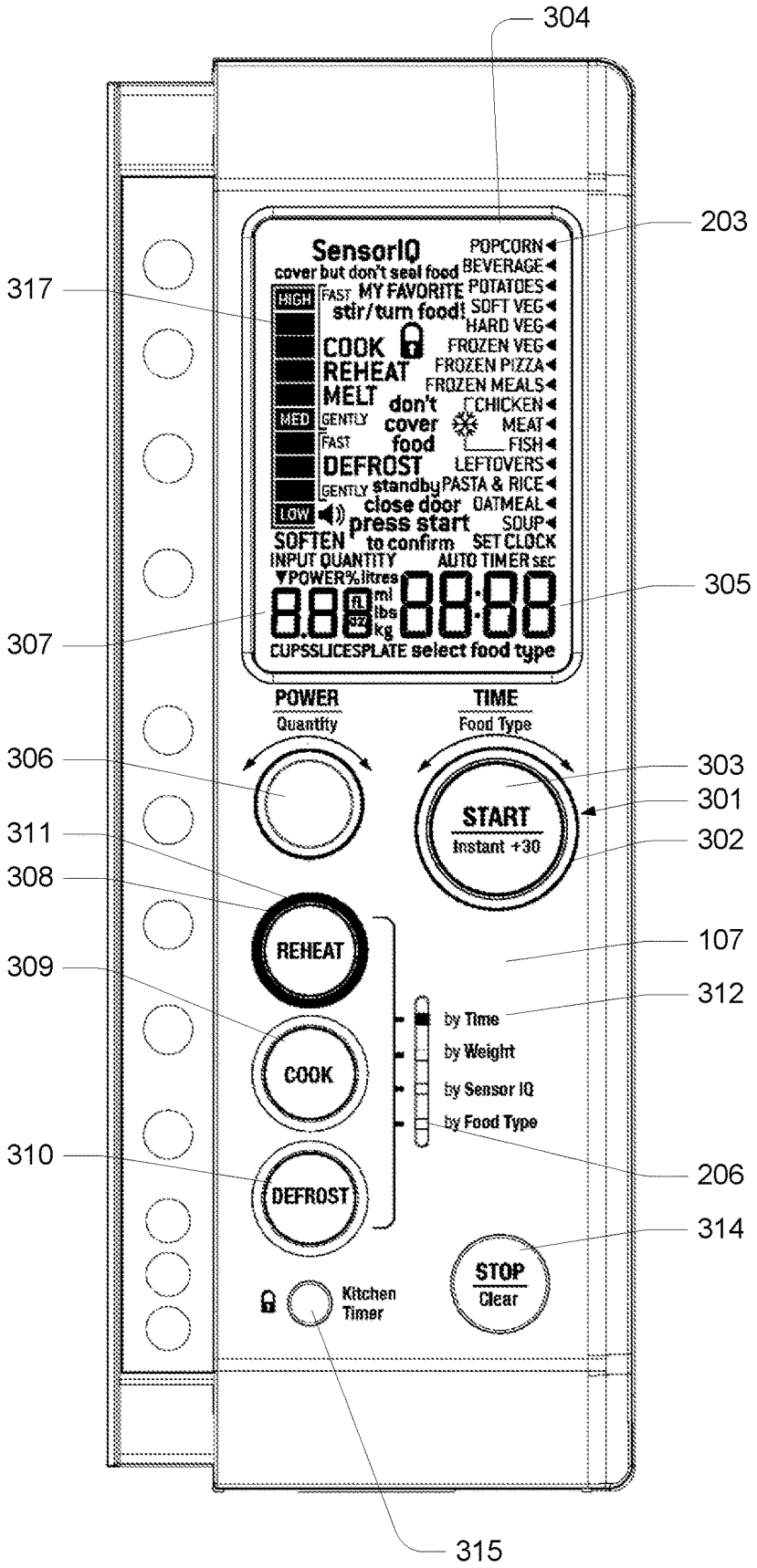
FIG. 3 is a plan view of a user interface and display.

As shown in FIG. 3, the graphic display 203 is located at the top of the user interface 107. Below the lower edge of the display 203 is located a user control or dial 301 having a rotating periphery 302 and a central push button 303. Depressing the central "Start" portion 303 starts the working of the microwave oven in accordance with the other settings. Rotating the peripheral portion 302 causes a sequential scrolling through a list of food types 304 that appears in a vertical list at the right hand margin of the display 203. The same peripheral portion 302 is used to adjust the cooking time. Cooking time is displayed as a countdown in real time, even as the other controls are operated, in numerals 305 that are located on the display 203 adjacent to and above the control 301, in this example, at a lower right hand corner of the display 203. The peripheral portion 302 can be rotated either clockwise or anti-clockwise to increase or reduce the cooking time. The numeral 305 are larger than any other letters or numerals that appear in the display 203.

A second rotating knob or dial 306 is can be turned in both directions to increase or decrease either the power delivered by the microwave oven or a food quantity when a user input of food quantity is required. A numerical representation of the power or quantity is displayed as the knob 306 is operated in the numeric characters 307 located above the control 306. In this example, the numerals 307 appear in the lower left hand corner of the display 203. The left-right orientation of the controls 301, 306 and their corresponding displays 305, 307 may be reversed.

In many embodiments the cooking time or food quantity selector 306 can be operated prior to initiating a cooking cycle with the device's processor recalculating and displaying the resulting cooking time 305 in real time, before cooking starts. In some modes, the recalculated cooking time is displayed but can not be changed by the user until the 'Start' button is pressed to initiate actual cooking.

Directly below and in vertical alignment with the control 306 are three push buttons 308, 309, 310, each having a circular, surrounding, illuminated indicator 311. These three push button controls 308, 309, 310 allow the user to select one of the three basic functions of the oven, being reheat 308, cook 309 or defrost 310. The corresponding function selections are displayed, for example in a central portion of the display 203. For each of the three primary function controls 308, 309, 310 there are four different modes, each mode being selected by a user by repeated pressing of the appropriate selector 308, 309, 310. Repeated pressing of a selector causes a mode sub-selection, allowing the user to elect whether the cooking function will be governed by the user input of a time of cooking, a weight of food, through the use of a humidity sensor, or food type. Each of these four mode sub-selections is represented by a visual indicator 206. In this example, four sub-indicators 206 are used to designate each of the four possible mode sub-selections. The sub-indicators appear in vertical alignment next to printed labels 312 that correspond to the sub-selection. The selected oven power is optionally displayed in a bar or strip or strip type display ("bar") 313 located, in this example, along a left hand margin of the display 213, preferably above the power and quantity control knob 306. the bar 313 may be used to display power when the numeric segments 307 are either not in use, or displaying a quantity.

The user interface also comprises a "stop or clear" push button control 314 that is located below all of the aforementioned controls. Also located below the other controls is a smaller dual purpose button 315 that activates either a kitchen timer, or when depressed for a longer interval of time, a lock that disables and re-enables the user interface.

Figure 4:
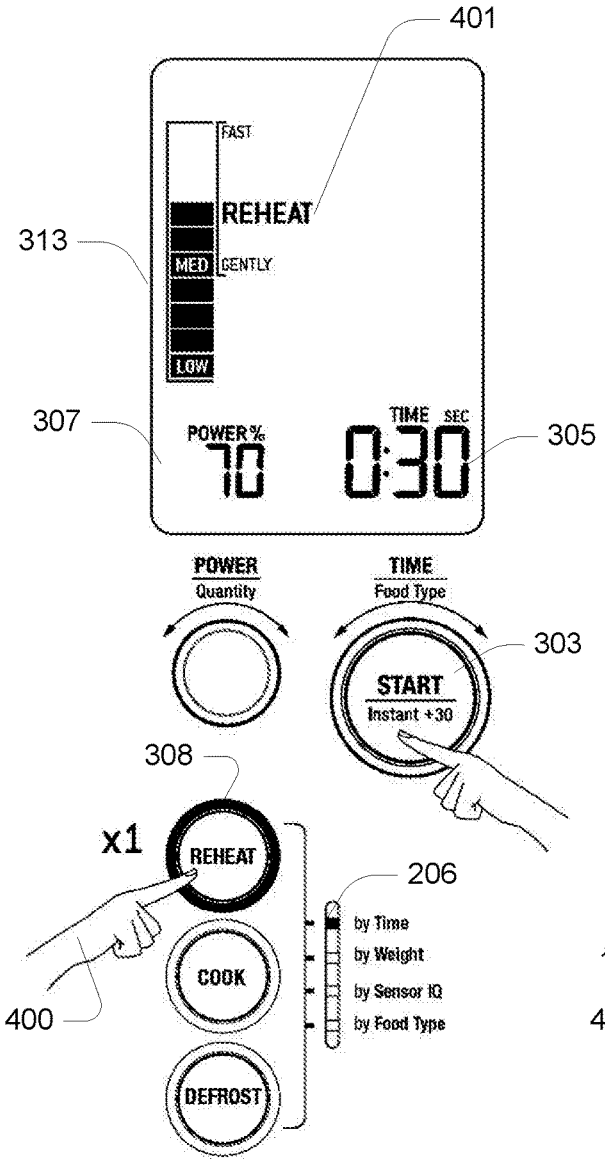
FIGS. 4-7 are schematic diagrams illustrating the use of the user interface in the context of a re-heat function.
Figure 5:
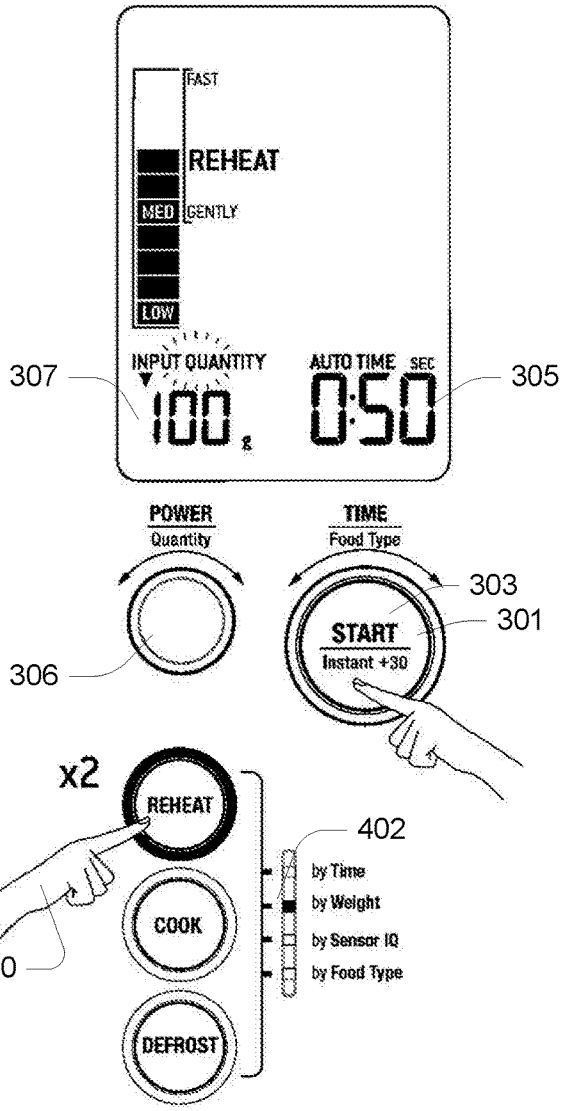

FIGS. 4-7 illustrate how the interface is used in the reheating of food in the microwave oven. As shown in FIG. 4, a user 400 depresses the reheat control 308 once thus illuminating the uppermost "by Time" segment of the indicator 206. This alerts the user to the fact that the reheating will be done in accordance with a selected time interval or in time mode. In this example, the numeric power indicator 307 indicates 70% and the graphic bar display ("bar") 313 has a corresponding number of segments activated or illuminated. The name of the function "REHEAT" 401 is displayed adjacent to the bar 313. The default time of 30 seconds is displayed by the time indicator 305. This time can be adjusted and re-displayed in real time using the outer ring 302 of the control 301. The user 400 presses the central portion 303 of the control 301 to initiate the reheat in accordance with the displayed time 305. Even after the cooking cycle has commenced the user can change the power or the time by turning the dials.

If the user 400 were to press the reheat control 308 twice successively, the indicator 206 would illuminate a second "by Weight" LED segment 402 of the indicator 206, alerting the user that the reheat function would be accomplished in accordance with a selected weight of food or weight mode. Because the reheat selector had been pressed twice successively, the quantity indicating portion of the display 307 will indicate a default quantity of e.g. 100 grams or another quantity selected by the user by rotating quantity selector knob 306. A default time of, for example, 50 seconds is displayed by the time indicator 305. In the "by Weight" mode, time can be adjusted only after the 'start' button has been pressed. Depressing the central portion 303 of the control 301 initiates a reheat by the selected weight or quantity of food. The list 304 is preferably not displayed in this example, when the user changes the food quantity using the quantity selector 308, the cooking time is changed in real time by the microwave's controller and the new time is displayed by the time indicator 305. The advantage of this is that the user can see what time the controller has predicted for the given weight before pressing 'start'.

Figure 6:
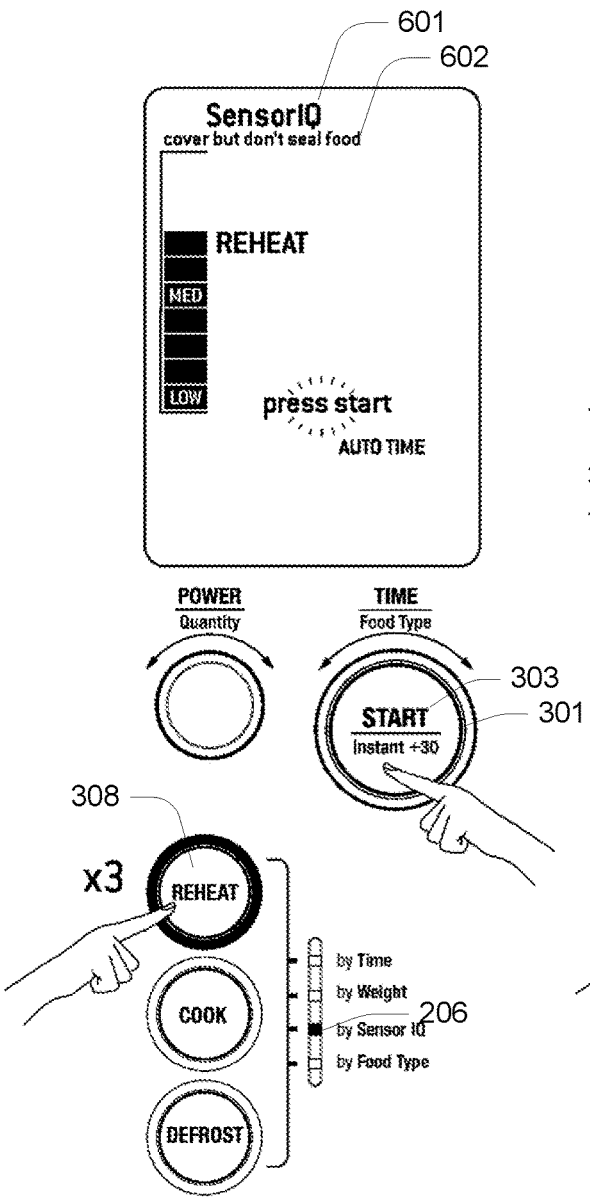

As shown in FIG. 6, depressing the reheat control 308 three consecutive times changes the function to reheat in accordance with the output of a humidity or steam sensor. This "by SensorIQ" mode is indicated by a third LED segment of the indicator 206. In this example, the display shows the term "SensorIQ" 601 and provides the user with a graphic instruction 602 to cover but not seal the food being cooked. The power level of the oven is automatically set and the bar 313 indicates the default power. The quantity and time numeric segments 305, 307 are not displayed. In this mode, the user need only depress the central portion 303 of the control 301 in order to initiate a reheating in accordance with the sensor output.

Figure 7:
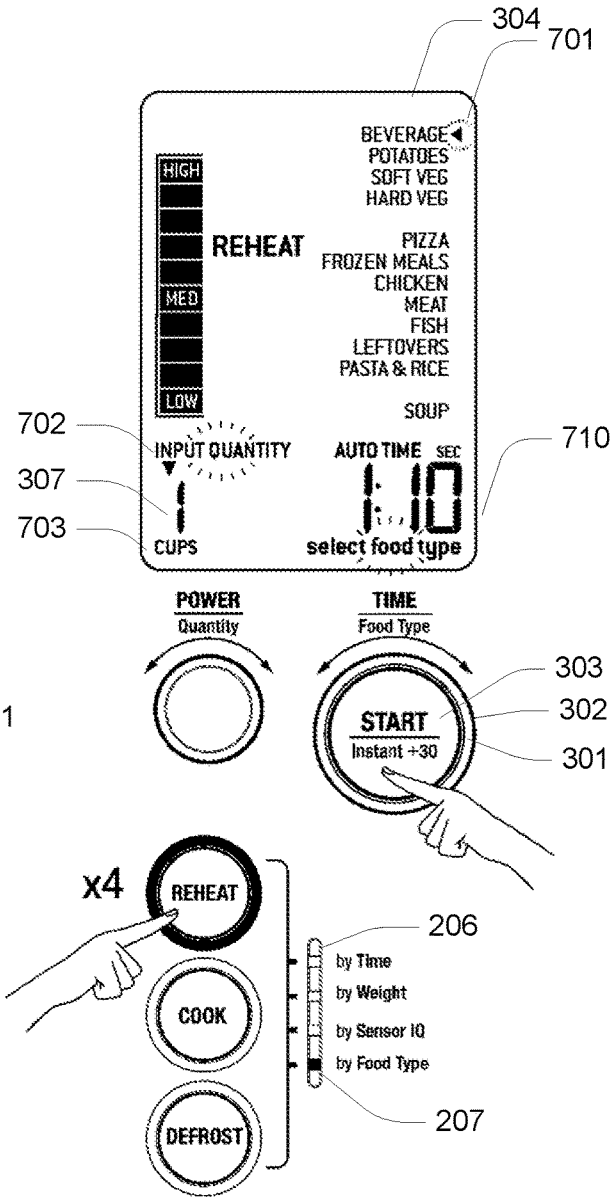

As shown in FIG. 7, depressing the reheat control 308 four consecutive times causes the mode of the reheat function to change to reheating in accordance with food type. This causes a fourth "by Food Type" segment 207 in the indicator 206 to be illuminated, indicating to the user that the reheating will be accomplished in accordance with a selected food type or food type mode. The food type selection is made by the user by rotating the outer ring or outer portion 302 of the control 301. Rotation, in either direction, of the peripheral portion 302 causes an arrow 701 to appear adjacent to one of the items in the vertical list of food types 304. In this example, the display indicates a food quantity in the quantity display 307. The quantity display 307 also shows the words "input quantity" 702 alerting the user to the fact that the default quantity is one and that the unit of that quantity is "cups" 703. The quantity type 703 is displayed below the numeric indication of quantity 307. The quantity is selected by rotation of the quantity selector 306. Once the food type and quantity are selected, the actual operative cooking time is displayed in real time 710 and the user need only depress the central portion 303 of the control 301 to initiate cooking.

Figure 8:
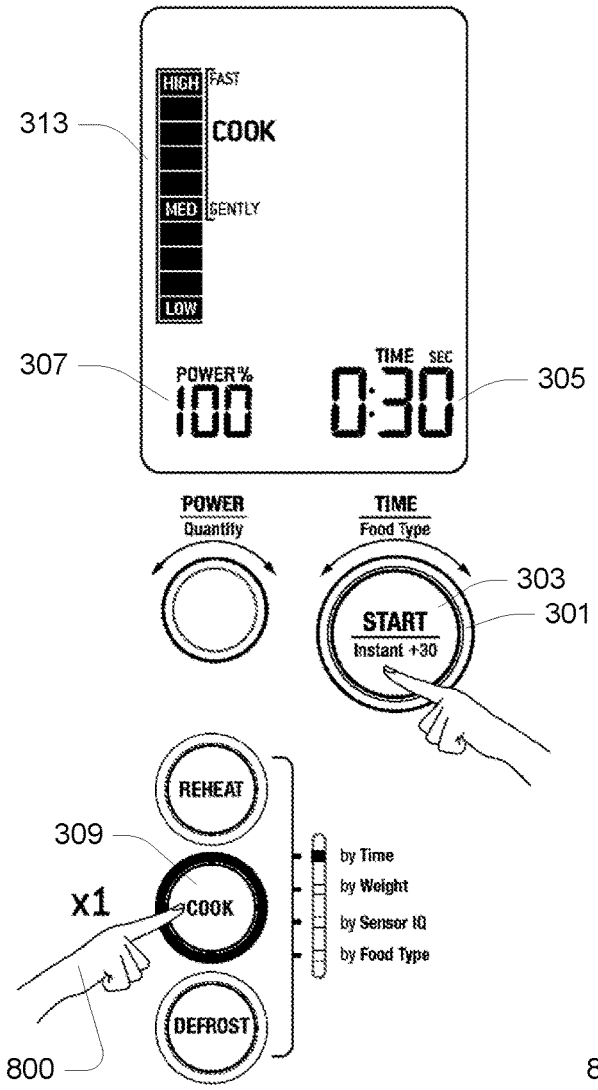
FIGS. 8-11 are schematic diagrams illustrating the use of a user interface in the context of a cook function.

FIGS. 8-11 illustrate how the cook function is used in four different modes. As shown in FIG. 8, the cook "by Time" mode is initiated by the user Boo depressing the cook selector 309 once. This causes the power indicator 307 to display the default 100% setting and the time indicator 305 to display the default time of 30 seconds. The bar display 313 has all segments activated indicating 100% power. Cooking is initiated by depressing the central part 303 of the control 301. User changes to the power or time are displayed 313, 307, 305 in real time.

Figure 9:
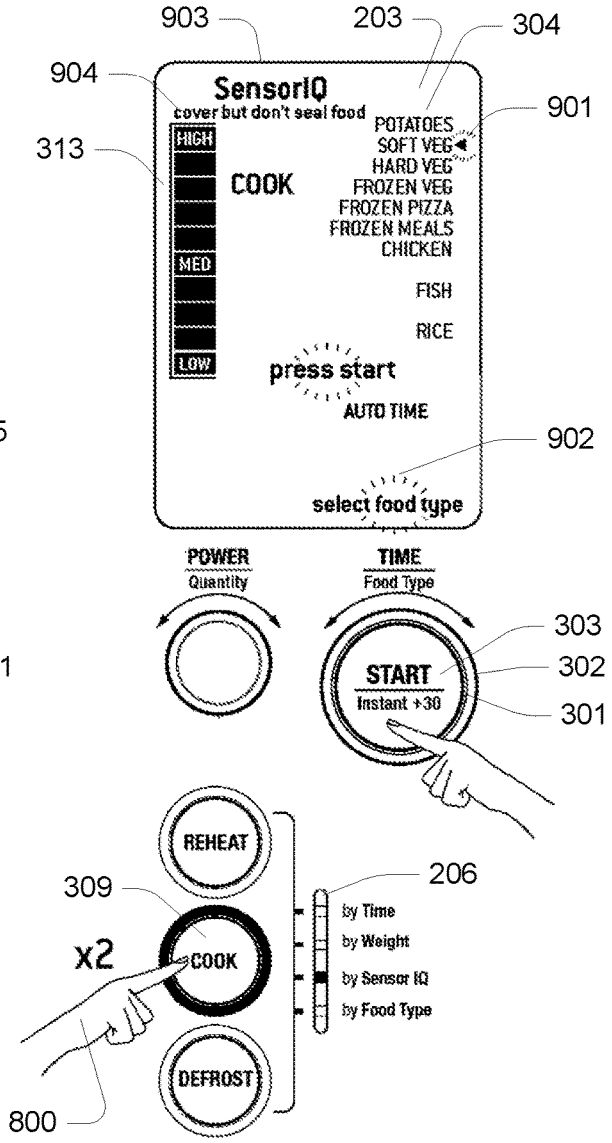

The cook function also has a cook by humidity sensor mode as shown in FIG. 9. This mode is accessed when the user 800 presses the cook function selector 309 two times successively. The "by SensorIQ" indicator 206 is illuminated, indicating sensor mode cooking. The display 203 depicts the vertical list of foods 304 and the moving indicator 901. The appropriate food type is user selected from the vertical list 304 using the outer portion 302 of the control 301. The indicator 901 appears adjacent to the selected food type in the list 304. The display prompts the user to select a food type with a graphic prompt 902. The food cooking time is determined by the oven's processor in accordance with the output of the humidity sensor. Time is not displayed. Power is displayed only on the bar 313. The display 203 indicates the selected sensor mode indicator 903 and a prompt 904 that the user should cover but not seal the food. Cooking is initiated by pressing the centre portion 303 of the control 301.

Figure 10:
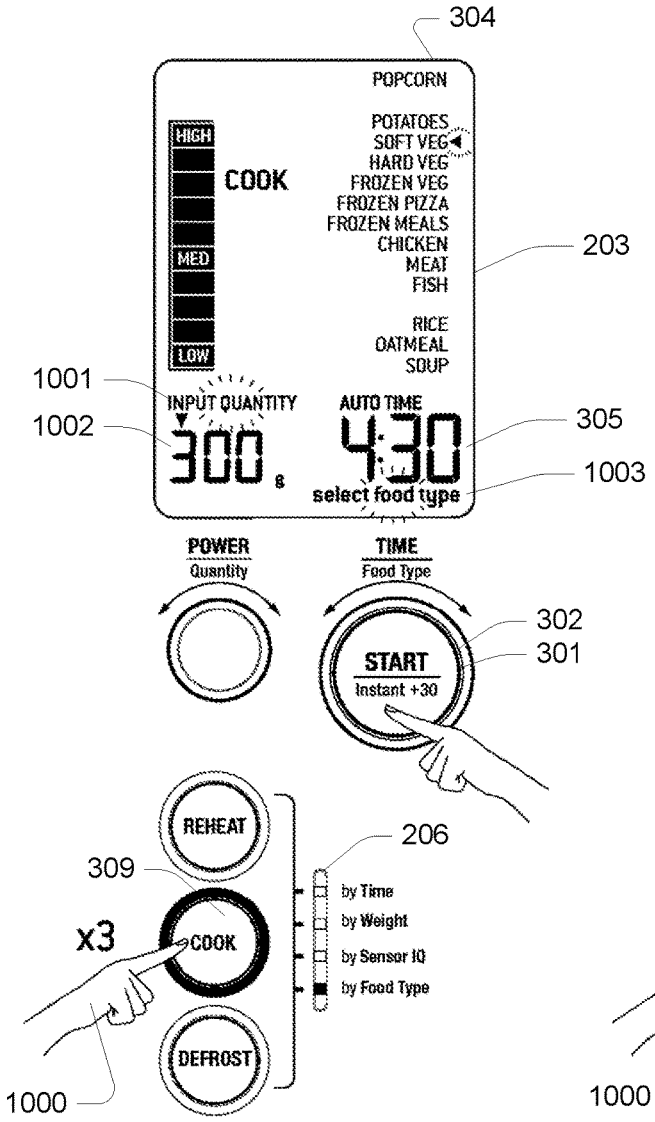
Figure 11:
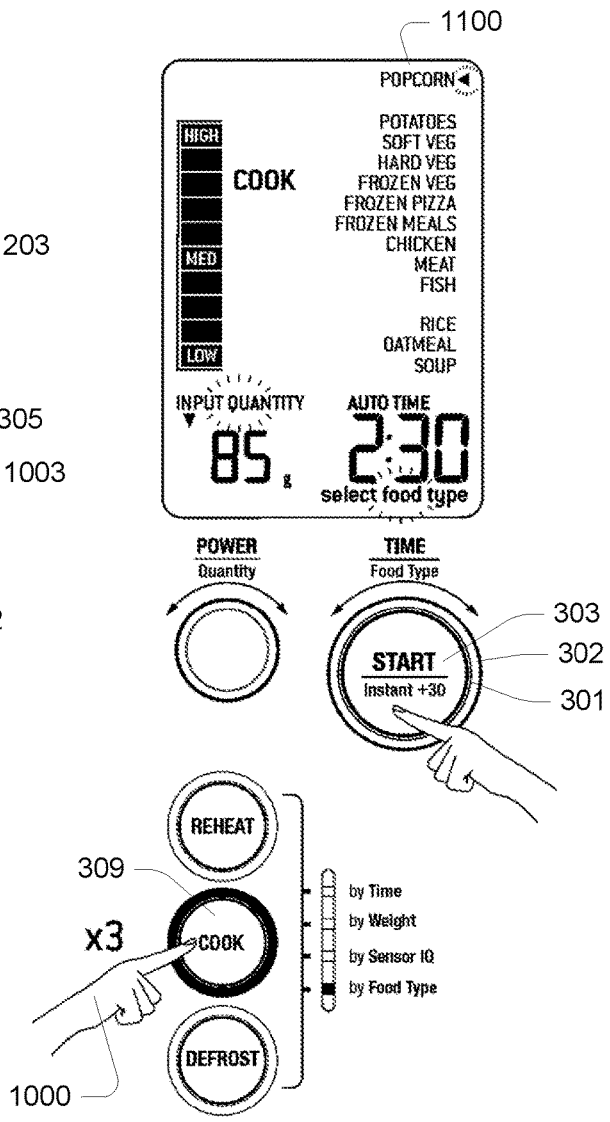
Figure 12:
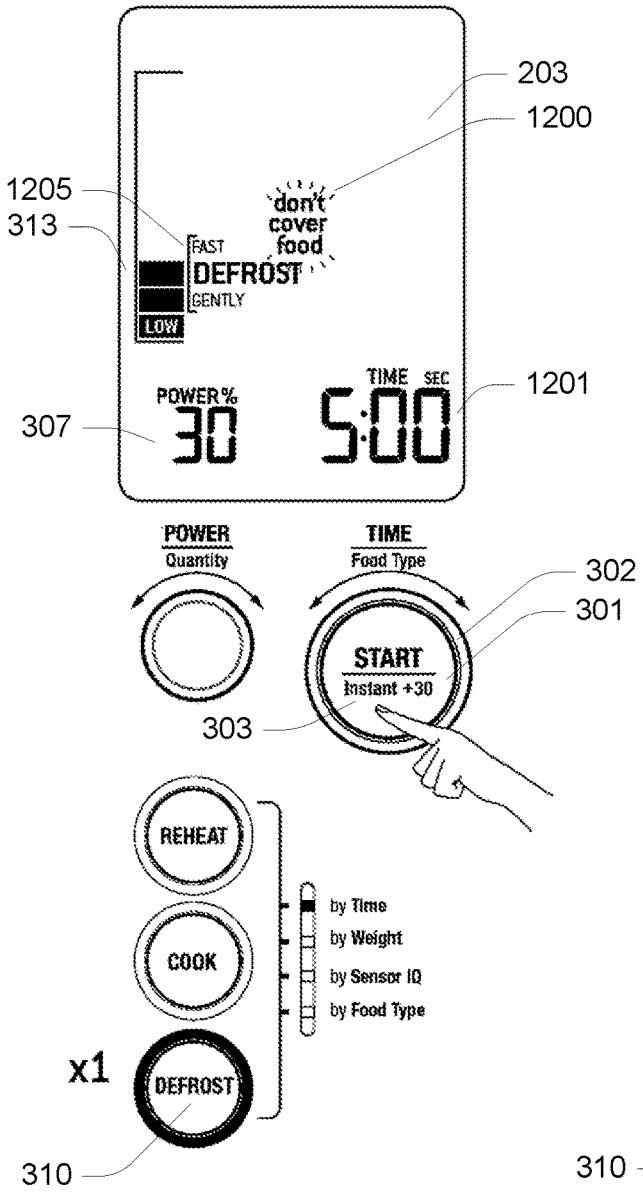
FIGS. 12-15 are schematic diagrams illustrating use of a user interface in the context of a defrost function.

FIG. 10 and FIG. 11 indicate two examples of the use of the user interface in the cook "by Food Type" mode as it relates to two different food types. The cook mode in which the user selects cooking by food type is accessed when the user 1000 depresses the cook selector 309 three times. This illuminates the "by Food Type" segment of the indicator 206. In this example, the user has selected "SOFT VEG" from the vertical list 304. Because "SOFT VEG" (soft vegetable) has been selected, the processor causes the display 203 to graphically indicate a prompt for the food quantity 1001 as well as the default quantity of 300 grams 1002. Accordingly, the processor causes (in respect to a type and quantity selection) the display to indicate the corresponding cooking time (in real time) 305. The user is also prompted by a graphic indication 1003 to select a food type using the outer portion 302 of the control 301. Items that are not cooked in the cook mode are not displayed in the vertical list 304. For example item such as frozen chicken, meat or fish and leftovers are respectively defrosted or reheated and therefore do not appear in the list 304.

As shown in FIG. 11, the cook function and food type mode may be used to select popcorn (a food type) 1100 from the vertical list 304. The displayed time reflects, in real time, the user's quantity selection. The power level is selected by the oven's processor in accordance with the food type selection.

Figure 13:
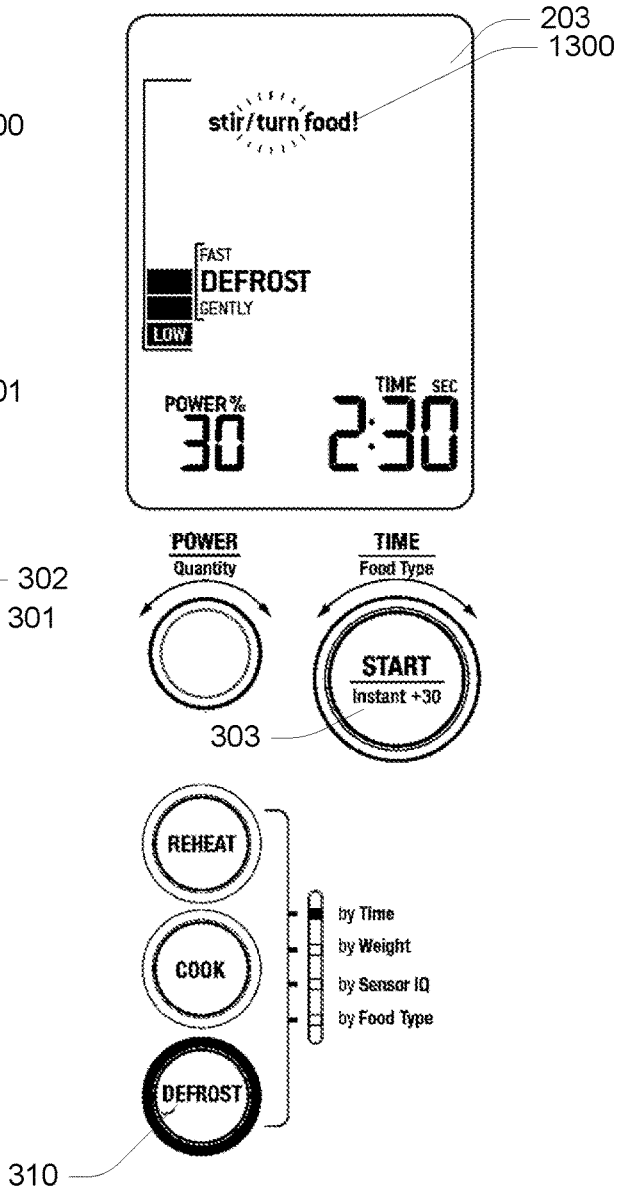

Aspects of the defrost function are illustrated in FIGS. 12-15. The defrost function is activated by depressing the defrost control 310. When this function is first selected, the display indicates a user warning not to cover the food 1200. The power indicator 307 indicates the graphic default power setting of 30%. A default time 1201 of 5 minutes is indicated on the display 203. The power is user adjustable within a limited range that is illustrated graphically 1205 adjacent to the bar 313. The bar indicator 313 first shows the illumination of segments corresponding to the 30% (or otherwise selected) power setting that is also indicated 307. The defrost time is adjustable by rotating the outer portion 302 of the control 301. The resulting defrost time is displayed in real time. Thereafter, defrosting can be initiated by pressing the time control's central portion 303. As shown in FIG. 13, approximately half way through the completion of the defrost cycle, the user is provided with a prompt 1300 on the display 203 to stir or turn the food. Opening of the microwave door stops the defrost cycle and allows the user to stir or turn the food that is in the cavity. The cycle is completed by closing the door and depressing the central portion 303.

Figure 14:
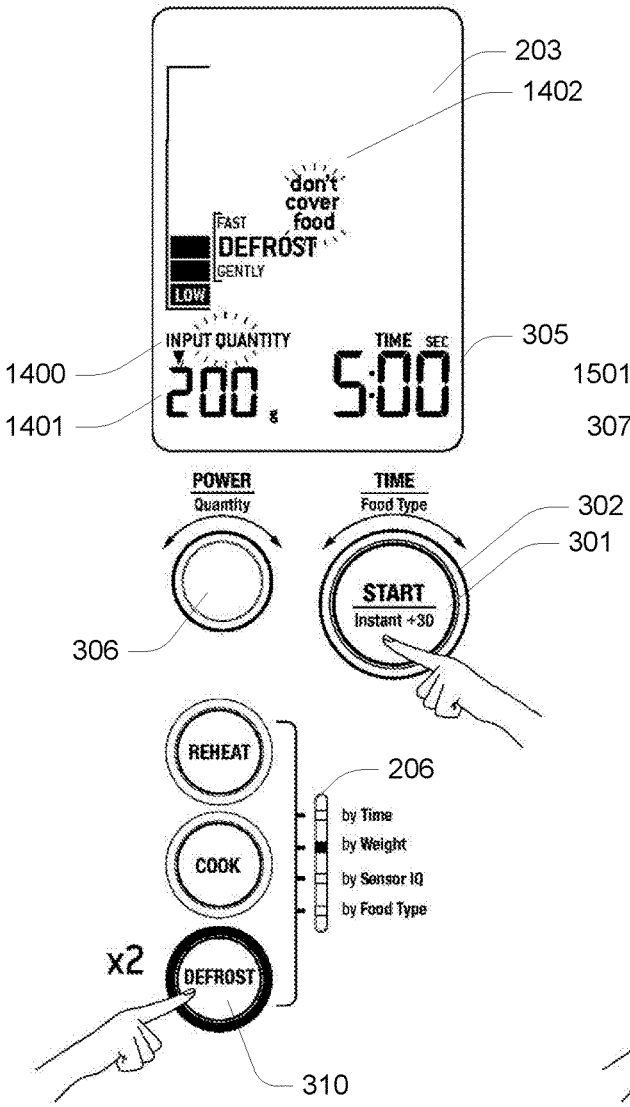

As shown in FIG. 14, pressing the defrost control 310 twice successively results in the defrost function entering the defrost "by Weight" mode. In this mode the appropriate segment of the indicator 206 is illuminated. The display 203 provides a graphic prompt for input quantity 1400 above the quantity indicator 1401. The quantity is adjusted by the user by rotation of the dial 306. The time is determined by the processor and shown on the display 305. The display provides an indication 1402 that the user should not cover the food in the cavity. The default power is determined automatically by the oven's processor.

Figure 15:
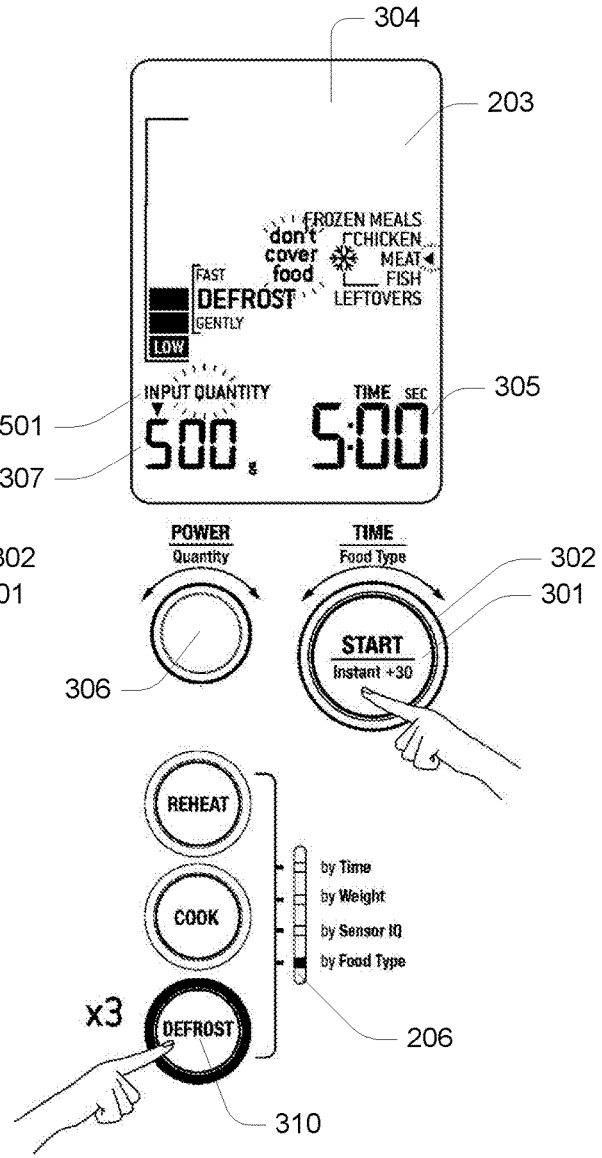

As shown in FIG. 15, depressing the defrost control 310 three times successively causes the "by Food Type" segment of the indicator 206 to become illuminated providing the user with information that the defrost is proceeding in accordance with a food type mode selection. Defrost "by SensorIQ" is not an available selection. A list of appropriate food types is displayed in the vertical list 304 on the display 203. In this example, the selectable types in the vertical list 304 comprise frozen meals, chicken, meat, fish and left overs. The user selects an item from the list utilising the outer portion 302 of the control 301. The user also adjust the food quantity using the quantity selector or control 306. The power level is set by the processor in accordance with food type and quantity. Rotation of the control 306 causes the display to indicate the selected quantity 307 below an indicator 1501 that prompts the user for the food quantity. The defrost time 305, based on the selected quantity 307 is displayed in real time.

Figure 16:
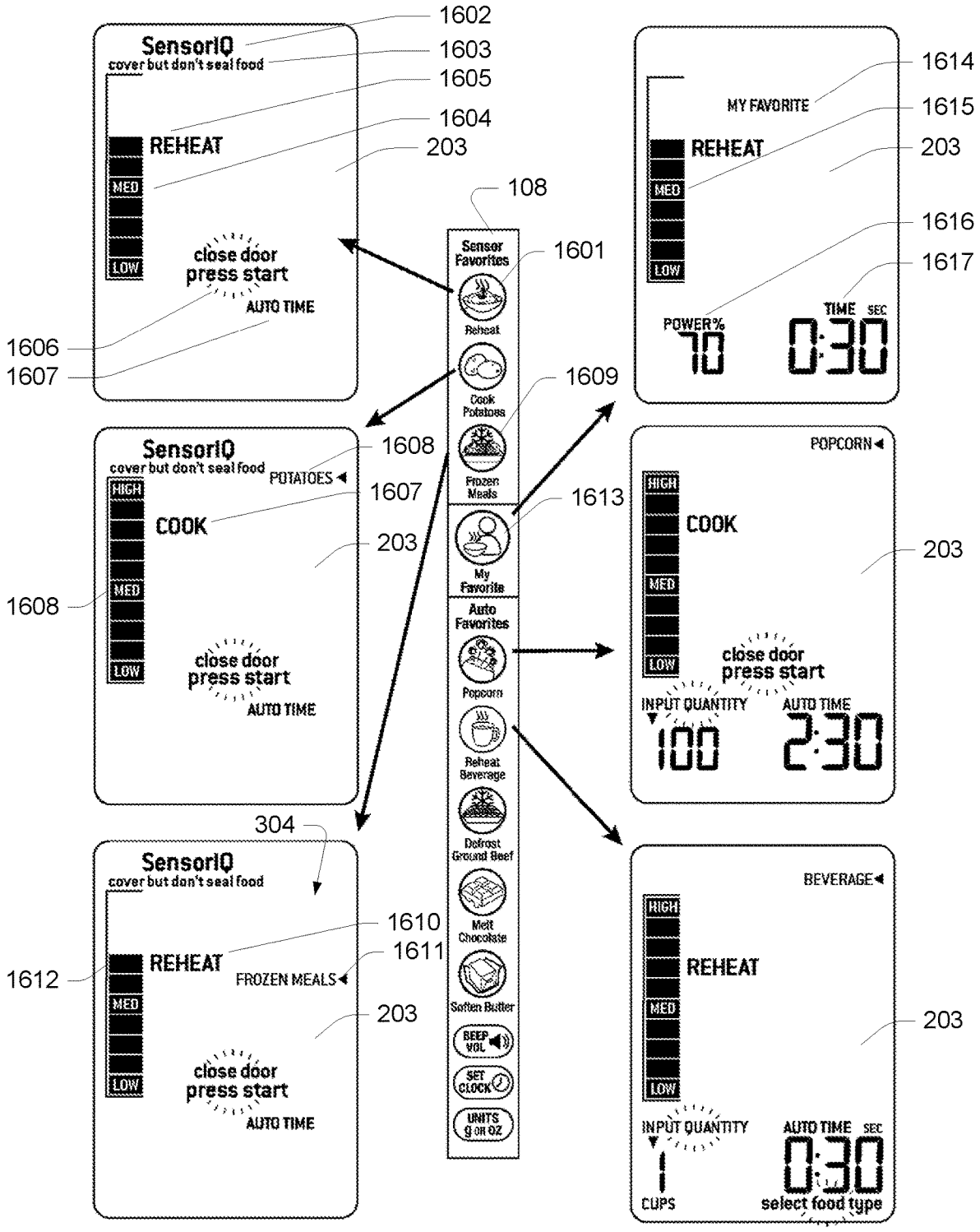
FIGS. 16-18 are schematic diagrams illustrating the display characteristics of the auxiliary control panel.
Figure 17:
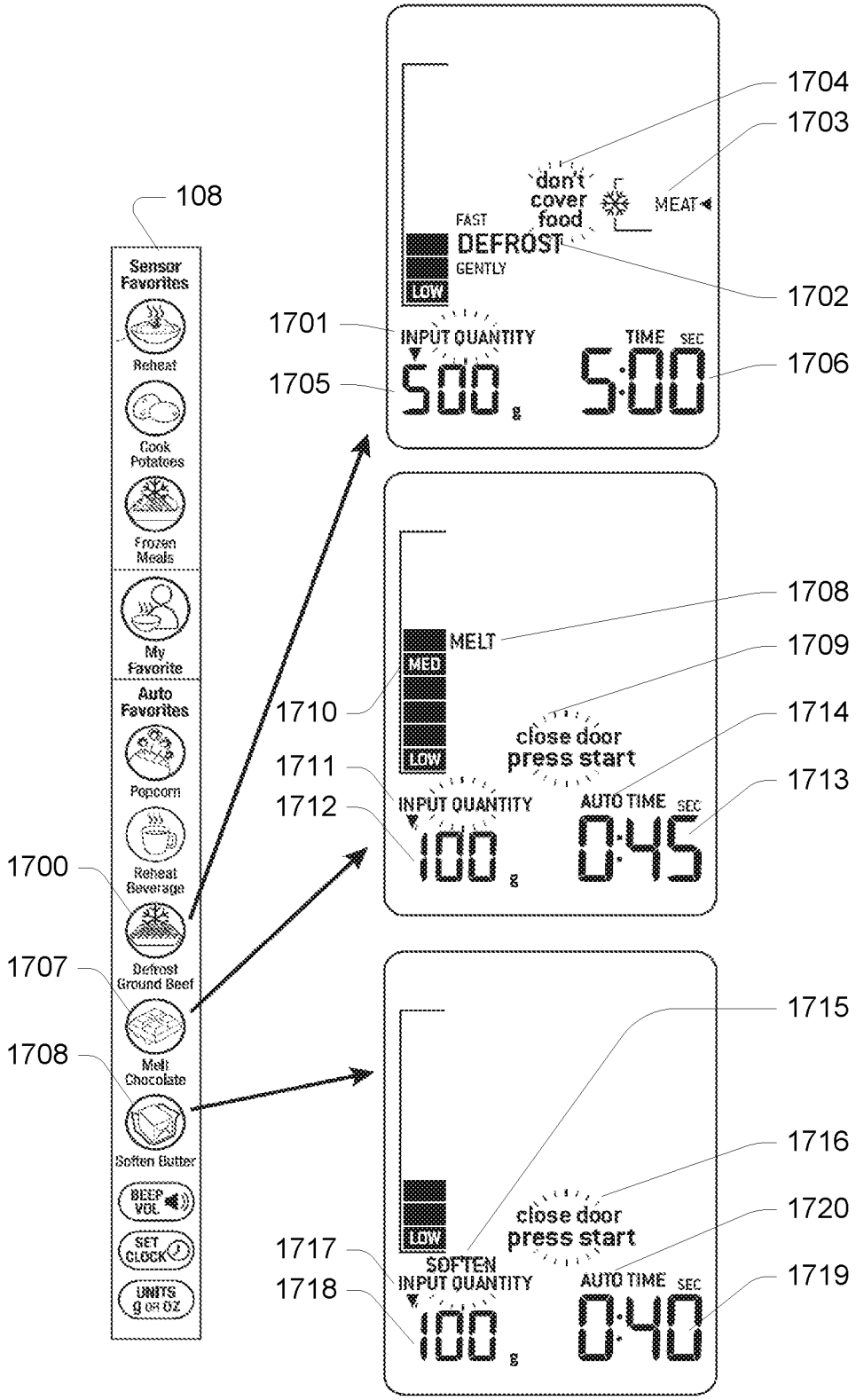
Figure 18:
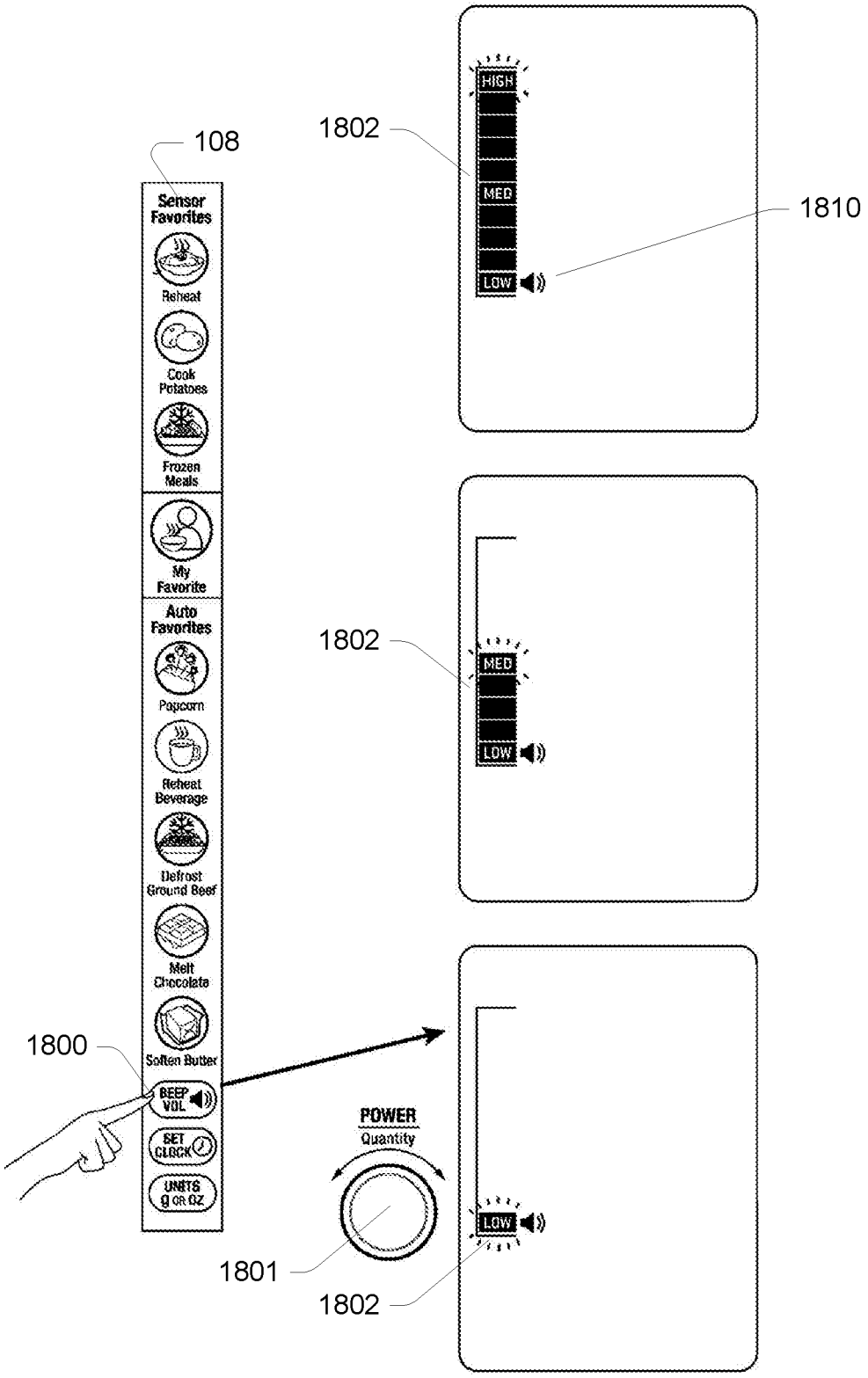

FIGS. 16-18 illustrate the functionality of the auxiliary controls available via the membrane or panel 108. In the example of FIG. 16, the uppermost user operable selector switch 1601 initiates a one button press command for reheating food using the humidity or steam sensor. The display provides a graphic indication 1602 that sensor type cooking has been selected. A prompt 1603 instructs the user to cover but not seal the food in the oven. The bar portion of the display 1604 indicates that the processor selected power is between medium and maximum. The reheat label 1605 is displayed. A prompt is provided for the user to close the oven's door and press the start button 1606. Another label notifies the user with the words "AUTO TIME" 1607 that the time is being determined by the unit's processor 207. Below the reheat button 1601 there is a "Cook Potatoes" control or selector.

When this selector switch is depressed by the user, the display depicts the "COOK" label 1607 and SensorIQ label and shows the item "POTATOES" 1608 in the vertical list 304. The bar portion 1608 indicates that the cooking is occurring at maximum or 100% power (using the humidity sensor). Below the "COOK POTATOES" selector is a "FROZEN MEALS" selector 1609. When activated by the user, the display 203 depicts the label "REHEAT" 1610 and the SensorIQ label and the item "FROZEN MEALS" 1611 is indicated in the vertical list 304. Other items in the list are not displayed. The bar portion 1612 indicates a power level between medium and maximum. Cooking proceeds in accordance with the cook by sensor mode. Below the "FROZEN MEALS" selector is a "MY FAVOURITE" selector 1613. When activated by the user, the display indicates the label "MY FAVOURITE" 1614 as well as a bar portion 1615, power setting value 1616 and time setting value 1617 appropriate to settings previously input by the user corresponding to a frequently used configuration of the user's choosing. Below the "MY FAVOURITE" selector are a number of "Auto Favourites" comprising one push selectable programs for commonly cooked foods such as popcorn, beverages, defrosting ground beef and melting butter.

As shown in FIG. 17 depressing the "Defrost Ground Beef" selector 1700 causes the display to depict the input quantity prompt 1701, the "DEFROST" label 1702, the vertical menu item meat 1703, the graphic warning "don't cover food" 1704, the default quantity of 500 grams 1705 and the default time of 5 minutes 1706. The "Melt Chocolate" selector 1707 causes the display to indicate the label "MELT" 1708, the prompt "close door press start" 1709 a display bar 1710 indicating a power level higher than medium, the "INPUT QUANTITY" label 1711 and a default quantity of e.g. 100 grams 1712. The quantity is adjustable using the quantity control 306. The processor 207 selects and displays the appropriate time 1713 as well as the label "AUTO TIME" 1714. Below the "Melt Chocolate" selector 1707 is the "Soften Butter" selector 1708. Using the selector 1708 causes the display to indicate the label "SOFTEN" 1715, the prompt "close door press start" 1716, the label "INPUT QUANTITY" 1717 and the default quantity of 100 grams 1718. The input quantity is adjustable using the input quantity control. The display depicts the time 1719 determined by the processor along with the label "AUTO TIME" 1720.

As shown in FIG. 18, a beep volume selector switch on the panel 108 can be depressed repeatedly to allow the user to scroll through user selectable warning beep volumes that are emitted by the oven. In the alternative, the quantity selector 1801 can be rotated in either direction to accomplish this same function. The bar portion of the display 1802 provides a graphic indication of the user's selection of beep volume and an icon or symbol for sound 1810. Any number of discreet beep volume levels may be selected 1800, 1801 and subsequently displayed 1802.

Figure 19:
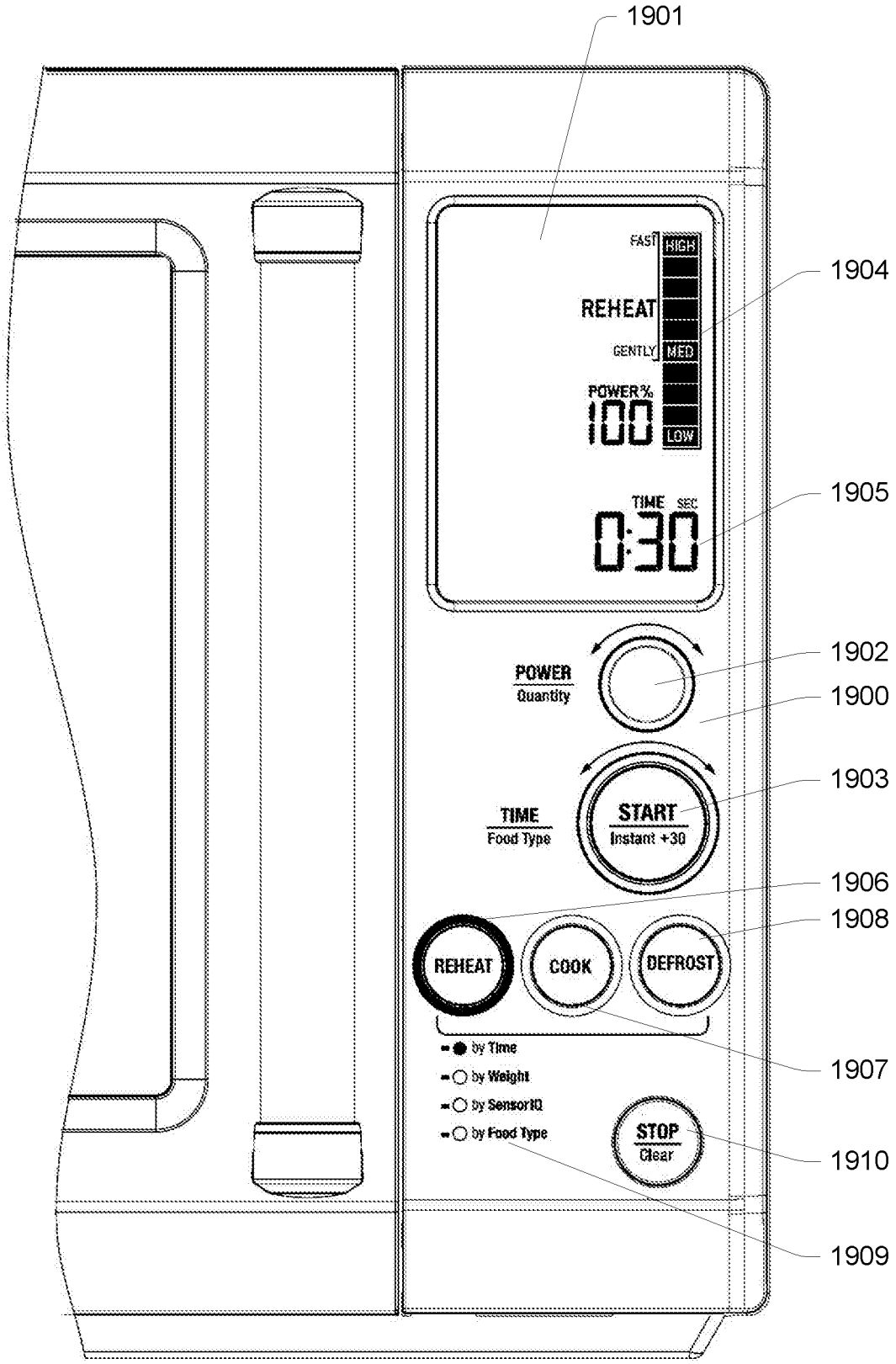
FIG. 19 is a front elevation of a user interface.

As shown in FIG. 19, an alternate embodiment of the user interface 1900 and its graphic display 1901 locates the power and quantity selection knob 1902 in vertical alignment with the time, food type and start control 1903. In this example, the power and quantity selector 1902 is located between the time, food type and start selector 1903 and the lower edge of the display 1901. In this example, because the power quantity selector 1902 is above the time and food type selector 1903, the power indicating bar portion of the display 1904 is located above the time indicating portion 1905 of the display. In this example, the reheat, cook and defrost selectors 1906, 1907, 1908 are located in a horizontal row and equally spaced across the width of the interface panel. The mode indicators for the three functions are located in vertical alignment 1909 below the reheat selector 1906. The "Stop/Clear" selector 1910 is located in the bottom right hand corner of the interface panel.

Figure 20:
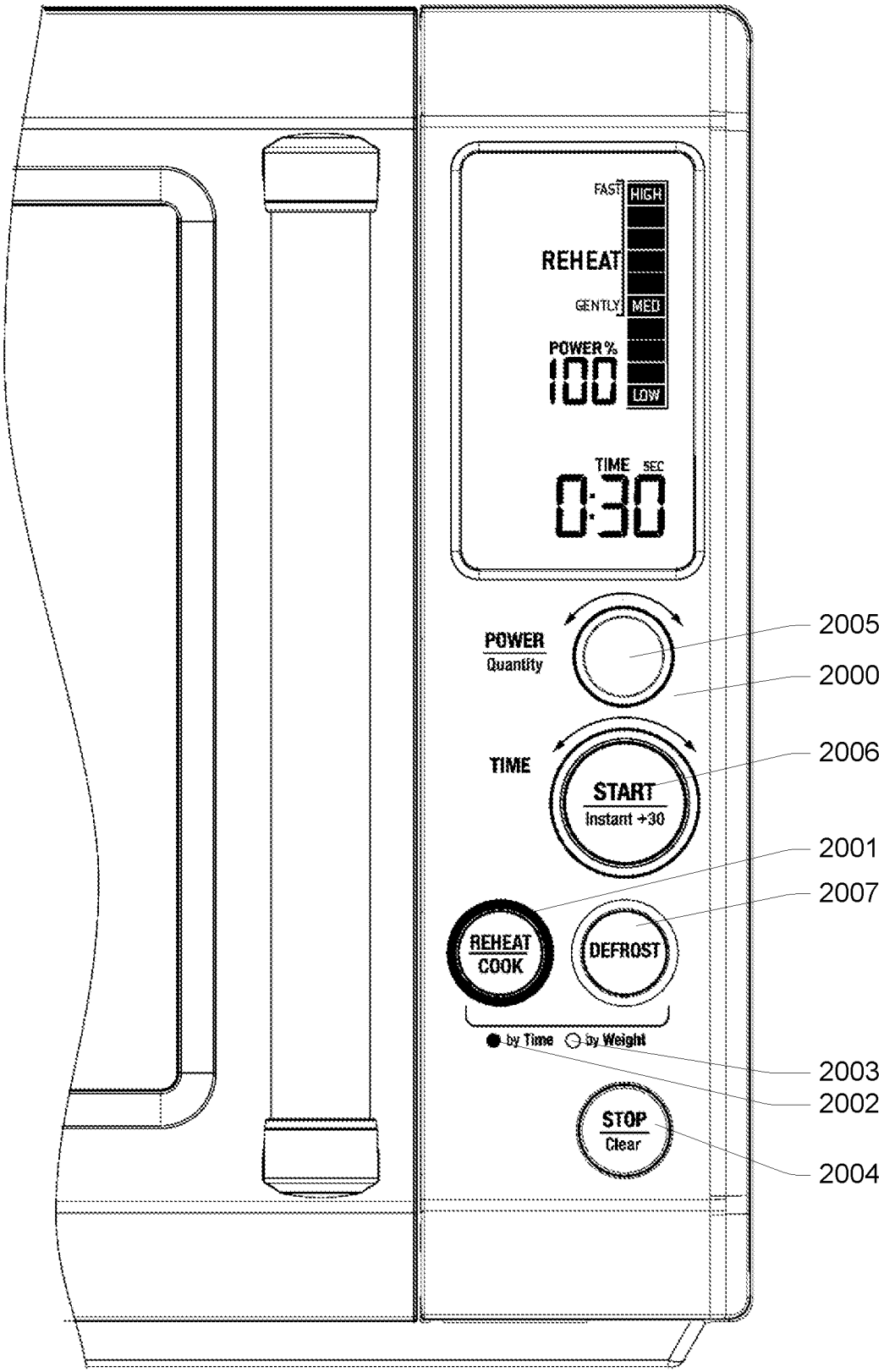
FIG. 20 is a front elevation of a user interface.

As shown in FIG. 20, in another embodiment of the interface 2000, the reheat and cook selectors 1906, 1907 are combined into a single selector 2001. In this example, the modes associated with each function have been reduced to two, e.g. being by time and by weight, each having an illuminated indicator 2002, 2003. The "Stop/Clear" selector 2004 is located in the lower right hand corner of the interface panel in vertical alignment with the "Power/Quantity" selector 2005, the time and start selector 2006 and the defrost selector 2007.

Figure 21:
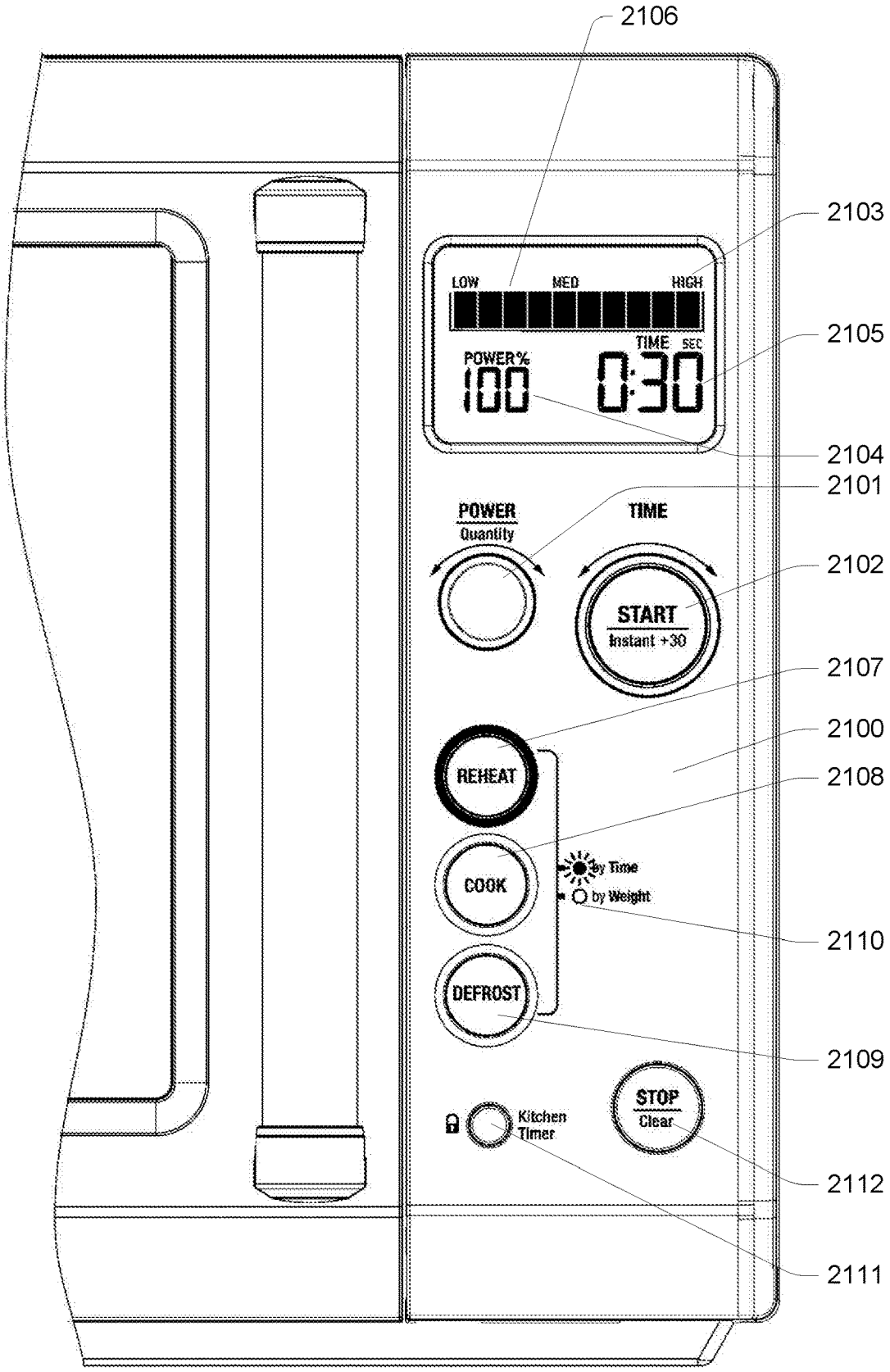
FIG. 21 is a front elevation of a user interface.

As shown in FIG. 21, the user interface panel 2100 comprises a horizontally aligned "Power/Quantity" selector 2101 to the left of a "Time/Start" selector 2102. The graphical display 2103 is located above the aforementioned selectors 2101, 2102. Within the display 2103, the numeric power indicating portion 2104 is located above the power selector 2101 and the time indicator 2105 is located above the time selector 2102. In this example, the graphic bar portion for indicating the power level 2106 is oriented horizontally above the numeric power and time indicators 2104, 2105. The function selectors for reheat, cook and defrost 2107, 2108, 2109 are located in vertical alignment below the power selector 2101. The mode indicators are two in number for "Time" and "Weight" 2110 and are located to the right of the function 2107, 2108, 2109. As previously discussed the combined kitchen timer and lock selector 2111 is located in the lower left hand corner of the interface panel and the "Stop/Clear" selector 2112 is located in the lower right hand corner of the interface panel.

Figure 22:
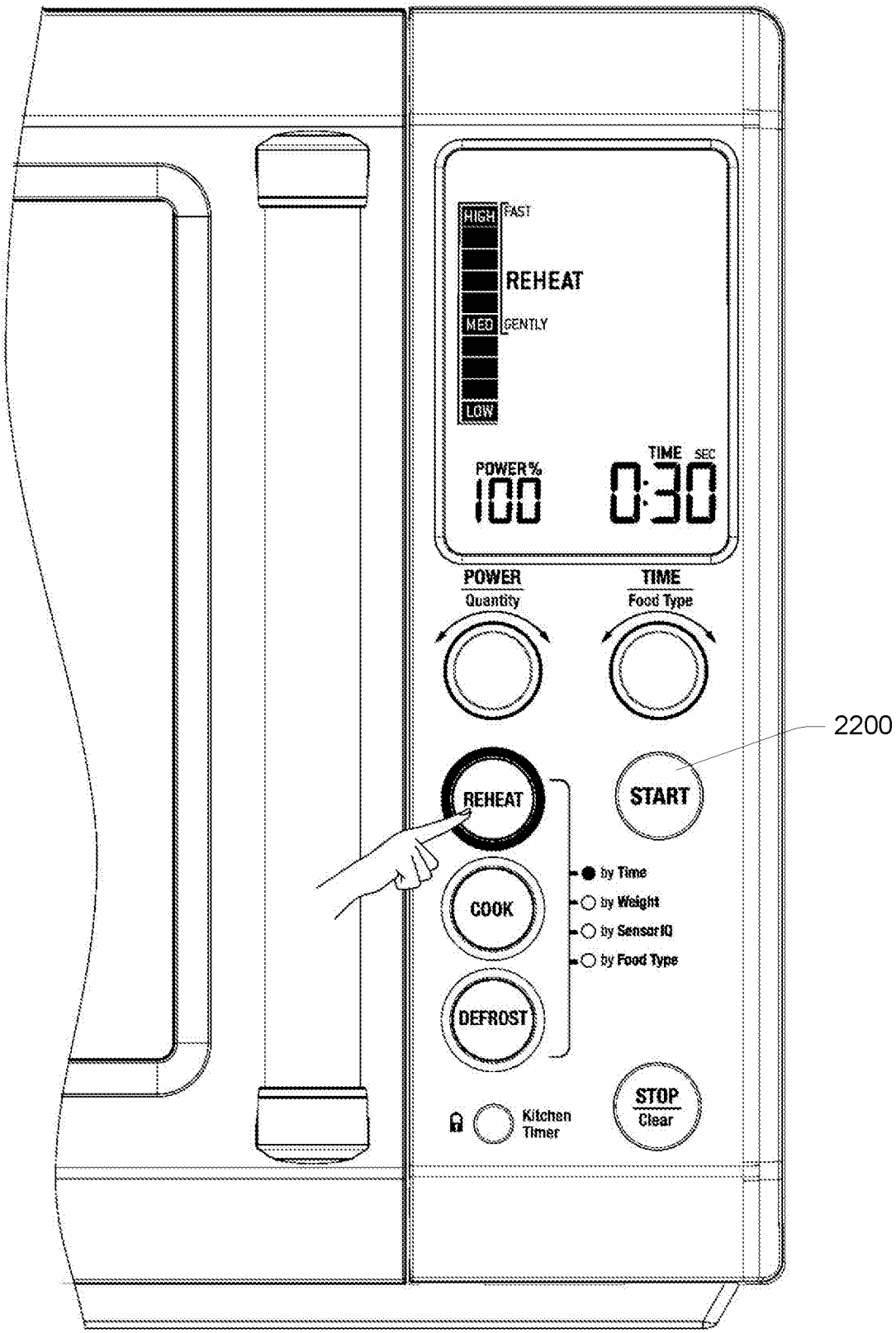
FIG. 22 is a front elevation of a user interface.

As shown in FIG. 22, a separate single purpose "START" selector 2200 may be provided instead of combining it with another selector.

Figure 23:
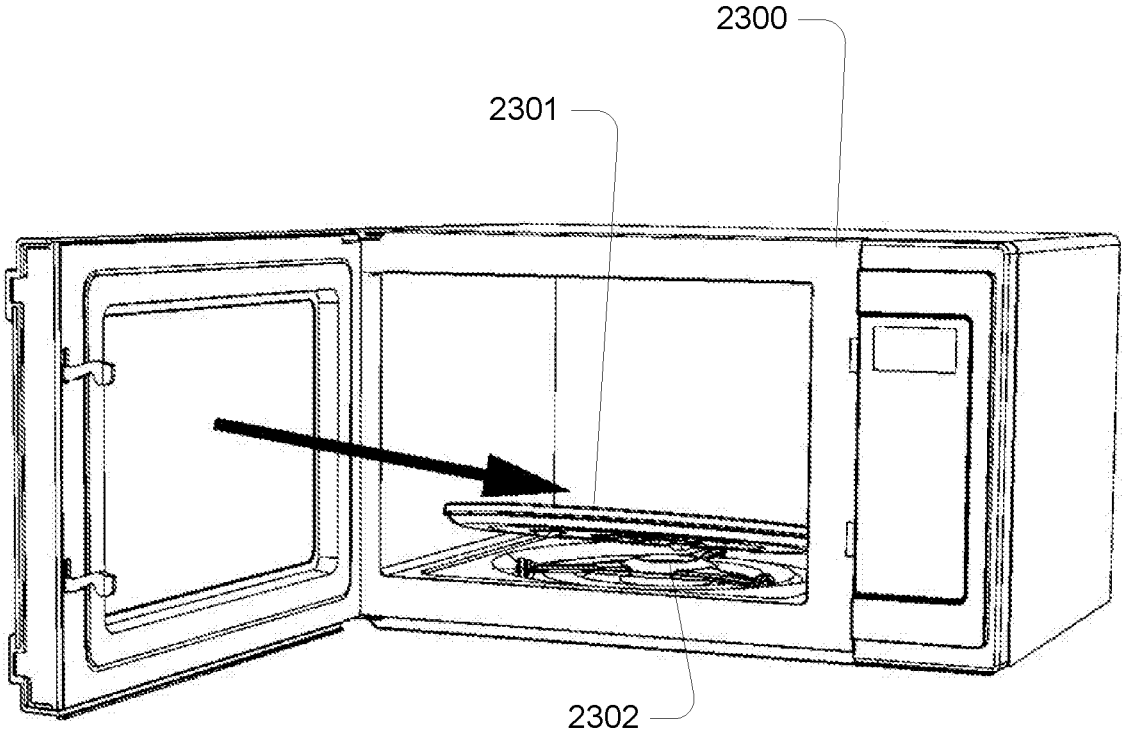
FIG. 23 is a perspective view of a microwave oven illustrating the insertion of a platter by a user.
Figure 24:
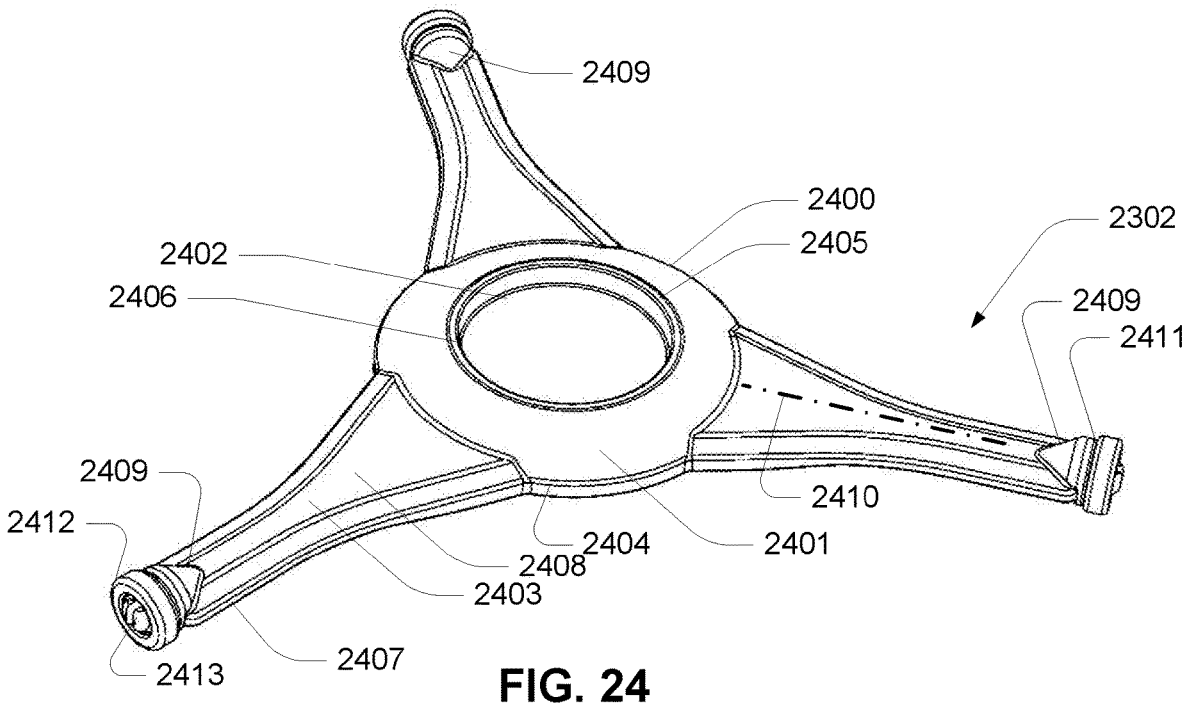
FIG. 24 is a perspective view of a roller support for a platter of a microwave oven.
Figure 25:
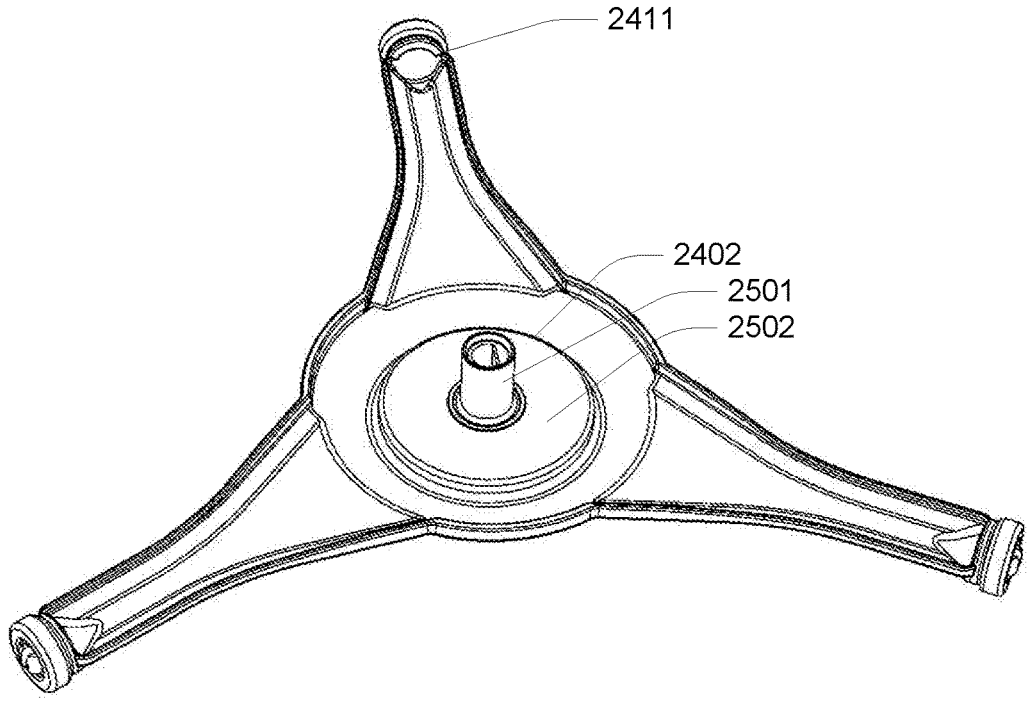
FIG. 25 is an underside perspective view of the device depicted in FIG. 24.
Figure 26:
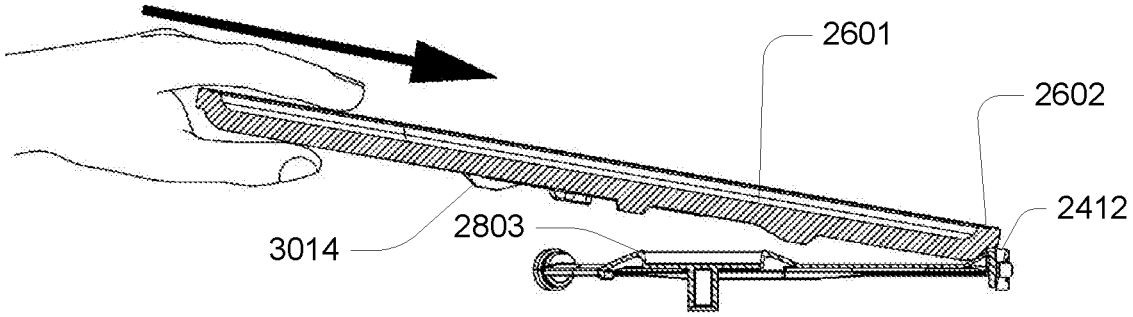
FIG. 26 is side elevation, cross sectioned to illustrate the interaction between a platter and a roller support.
Figure 27:
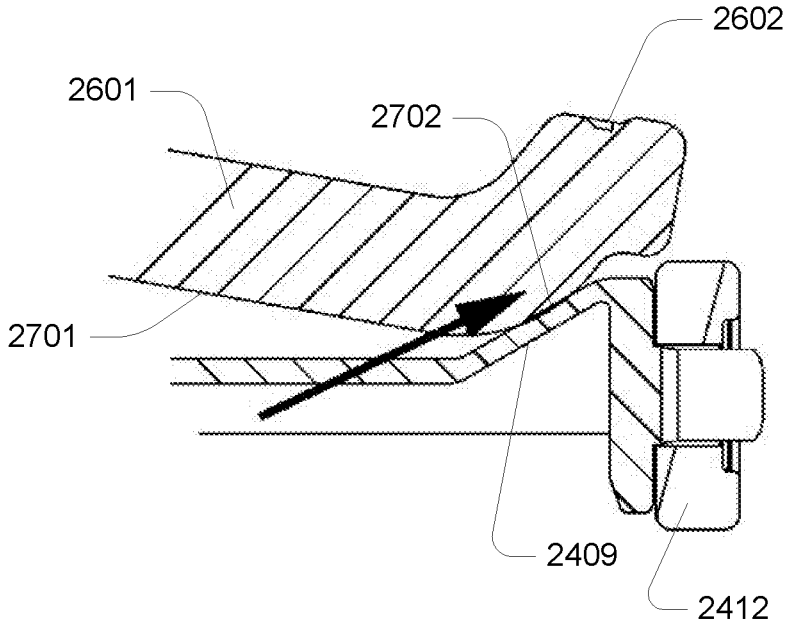
FIG. 27 is a detail of the platter rim and protective ramp illustrated in FIG. 26.
Figure 35:
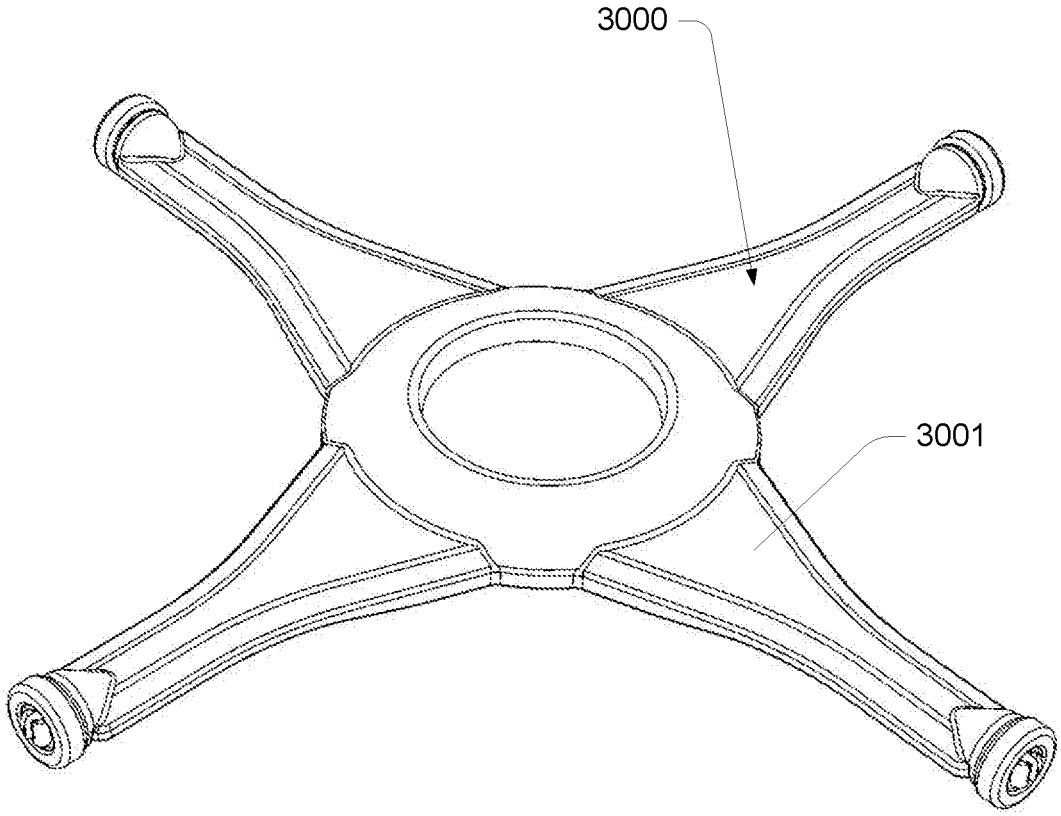
FIG. 35 is a perspective view of a roller support with four legs.

As shown in FIG. 23, a microwave oven 2300 has a rotating glass platter 2301 carried by a roller support mechanism 2302. As shown in FIG. 24, the roller support mechanism 2302 has a central hub 2400. The central 2400 features a tapered or ramping ring-shaped surround 2401 within the upper edge of which is located a central, circular well or cup 2402. Three or more legs 2403 are equally spaced round the rim of the hub 2401. The rim is the thinnest part of the hub when seen in side elevation. Each of the legs radiates from the rim of the surround 2404. The thickest portion of the hub, in side elevation, is the edge of the opening 2405 that surrounds the central well 2402. Each leg has a widest portion 2406 adjacent to the rim 2404, a terminal portion with generally parallel sides 2407 and a tapered portion 2408 that extends between the rim 2404 and the terminal portion 2407 of each leg. The terminal portion 2407 incorporates a ramp 2409. The ramp has a shape approximating a half of a cone split longitudinally. The apex of the cone is located on and points along the longitudinal axis 2410 of each leg. The widest portion of the ramp 2409 forms an approximately semi-circular protective bumper 2411 that is only slightly smaller than the diameter of the roller or wheel 2412 carried at the end of each leg. The roller or wheel 2412 is carried by a split stub axel or other means 2413 that allows the wheel to be assembled onto the stub axel 2413. As shown in FIG. 25, the roller support has a female coupling 2501 located at its centre and below the floor 2502 of the circular well 2402. The coupling 2501 cooperates with a motorised stub shaft located in the microwave oven. As shown in FIG. 35, a roller support 3000 for a platter may have three or more legs 3001. As shown in FIGS. 26 and 27 a glass platter 2601 is configured to cooperate with the roller support 2302.

Figure 29:
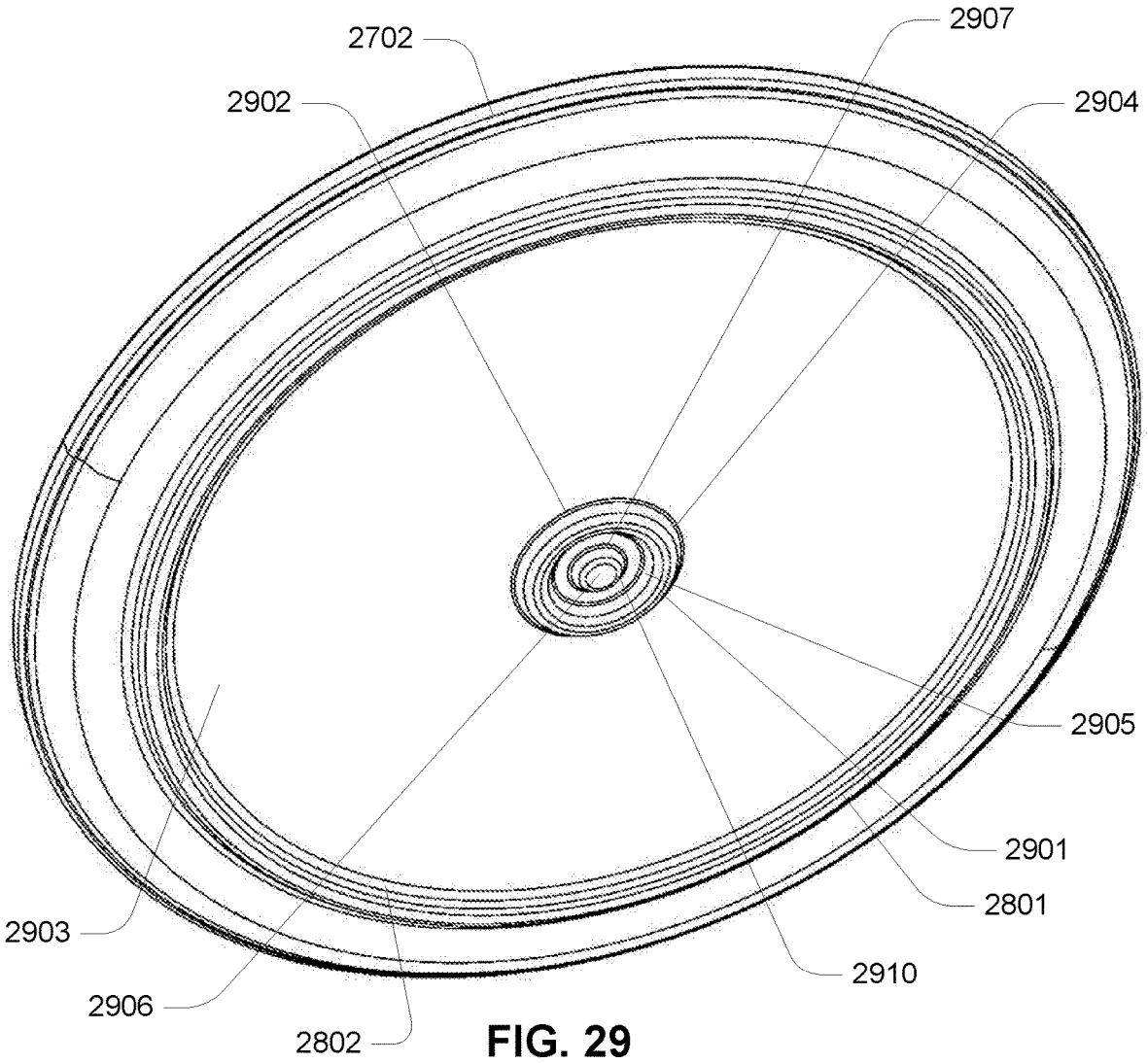
FIG. 29 is an underside perspective view of the platter depicted in FIG. 28.
Figure 28:
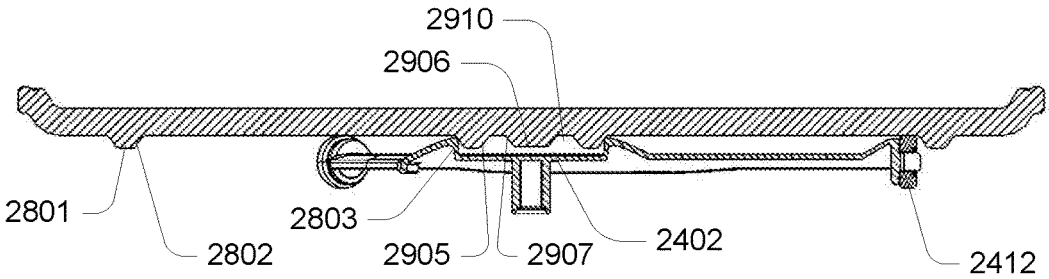
FIG. 28 is a side elevation, cross sectioned to illustrate the interaction between a platter and a roller support.

The glass platter 2601 has an elevated, upward curving circumferential rim 2602. The rim 2602 has an under surface that is curved upwardly or chamfered around the entire periphery of the underside 2701. The chamfer 2702 cooperates with the ramp or half-cone 2409. As suggested by FIG. 26, as the platter 2601 is urged into position, the chamfer 2702 rides up the ramp 2409. The ramp 2409 prevents the roller or wheel 2412 from interfering with or being damaged by the movement of the platter 2601. The ramp 2409 assists the platter into its final position and prevents the platter from breaking the wheel off. As further suggested by FIGS. 23, 27 and 28 further advancing the platter 2601 causes a stabilising ring 2801 located on an underside of the platter to ride over the ramp 2409. In this final position illustrated in FIG. 28, the rollers 2412 are captured within the inner diameter 2802 of the optional stabilising ring 2801. In this orientation, a generally circular centring ring 2901 with its chamfered periphery 2902 seats within and is located by the upright side walls 2803 of the central well 2402. In preferred embodiments and as suggested by FIG. 29, the centring ring 2901 located in the centre of the underside 2903 of the platter comprises an outer ring 2904 having a tapered or chamfered outer rim or sidewall 2902 and a chamfered or tapered inner rim or sidewall 2905. Optionally, a central mound 2906 is located concentric to the locating ring 2901. The central mound 2906 has tapered a sidewall 2907 all around it. The ring 2901 optional mound 2906 form visual targets or features that promote easy installation of the platter into the well.

Figure 30:
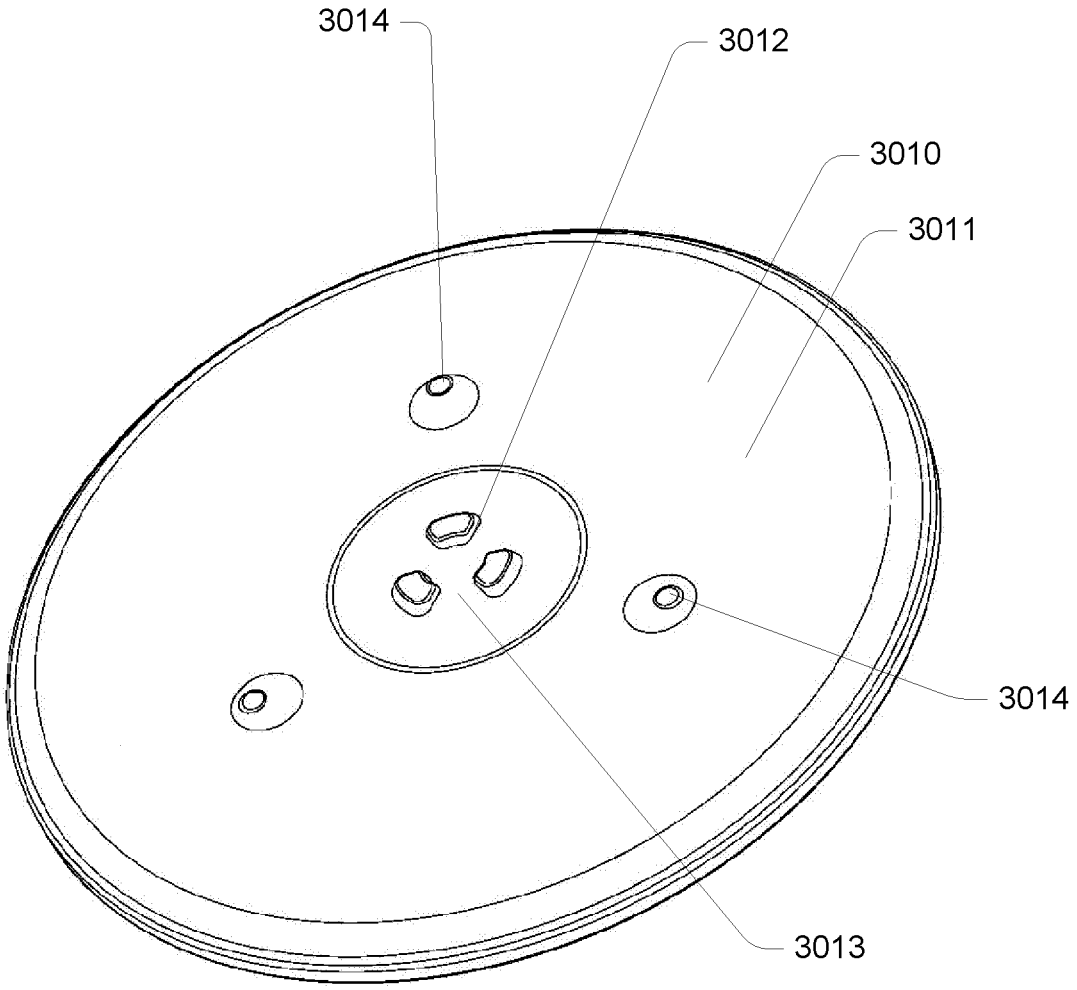
FIG. 30 is a underside perspective view of a microwave oven platter.

As shown in FIG. 30, a roller support of the type disclosed with reference for FIGS. 24-29 and 35 is particularly well adapted to support and cooperate with a glass platter 3010. The glass platter 3010 is of a kind well known in the prior art. However, this platter type is sometimes difficult to use with conventional platter supporting mechanisms. The platter 3010 depicted in FIG. 30 has an under surface 3011 that does not have a stabilising ring 2801 for locating the rollers. The underside 3011 features three, central, male or protruding coupling features 3012 that are equally spaced around a central void 3013. This type of array of male coupling features 3012 is well known in the art and cooperates with prior art platter drive mechanisms. In addition, prior art platters of this type also have three (or perhaps more) feet 3014 located radially outward of the coupling features 3012. The feet 3014 may have flat bottom surfaces or are otherwise adapted to stabilise the platter 3010 when it is rested on a flat surface. As will be explained, it is important that a roller support mechanism (sees FIGS. 24-29) not contact or interfere with the feet 3014.

Figure 31:
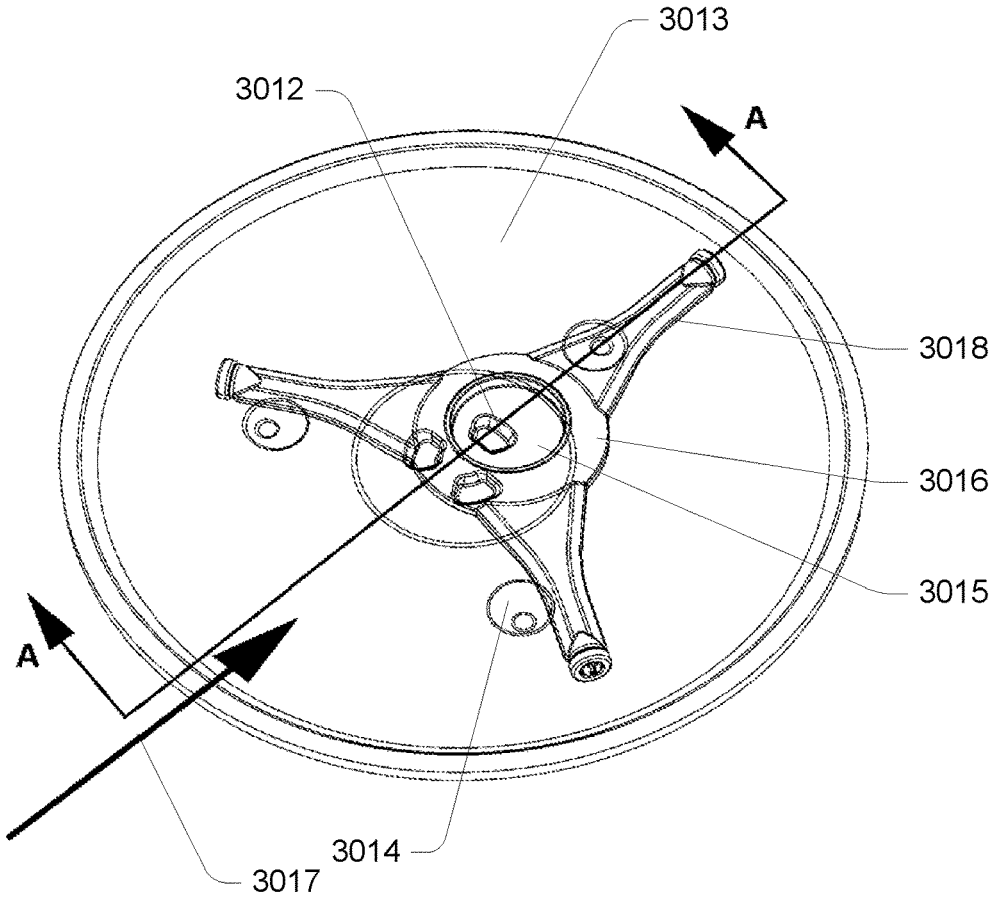
FIG. 31 is a perspective view illustrating the mounting of a platter onto a roller support.
Figure 32:
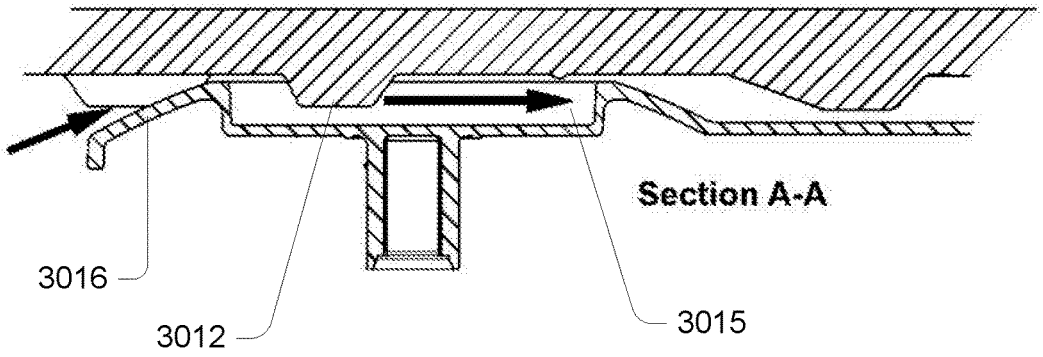
FIG. 32 is a side elevation detail, cross sectioned to illustrate the interaction of a platter and roller support.

As suggested by FIGS. 31 and 32, when locating the platter 3013 onto the roller support 3014, the user is able to see the support 3014 through the platter. The user can then use the central well 3015 and the circumferential ramp 3016 as a visual target area in which to locate the downward extending male coupling features 3012. The coupling features 3012 will contact and slide over the ramped surround 3016 of the well 3015. As shown in FIG. 32 the coupling features will advance over the ramped surround 3016 as the platter is inserted (for example) in the direction of the arrow 3017, this being the direction from the opening into the oven's cooking cavity.

Figure 33:
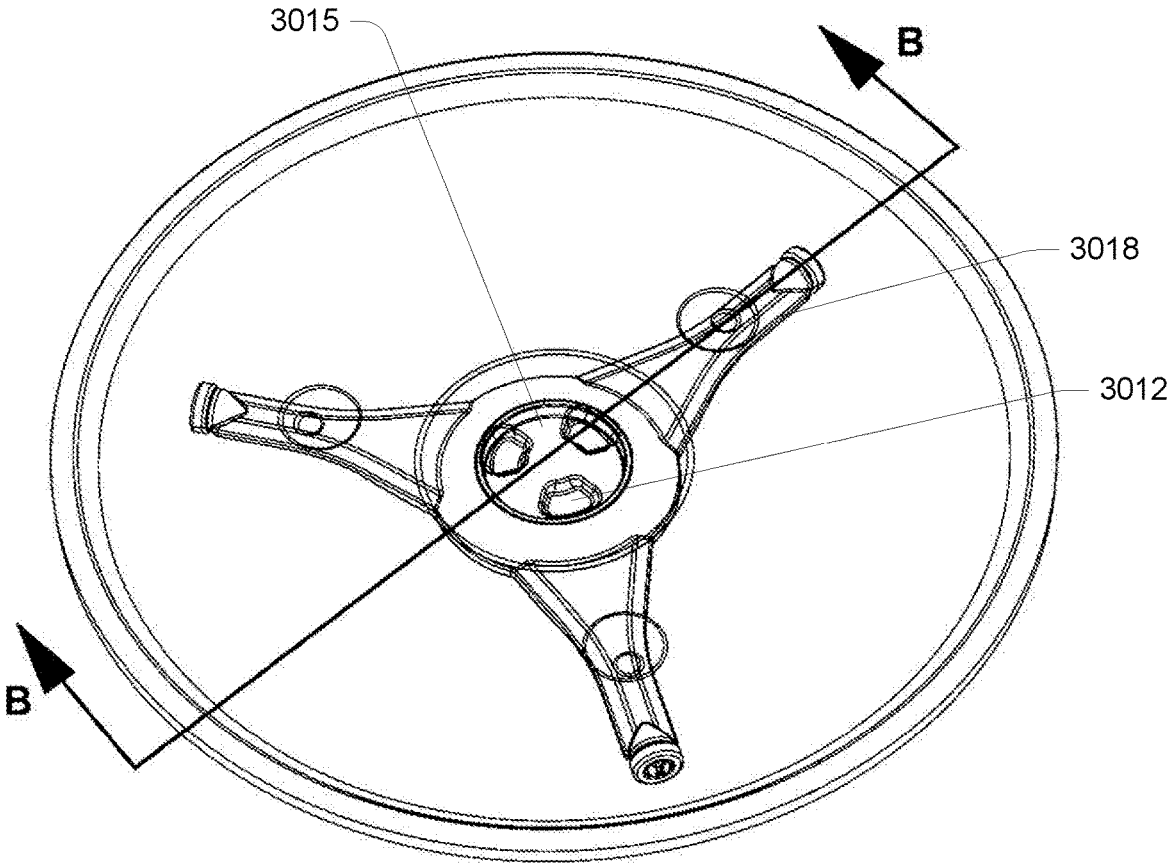
FIG. 33 is a perspective view illustrating the seating of a platter onto a roller support.
Figure 34:
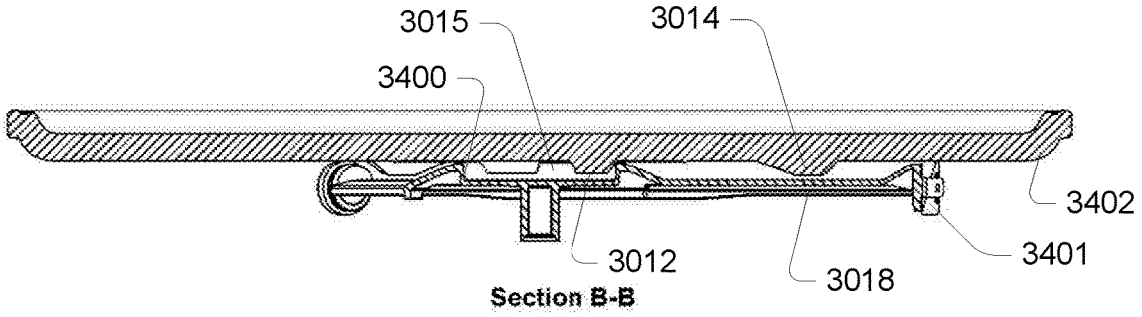
FIG. 34 is a side elevation of the platter and roller support depicted in FIG. 33.

As suggested by FIGS. 33 and 34 the male coupling features 3012 will come to rest within the sidewalls 3400 of the well 3015 and will be difficult to dislodged from the well 3015 unless the platter is lifted vertically. As seen more clearly in FIG. 34, the platter's downward extending feet 3014 are accommodated above the roller support legs 3018, there being a clearing space between the upper surface of the leg 3018 and the lower surface of the foot 3014. The rollers 2412 make contact with the underside of the platter in the area between the feet 3014 and the outside diameter of the under surface 3402.

Figure 36:
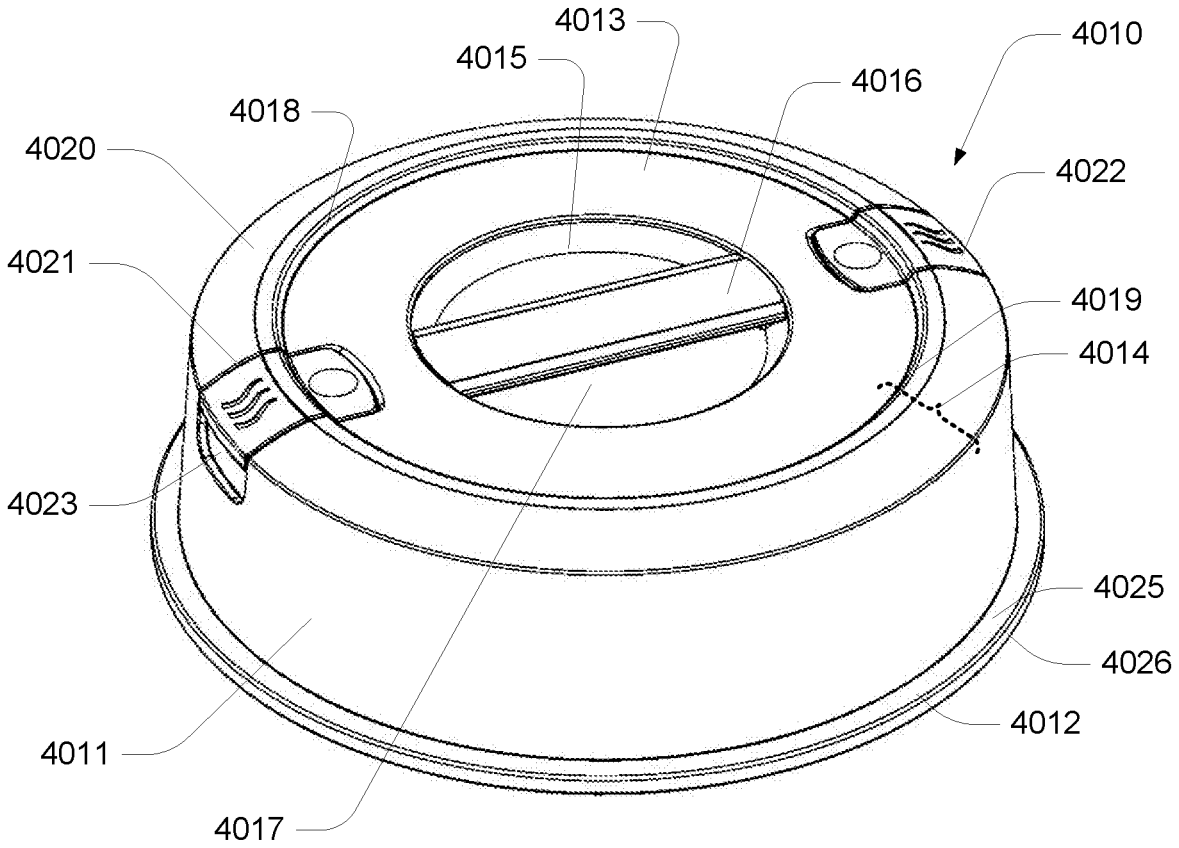
FIG. 36 is a perspective view of a cover and support for microwave oven cooking.
Figure 37:
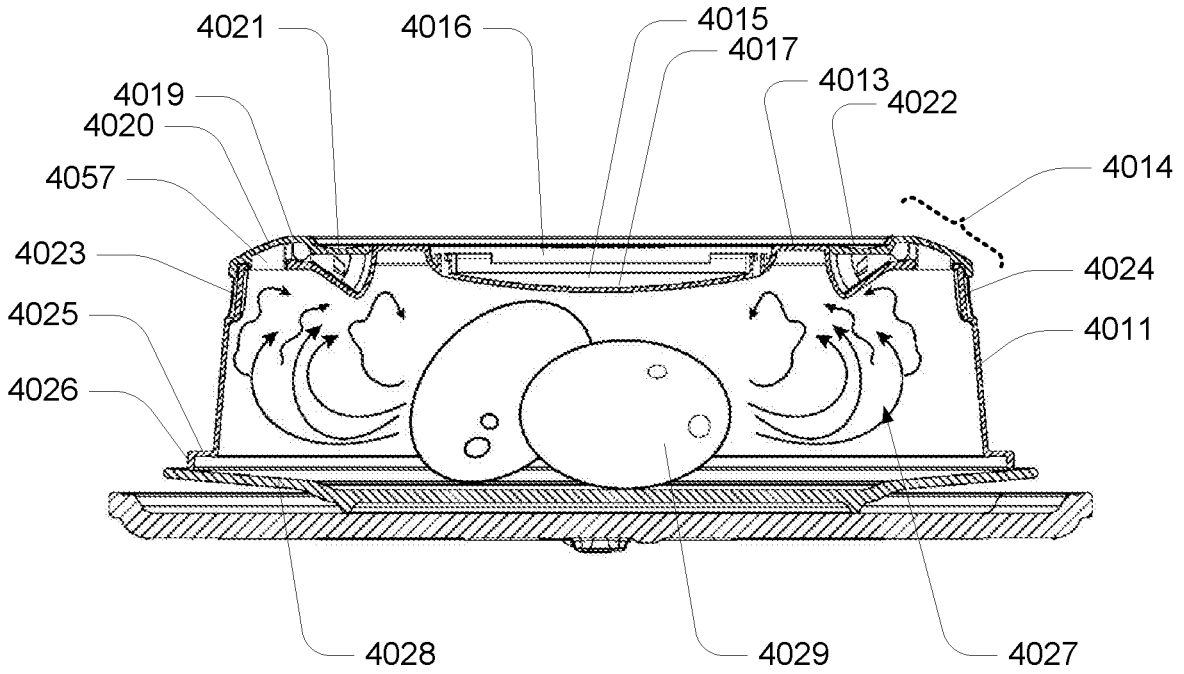
FIG. 37 is a cross section through the device illustrated in FIG. 1.

As shown in FIG. 36, a cover and stand comprises a circumferential sidewall 4011 that is located between a lower rim 4012 and an upper surface 4013. In this example, the upper surface 4013 is recessed with respect to a chamfered intermediate portion 4014 that extends between the upper surface 4013 and the sidewall 4011. In this example, the overall cross-sectional shape of the device 4010 is circular. It will be understood that the cover 4010 may be manufactured in other shapes. In the example of FIGS. 36 and 37, the upper surface 4013 is round and flat. The upper surface 4013 encircles a central optional well 4015 across which extends an optional handle 4016. The lower surface 4017 of the central well 4015 forms an inverted dome.

The intermediate or transition portion 4014 has an inner sidewall 4018 that extends between the upper surface 4013 and a flat upper rim 4019. The remainder of the intermediate portion forms a chamfer or taper 4020 that extends between the rim 4019 and the sidewall 4011.

The cover features a pair of opposed pivoting closures 4021, 4022. Each closure 4021, 4022 is received within a recess 4023, 4024 so that all of the upper surfaces of each closure are generally flush with respect to the remainder of the cover 4010.

In preferred embodiments' the lower rim 12 includes a radially extended shoulder 4025 and a descending rim 26 that is larger in diameter than the widest part of the sidewall 4011.

FIGS. 36 and 37 show the closures in a closed position. In the closed position, humidity 4027 tends to accumulate under the cover, that is, between the cover 4010 and a plate 4028 on which food 4029 is being cooked, reheated or defrosted in a microwave oven.

Figure 38:
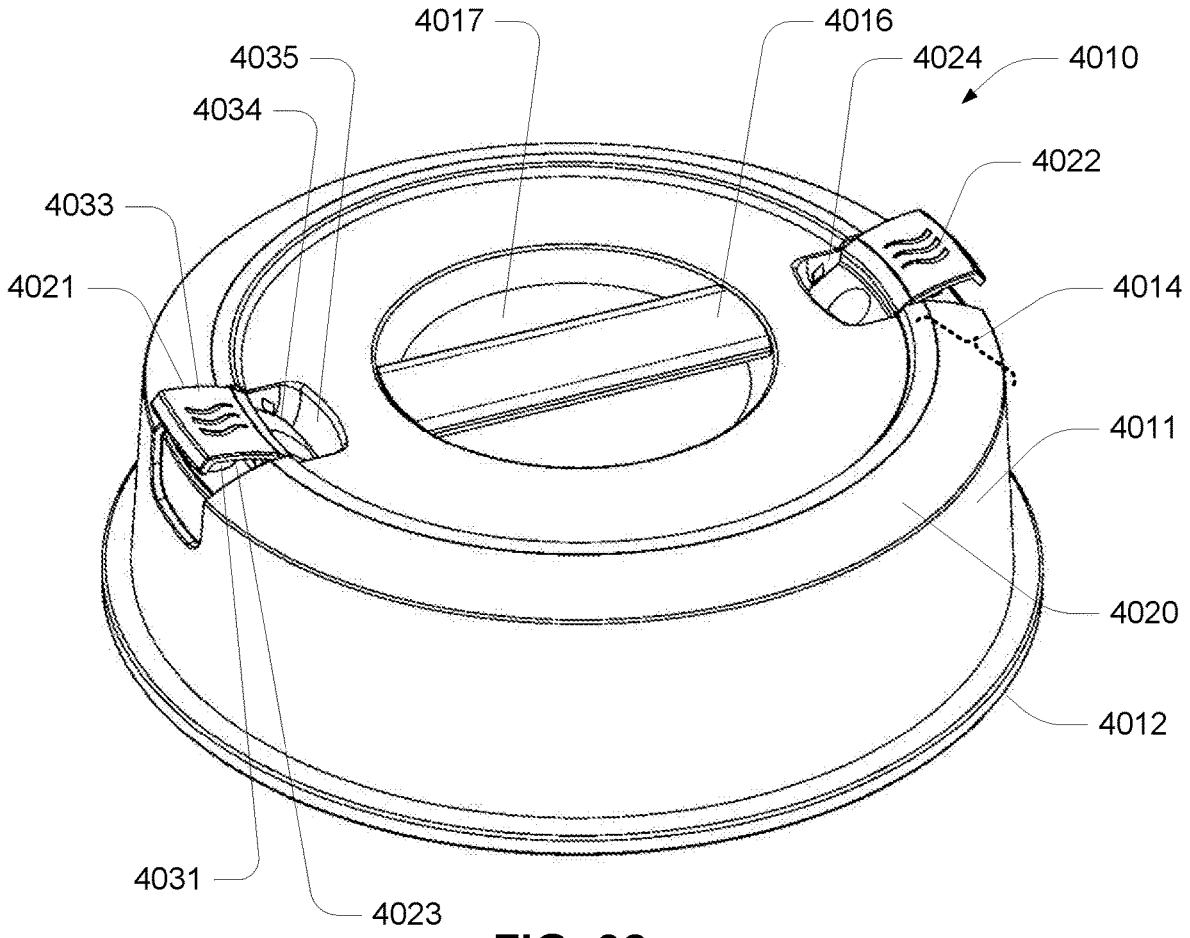
FIG. 38 illustrates the device of FIG. 1 with the closures in the open position.
Figure 39:
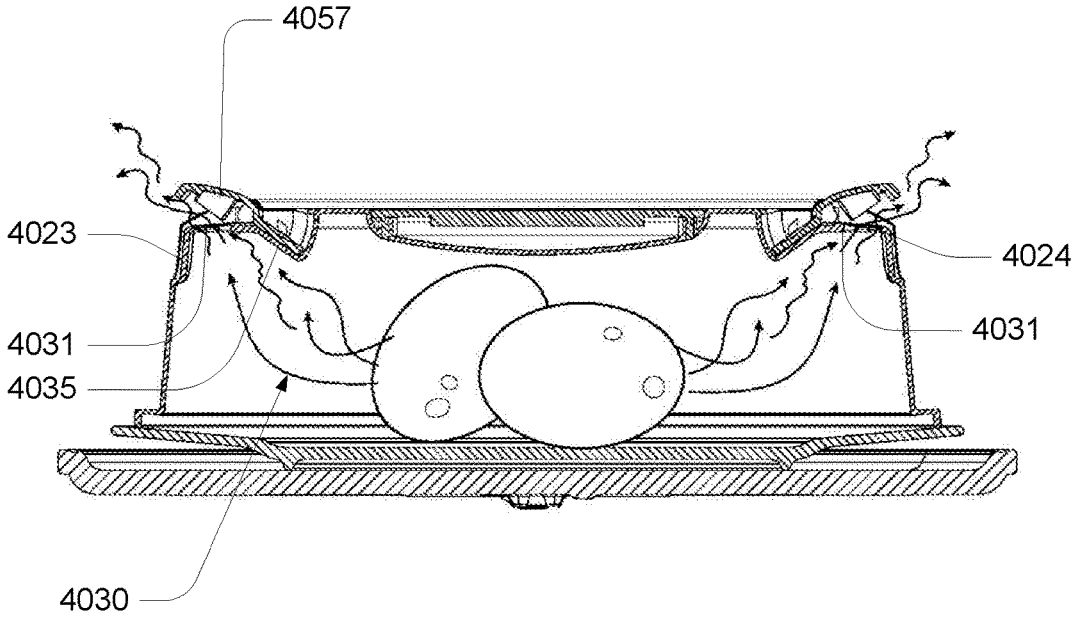
FIG. 39 is a cross section of the device depicted in FIG. 3.

In FIGS. 38 and 39, the closures 4021, 4022 are both shown in an open position whereby humidity or steam 4030 may escape through openings 4031 formed in the recesses 4023, 4024 in which the closures are located. The size of the openings can be calibrated to allow the correct amount of steam to escape to match the microwave controls humidity sensor. When the closures 4021, 4022 are pivoted into an open position, a portion of each closure 4033 that is radially outward of the closures hinge lies above the surface of the chamfered portion 4020. The portion of the closure 4034 that was radially inward of the closure's hinge is received by a depression or cavity 4035 that forms part of each recess 4023, 4024.

Figure 40:
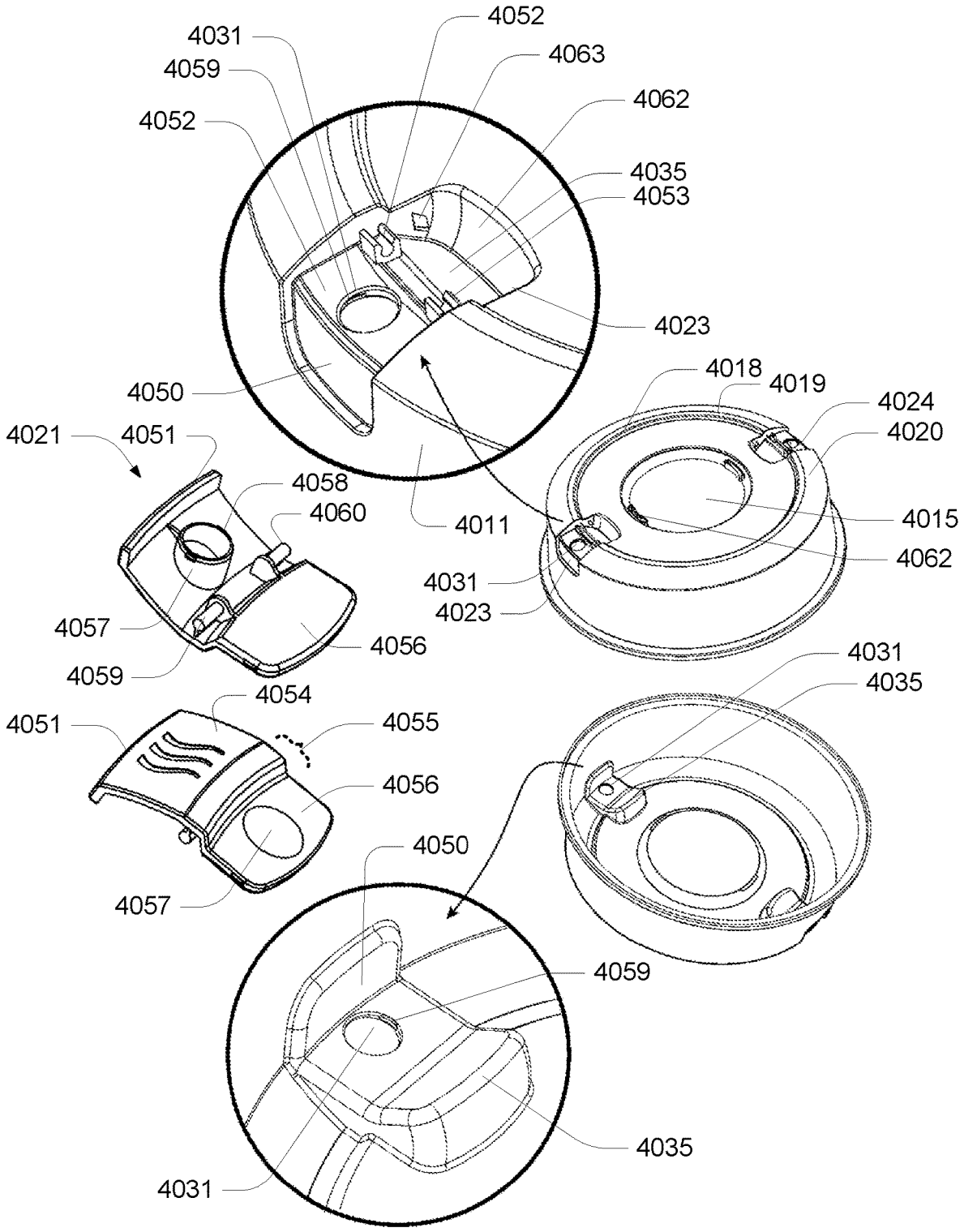
FIG. 40 are perspective views illustrating the closure and its recess.

As shown in FIG. 40, the shape of the recess 4023 conforms to the perimeter of the closure 4021. The recess 4023 has a forward wall 4050 that is recessed with respect to the sidewall 4011 and that accommodates an outer rim 4051 of the closure 4021. The recess 4023 has a recessed, horizontal ceiling 4052 in which is formed the vent opening 4031. In this example, pair of hinge elements being hinge channels 4052, 4053 are located radially inward of the opening 4031 and between the opening 4031 and the depression 4035.

The closure 4021 has an upper surface 4054 that conforms in shape to the shape of the chamfer 4020. The upper wall 4054 extends between the closure's rim 4051 and a transition section 4055 that conforms to the shape of the inner wall 4018 and upper rim 4019 of the cover 4010. The transition section 4055 supports a tab 4056 that is received by and cooperates with the depression 4035. The tab 4056 may have a visual indicator 4057 that provides a user with a target or visual reference for where to press the closure to open the vent formed by the opening 4031. The underside of the closure 4021, in this example, has a cylindrical plug 4057 that cooperates with the opening 4031. Other shapes for the plug 4057 and opening may be used, so long as they cooperate. The plug 4057 may have radially extending nibs or ears 4058 that are adapted to engage recesses 59 formed in the sidewall of the opening 4031. The ears 4058 assist in stabilising the closure when it is in a closed position and provide haptic feedback to the user regarding the state of the vent formed by the opening 4031 and plug 4057. A pair of hinged components in the form of cylindrical stubs 4059, 4060 cooperates with the hinge components 4052, 4053 and is located between the tab 4056 and the plug 4057. The internal sidewall 4062 of the well 4035 has inwardly directed tabs or shelf features 4063 for stabilizing the pivoting motion of the tab 4056 as it rotates about the hinge components, 4052, 4053, 4059, 4060. In this example, particular hinge components have been disclosed but it will be understood that the hinge components may take a variety of forms and orientations within the context of being located between the vent opening 4031 and the depression 4035. FIG. 40 also illustrates that the central well 4015 has opposing and upwardly extending channel features 4062 for receiving the ends of the handle 4016. Accordingly, a gap is created between the handle 4016 and the floor 4017 of the well.

Figure 41:
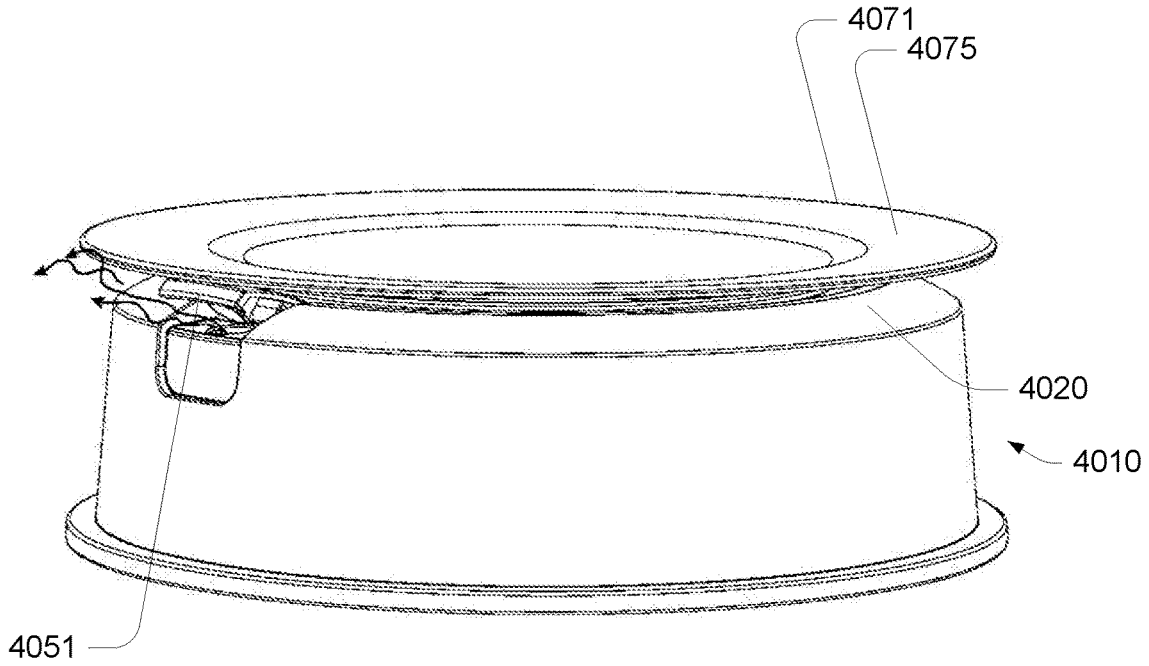
FIG. 41 is a perspective view illustrating the stacking of a plate on a cover.
Figure 42:
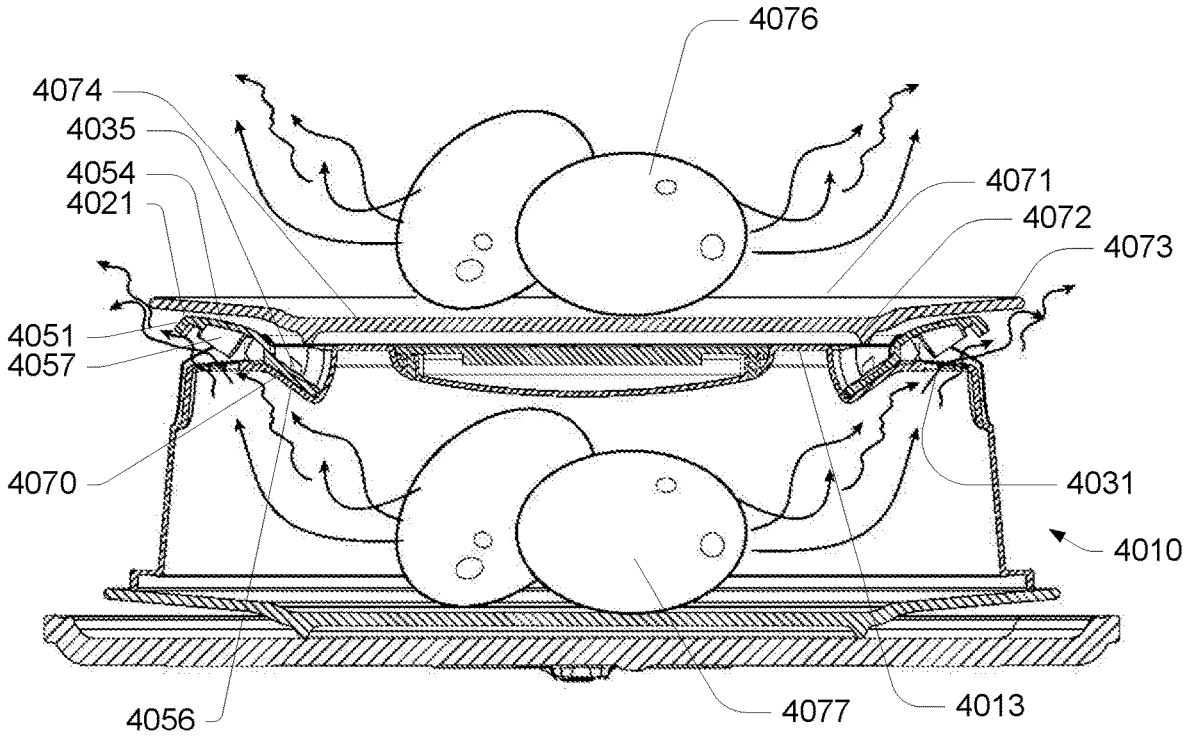
FIG. 42 is a cross section of the arrangement depicted in FIG. 6.

As shown in FIGS. 41 and 42, when the closure 4021 is in an open position, the closure's tab 4056 lies closely adjacent to the lower surface 4070 of the depression 4035. The closure's rim 4051 and upper surface 4054 lie above the circumferential chamfer 4020, thus releasing the plug 4057 from the vent opening 4031. However, it can be seen that even in the open position, the closure does not interfere with a plate 4071 that is stacked on supported by the cover 4010. In this example, the plate 4071 has a lower rim 4072 that sits on the flat and recessed upper surface 4013 because the edge 4073 of the plate is elevated above the floor 4074 of the plate, the broad and inclined rim 4075 of the plate does not interfere with the closure in its open position. The second plate 4071 may be used to support second foods 4076 for cooking on their own in an elevated position or simultaneously with foods 4077 located beneath the cover 4010. Elevation can improve microwave penetration to the underside of larger masses of food.

Figure 43:
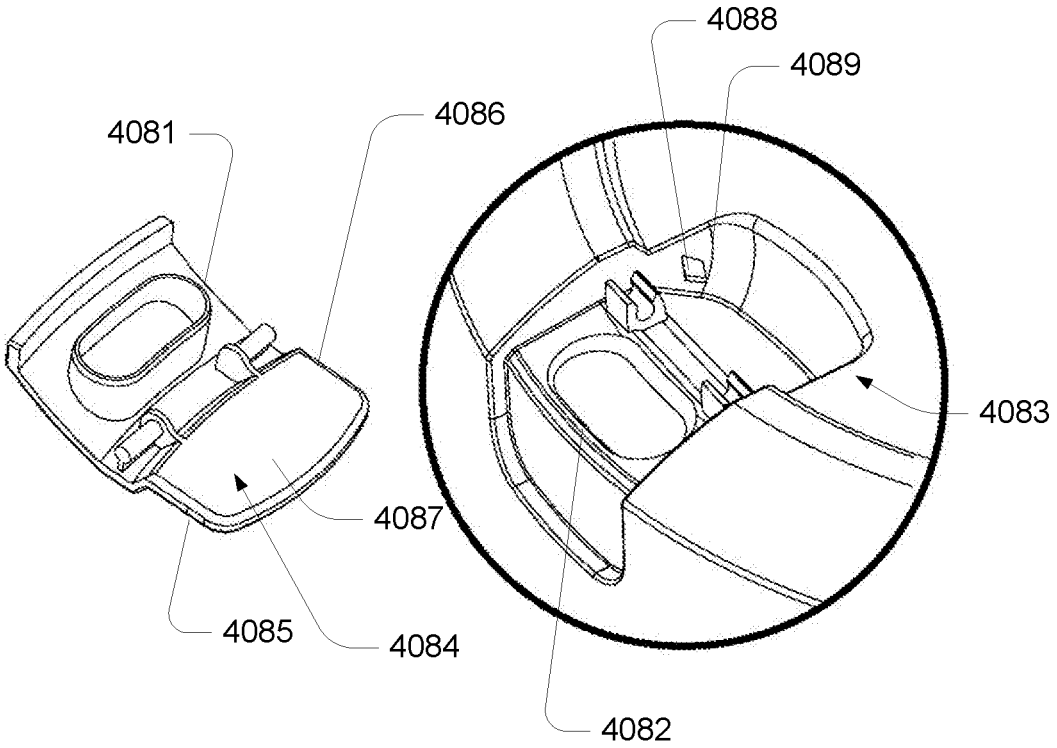
FIG. 43 are perspective views of a second embodiment of a closure and recess.

As shown in FIG. 43, the shape of the closures' plug 4081 may vary from the circular. In this example, the plug 4081 is elongated or oval shaped. The precise of the plug 4081 is not important so long as it cooperates with the shape of the opening 4082 formed in the cover 4083. In this example, it can be seen that the closure 4084 has a pair of structural features such as tabs or recesses 4085, 4086 located on either side of the tab 4087. These features of the closure 4084 cooperate with the shelves or nibs 4088, 4063 that are located on the internal side wall of the well 4089. These optional features stabilise the pivoting closure, particularly when the vent opening 4082 is open, by preventing gravity from returning the closure 4084 to its closed position.

Figure 44:
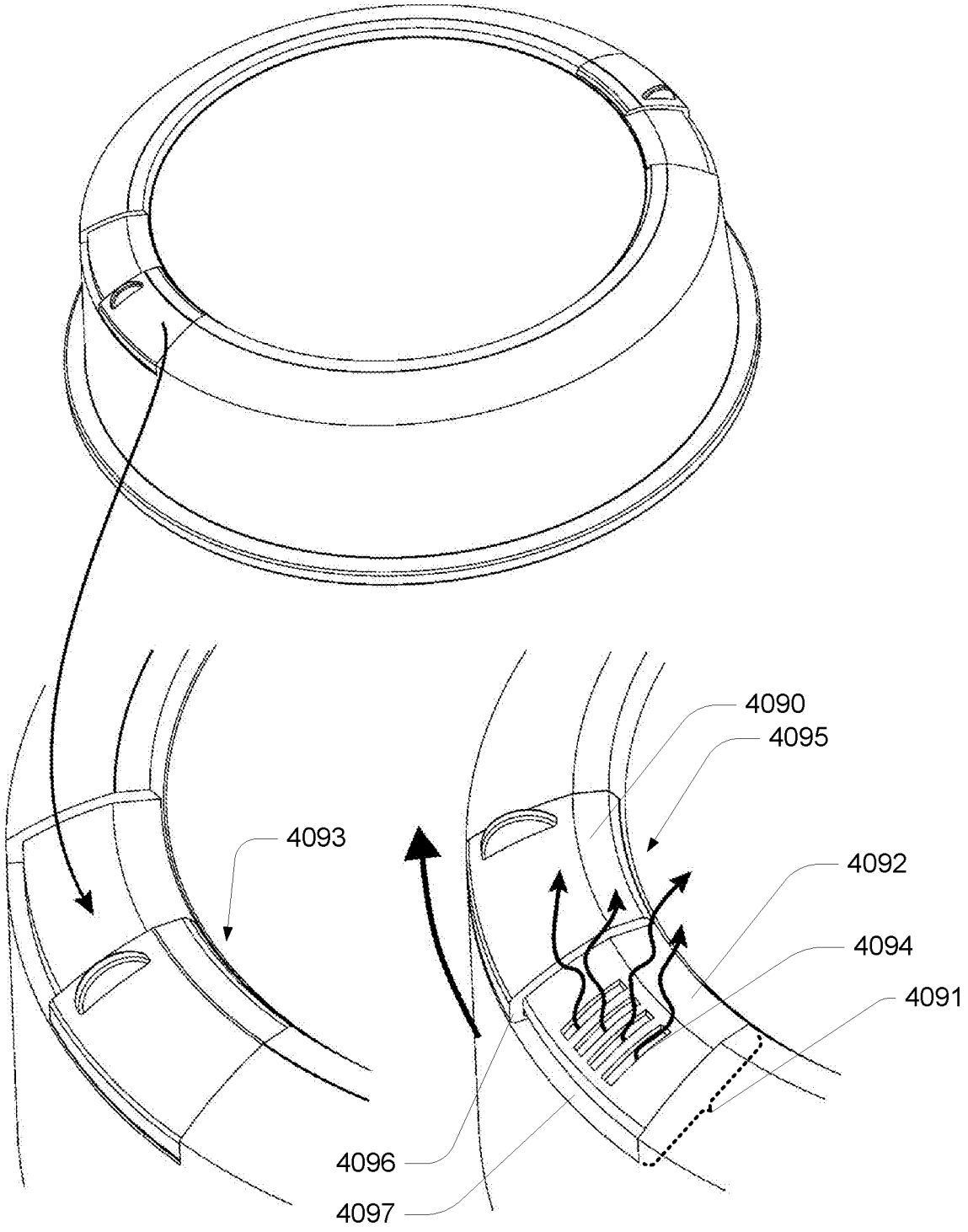
FIG. 44 is a perspective view of another embodiment of a closure and recess.

As shown in FIG. 44, the closure 4090 may slide rather than pivot. In this example, the closure 4090 slides about the circumference of the intermediate portion 4091, 4014 and is shaped to resemble it. The closure 4090 slides within a recess 4092. When it is closed, 4093 the closure obstructs the one or more steam vent openings 4094. When the closure 4090 is open or partially open 4095 the vents 4094 are exposed. In this example, the closure 4090 is stabilised by a return of lip 4096 that engages a groove 4097 located in the area of the recess 4092. FIG. 44 shows the cover without the optional well 4017 and optional handle 4016.

Figure 45:
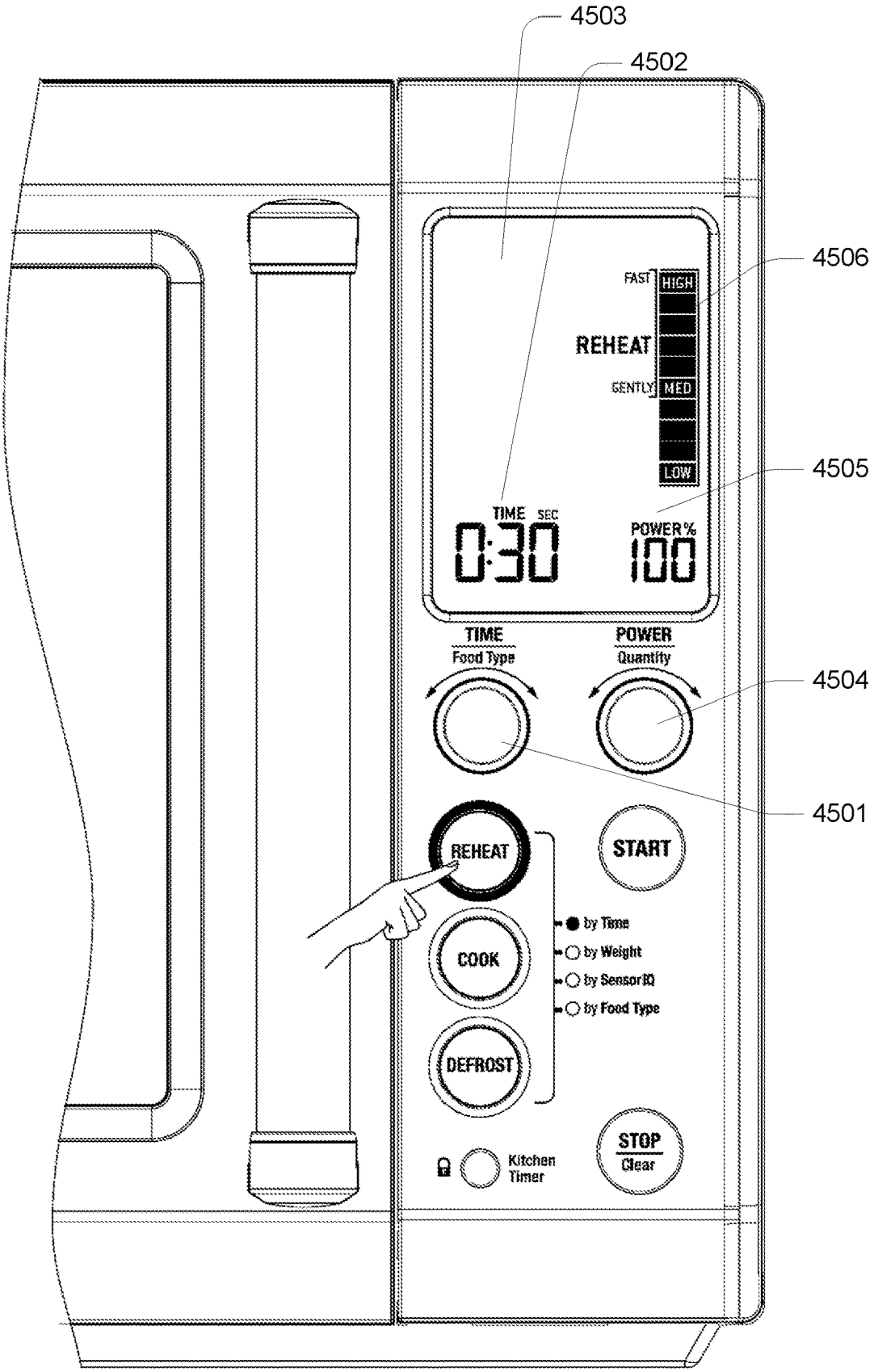
FIG. 45 is a front elevation view of an alternate control panel and display.

As shown in FIG. 45 and with reference to the embodiments depicted in, for example, FIGS. 3-15, the left-right orientation of the "power/quantity" control and the "time/food type" control may be reversed. In this embodiment, the "time/food type" control 4501 is located in the upper left corner of the control panel and the numeric display of time 4502 is located in the lower left corner of the display panel 4503, above the "time/food type" control 4501. Correspondingly, the "power/quantity control" 4504 is located in the upper right hand corner of the control panel area and the power and quantity numeric display 4505 is located above and adjacent to it in the lower right corner of the display area 4503. In this example, the power indicating bar display 4506 is located along the right hand margin of the display 4503 above the numeric segments that indicate power of food quantity 4505.

Figure 46:
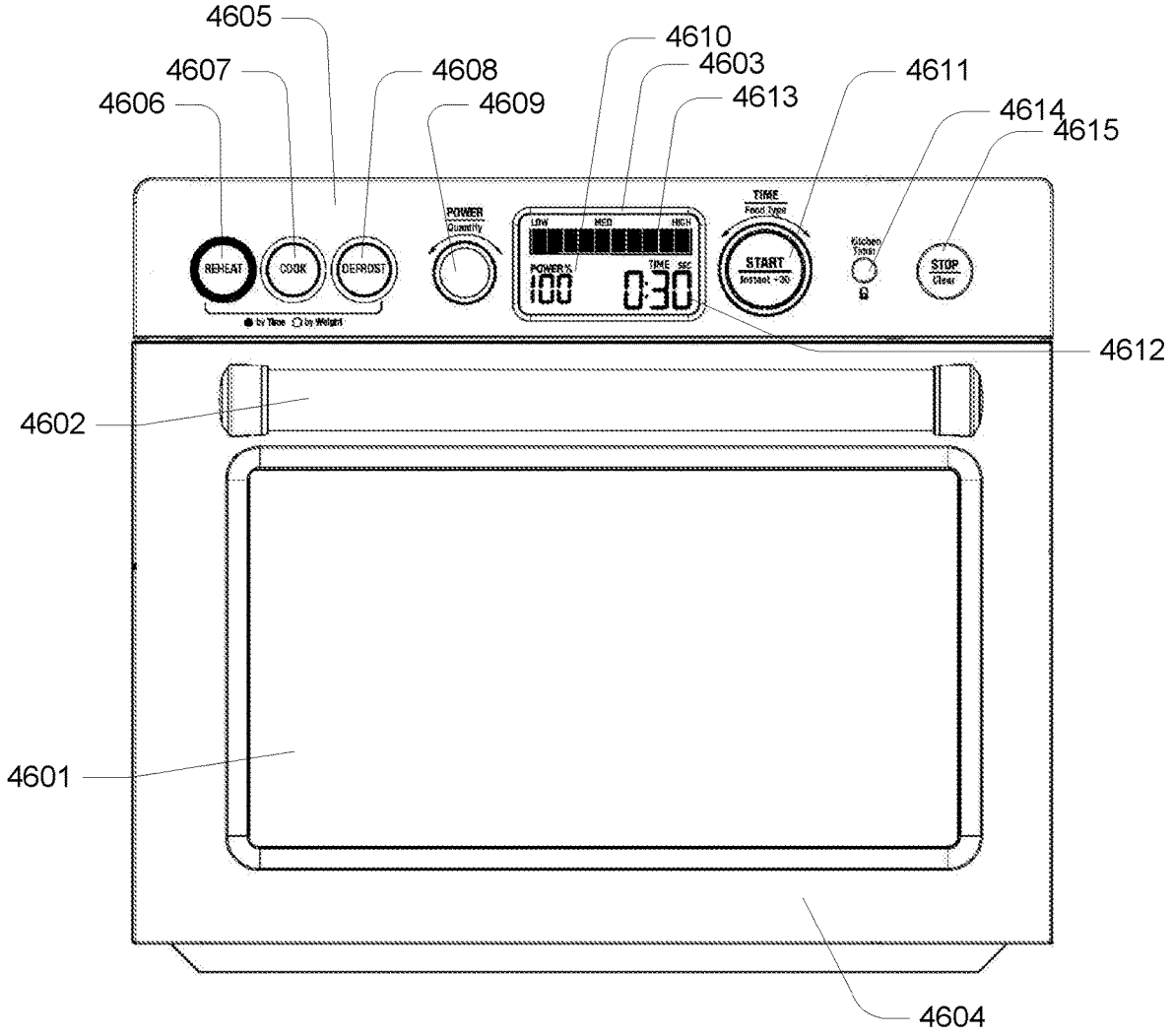
FIG. 46 is a front elevation of an oven with a horizontally hinged door with a control panel and display above it.

An alternate embodiment is depicted in FIG. 46. In this example, the microwave oven 4600 has a door that pivots horizontally to expose the cooking cavity. The door features a central viewing window 4601 and a cylindrical horizontal handle 4602 located above it. A graphic display area 4603 is located above the door 4604 in a horizontally aligned rectangular panel 4605 that also features the various user controls. The user controls include function buttons, each with an illuminated surround, for the following functions: reheat 4606, cook 4607 and defrost 4608. These controls are located in horizontal alignment to the left of the panel 4605. The "power/quantity" control or rotating knob 4609 is located directly to the left of the graphic display 4603. The numeric segments for displaying the power or food quantity 4610 are located adjacent to the left edge of the display 4603. The combination rotating and push button time/food type and start control 4611 is located to the right and adjacent to the graphic display 4603. The numeric segments 4612 for displaying the cooking time are located at the lower right hand corner of the display adjacent to the right side edge of the display 4603. The graphic bar display 4613 extends across the top edge of the display 4603 above the power and time numeric segments 4610, 4612. The combination kitchen timer and lock control 4614 is located between the time/food type and start control 4611 and the stop/clear control button 4615. In this example, all of the user operated controls 4606, 4607, 4608, 4609, 4611, 4614 and 4615 are located in a horizontal row, with their centres approximately aligned, and in approximate alignment with the transverse centre line of the display area 4603. The display area 4603 is located in alignment with the medial centre line of the door 4604.

Figure 47:
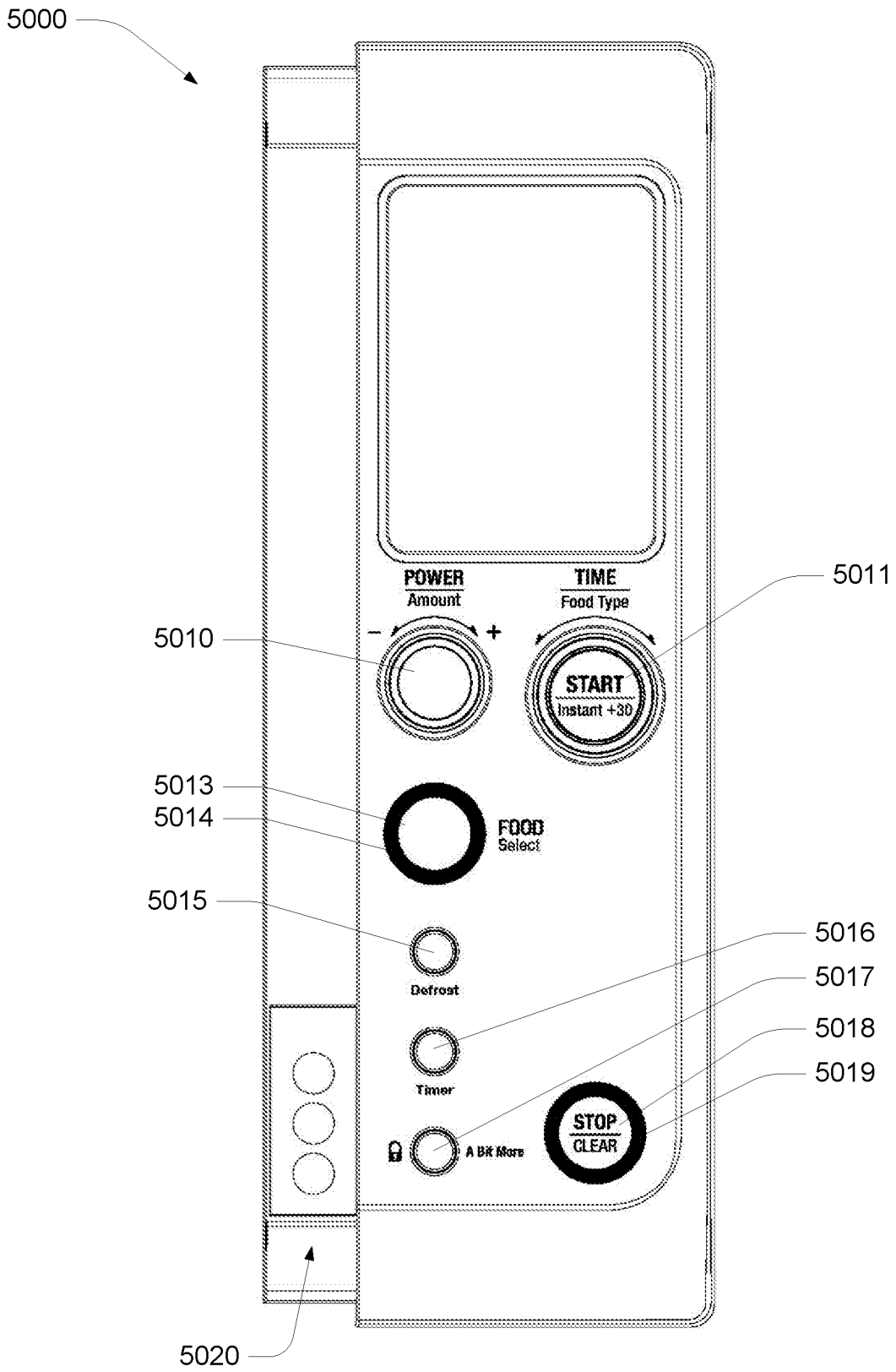

FIG. 47 shows an alternative control panel 5000 for a conventional oven or microwave oven. In this alternative embodiment user interface, the power input element (or dial) 5010 and time input element (or dial) 5011 are positioned in a horizontal configuration. A dedicated food selection user input (or button) 5013 enables user selection of predetermined food types with predetermined preheat or cooking options. An illuminated light ring 5014 is provided for indicating activity of food selection. Three further associated user inputs are vertically orientated, and include defrost selection 5015, timer selection 5016 and an "a bit more" selection 5117. In this embodiment, the "a bit more" selector can be further used to activate a child lock function. A stop/clear selector 5018 is located below the start selector. The start selector is also associated with an illuminated light ring 5019. The user interface further includes a plurality or user selectors 5020 that are located behind the door when closed. These user selectors 5020 can include: clock set; volume adjustment; and/or unit conversion.

Figure 48:
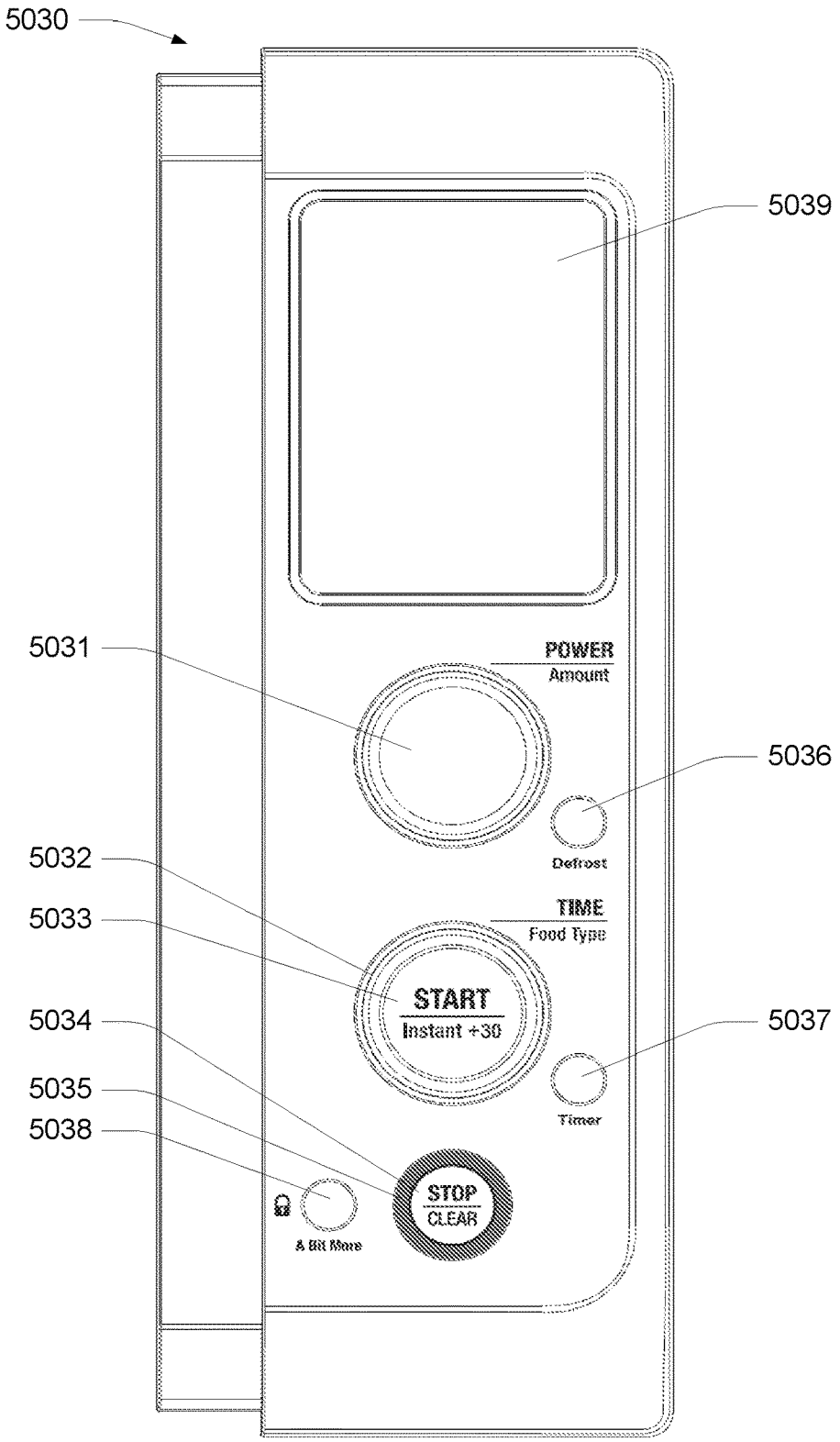

FIG. 48 shows an alternative embodiment of a user interface 5030. In this embodiment the power selector 5031 and time selector 5032 are vertically aligned. The time selector is associated with a centre button that operates as a start selector 5033. A stop/clear selector 5034 is further located below the time and start selectors, and includes an illuminated light ring 5035. Distinct user inputs are further provided as a defrost selector 5036, timer selector 5037 and "a bit more" selector 5038. The user interface includes a display element 5039. It will be appreciated that the shortcut button located behind the closed oven door (as shown in FIG. 47) are not included in this configuration.

Figure 49:
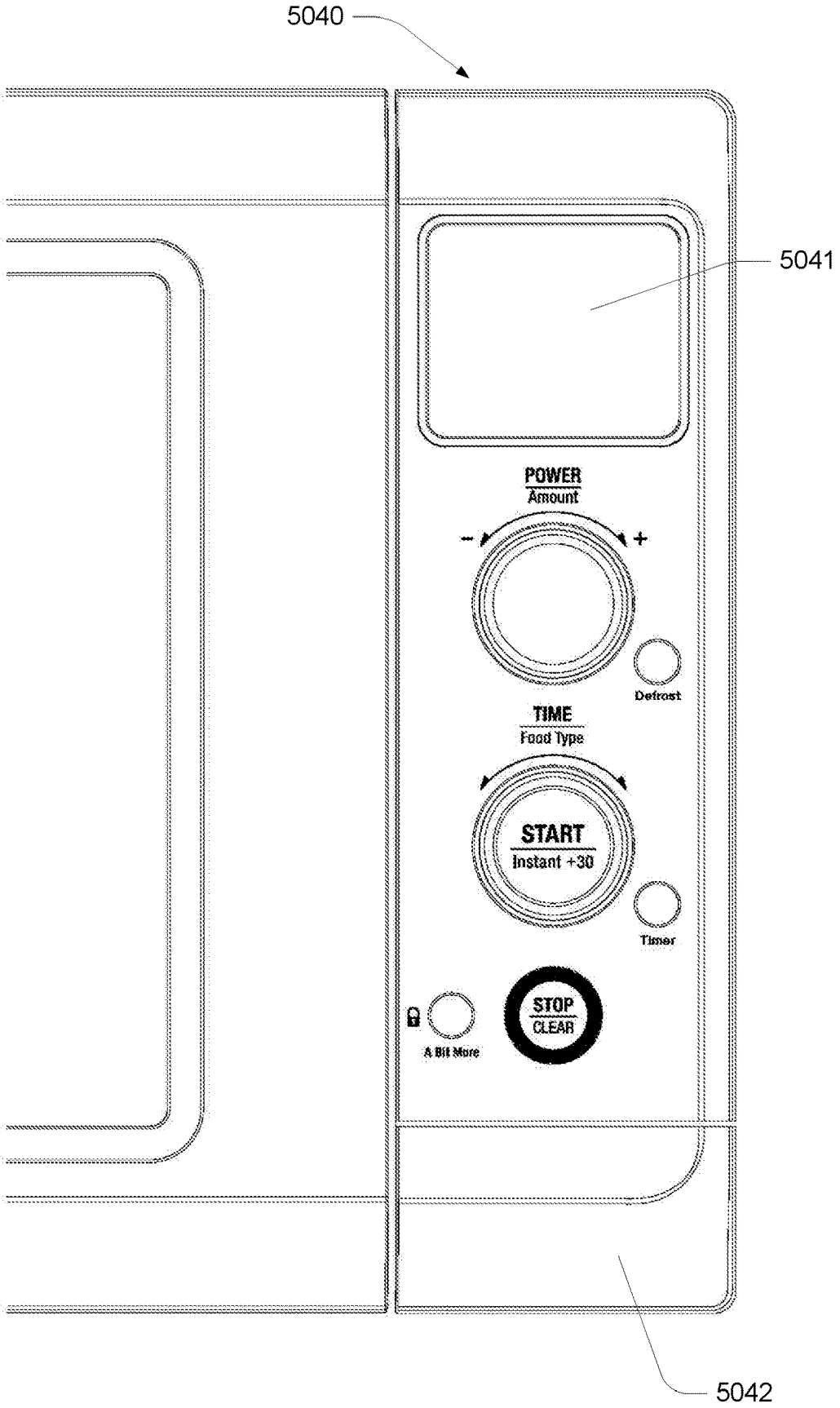

Referring to FIG. 49, an alternative embodiment user interface 5040 presents an alternative display element 5041, primarily having a different size to that depicted in FIG. 48. This alternative configuration further includes a push door release button 5042 located beneath the user interface.

Figure 50:
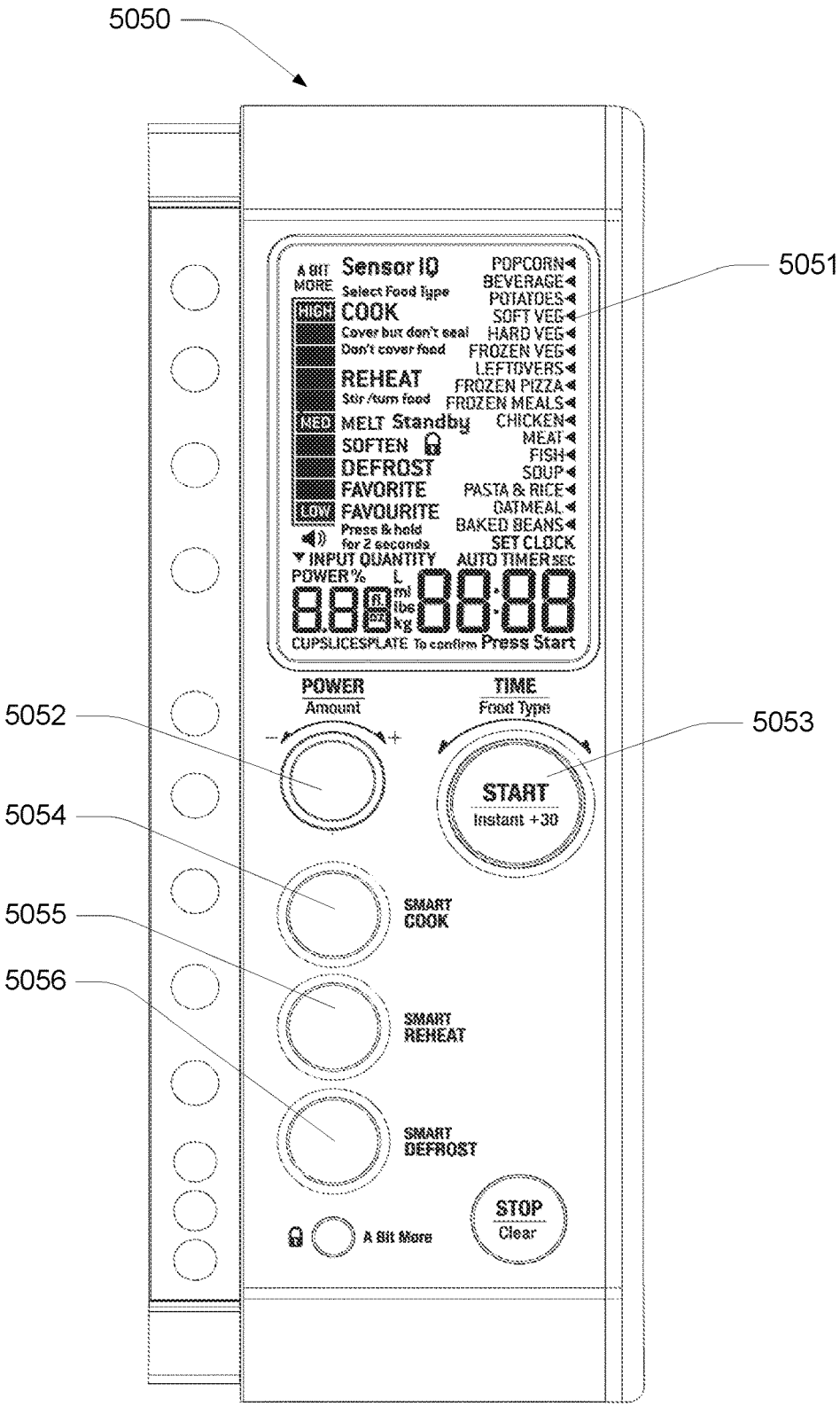
Figure 51:
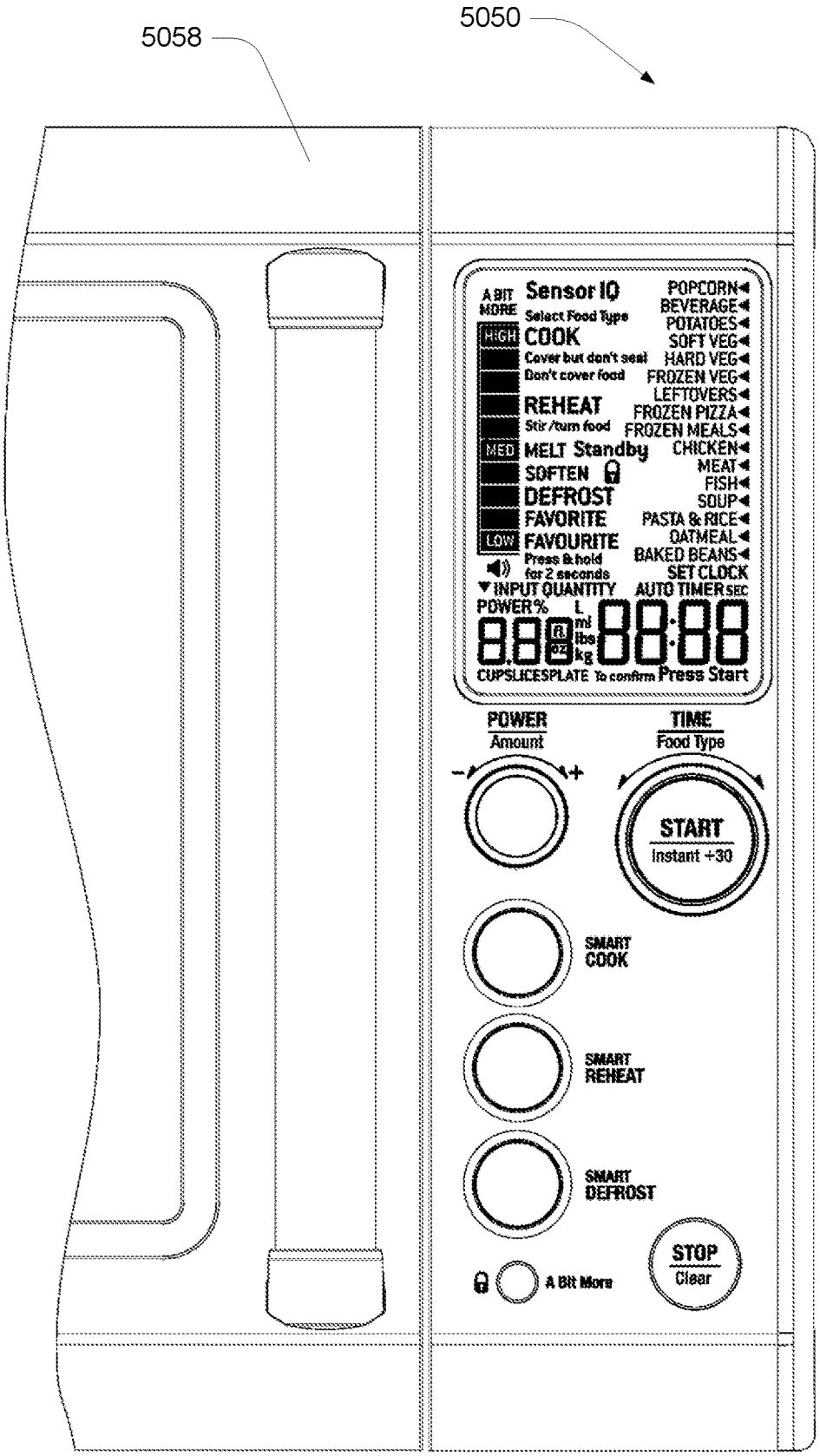

FIG. 50 shows an alternative embodiment user interface 5050. A display element 5051 is shown with all segments being active. In this configuration the power selector 5052 and time selector 5053 are horizontally aligned. Three custom cooking selectors 5054, 5055, and 5056 are vertically aligned, and each associated with an illuminated light ring. The user interface control panel 5050 is further depicted in FIG. 51, shown with a door 5058 in the closed configuration.

FIG. 52 through FIG. 65 show operation of example embodiment user interface 6000. The user interface includes a display element 6002, a power selector 6004, a time (or food type) selector 6006, which is further associated with a centre start selector 6008. A plurality or function selectors (6010, 6012, 6014) are also included in the user interface, each associated with an illuminated light ring. A stop/clear selector 6016 is included. An action selector 6018 for "a bit more" action is included. This action selector 6018 is also used for activating and deactivating a child lock function.

Figure 52:
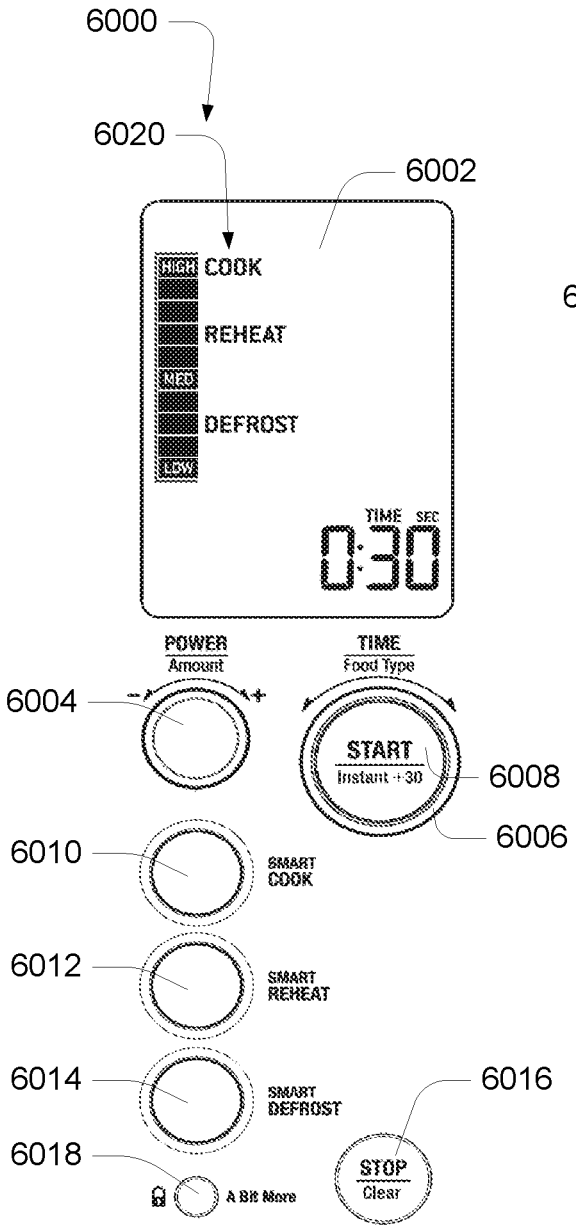

Referring to FIG. 52, the display element 6002 displays indicators for "cook", "reheat", "defrost" functions (at 6020), which are each associated with a respective function selector (6010, 6012, 6014), and which correlate with the order presented on the user interface.

Figure 53:
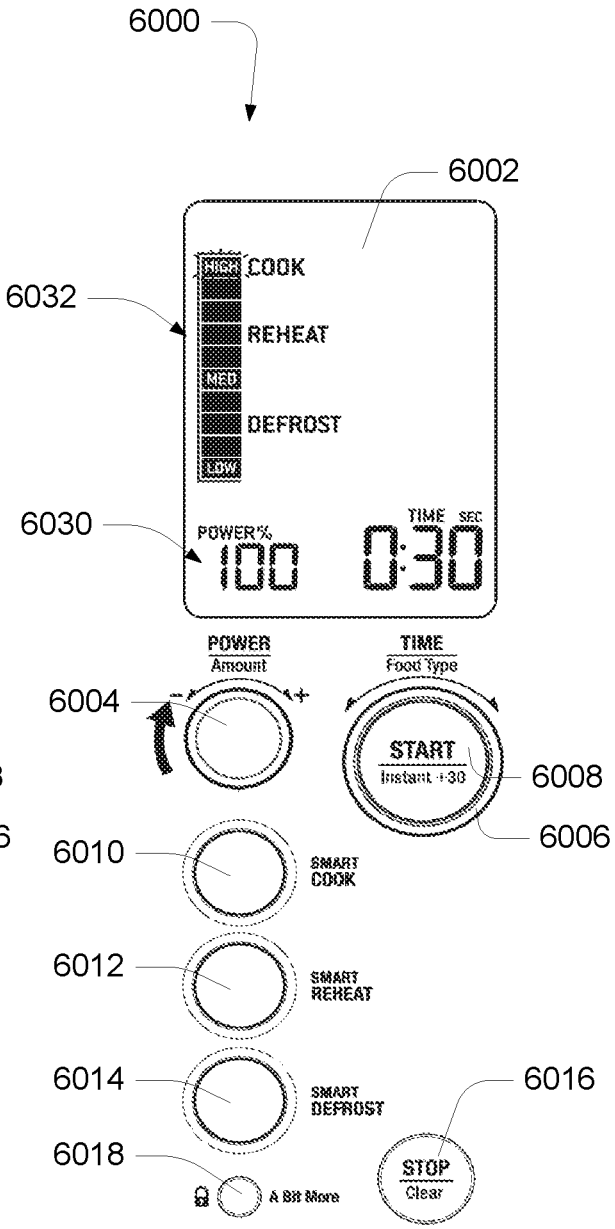

Referring to FIG. 53, the selected power setting is displayed both in a numerical value 6030 and vertical power bar graph 6032. In the present configuration, with the power setting at 100%, clockwise rotation of the power selector 6004 causes the upper portion of the power bar graph to flash, indicating to the user that the highest power setting is selected.

Figure 54:
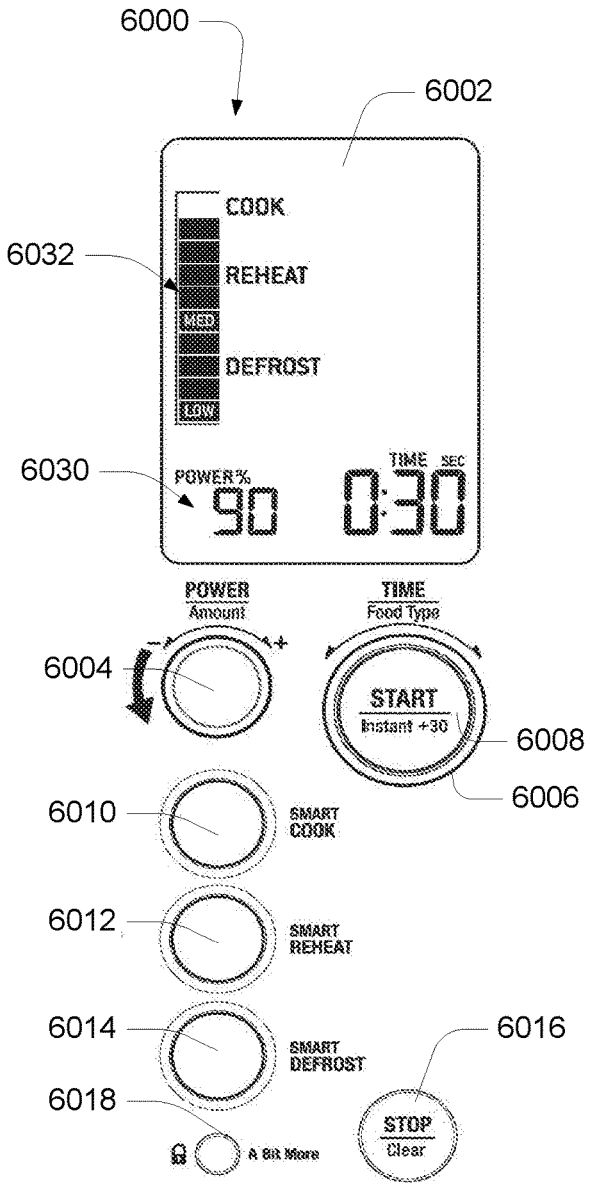

Referring to FIG. 54, anticlockwise rotation of the power selector causes the selected power setting to decrease, which is represented in both the numerical display 6030 and power bar graph 6032.

Figure 55:
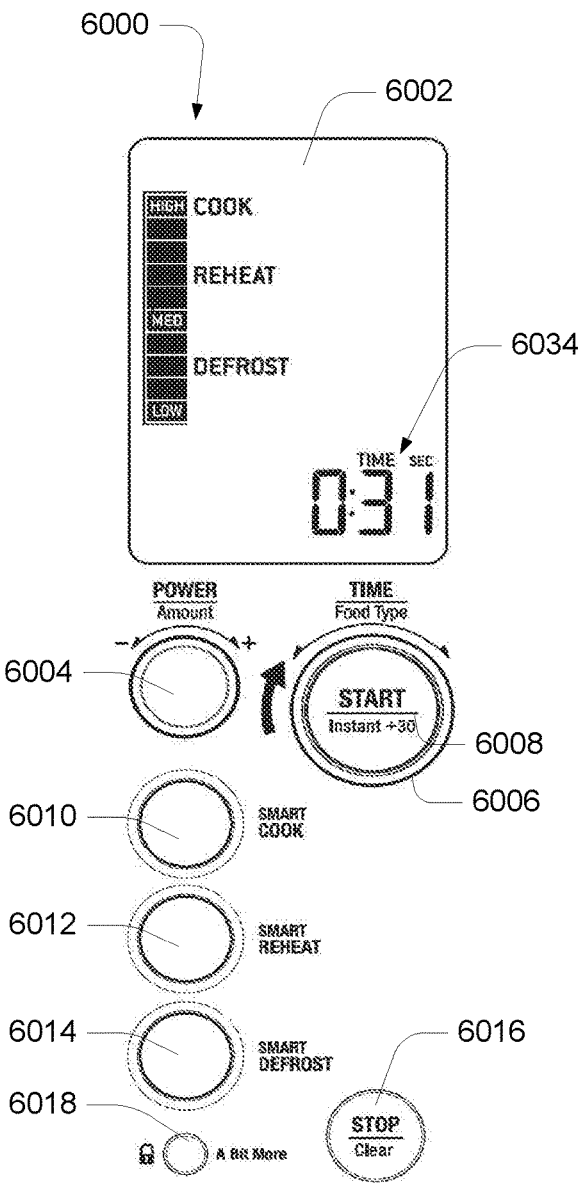

Referring to FIG. 55, clockwise rotation of the time selector 6006 causes the user's selected time to increase, as depicted a numerical display 6034.

Figure 56:
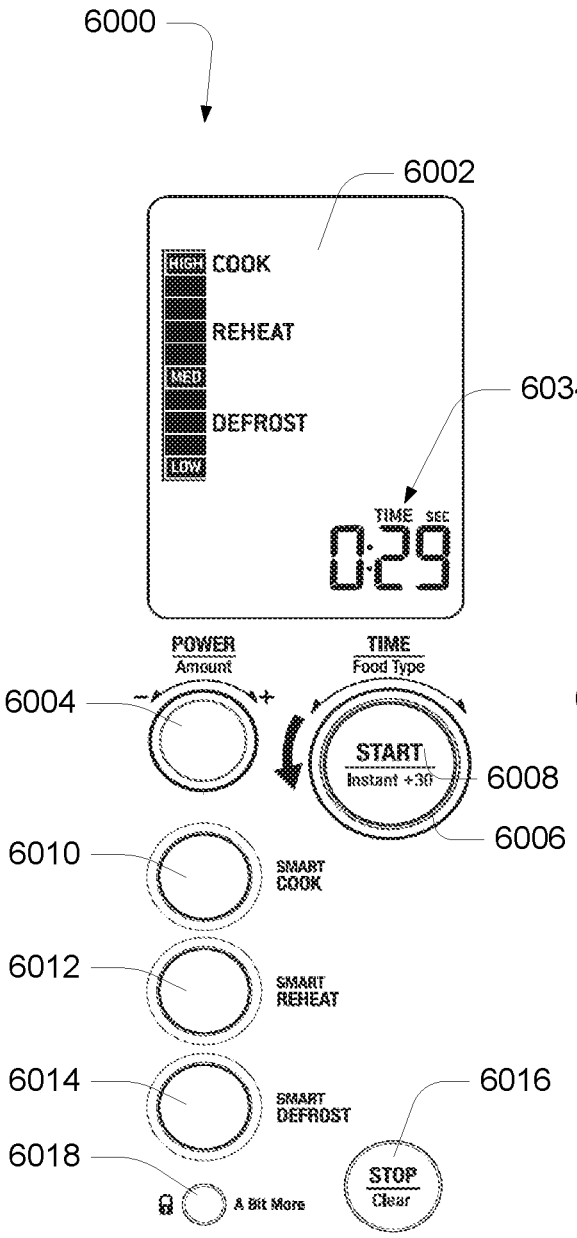

Referring to FIG. 56, anticlockwise rotation of the time selector 6006 causes the user's selected cooking time to decrease, as depicted in the numerical display 6034. During user time selection, the numerical display for the power setting may be deactivated, thereby highlighting the user's selected time.

Figure 57:
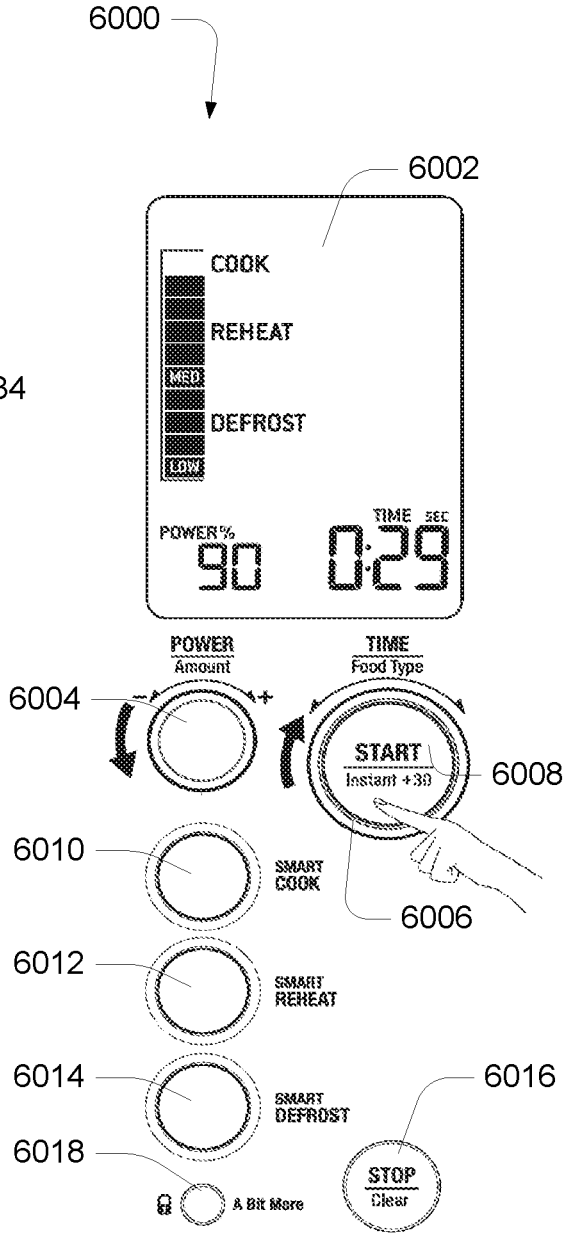

Referring to FIG. 57, user selection of the start selector 6008 causes the oven (conventional or microwave) to operate. Both the power selector 6004 and the time selector 6006 can be used to adjust the power and time settings during operation of the oven.

FIG. 58 through FIG. 65 depict user operation of function selectors (6010, 6012, 6014)

Figure 58:
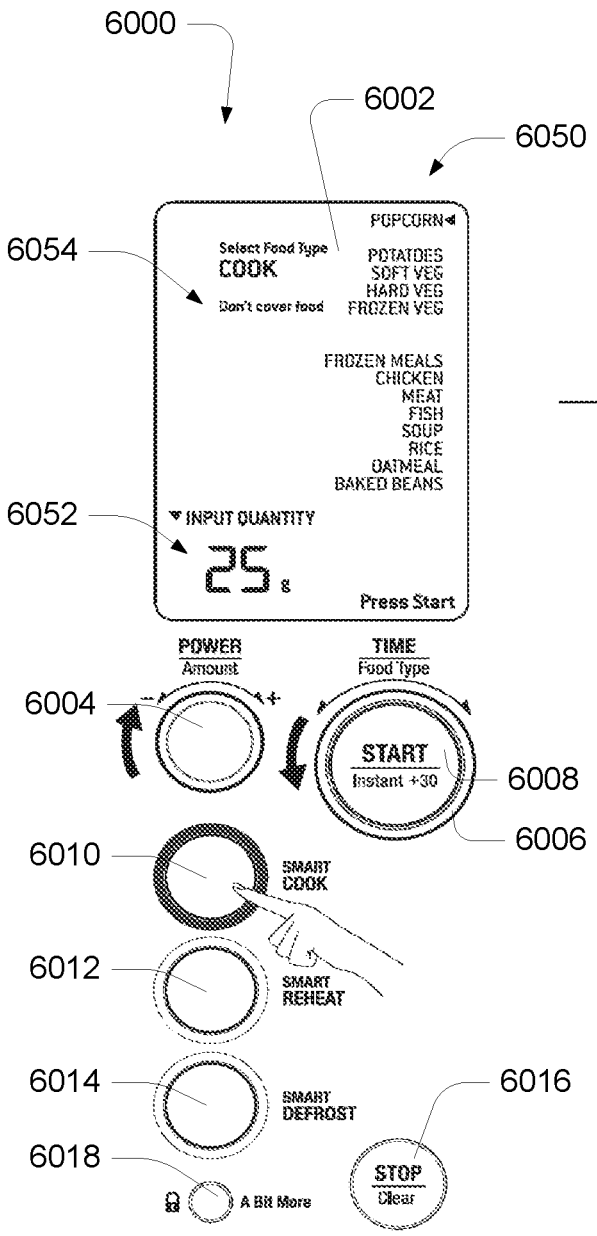
Figure 59:
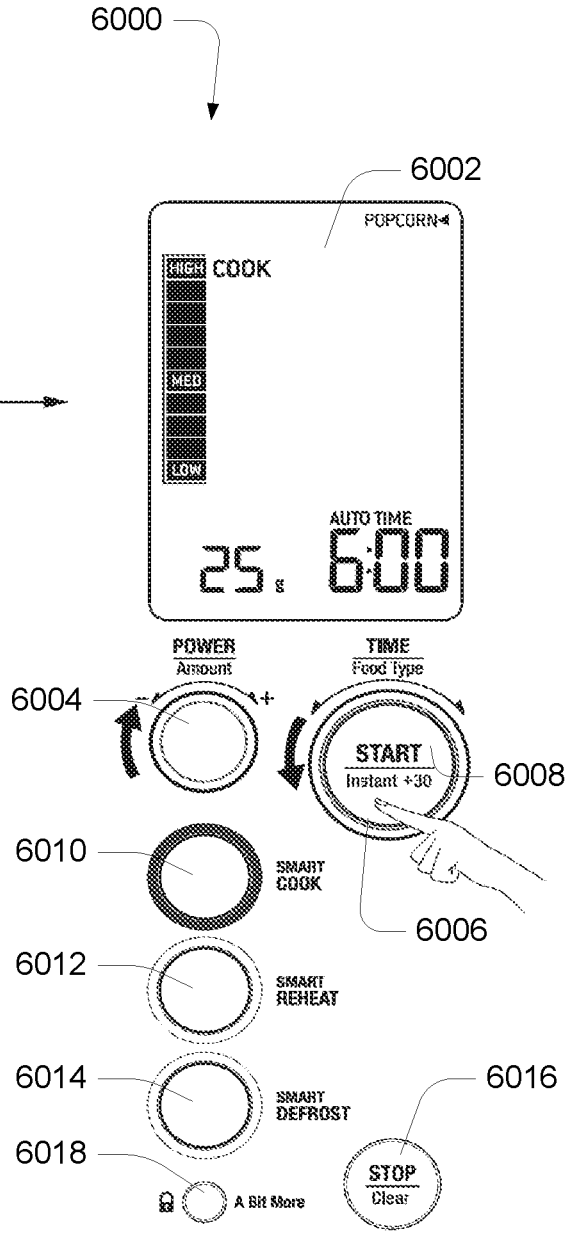

Referring to FIG. 58, user selection of the "Smart Cook" function selector 6010 causes the display element 6002 to present predetermined options for the function. In this embodiment, the food type can be selected from the user interface (at 6050). The food type can be selected by rotation of the user selector 6006. The food quantity can be selected by rotation of the power/amount selector 6004, which is indicated in the user interface (at 6052). A gesture can also be presented in the user interface for indicating a preferred cooking configuration (at 6054). The function selected can also be indicated by an indicator ring about the respective selector. Referring to FIG. 59, Upon selection of the start button 6008, the display element then displays a predetermined time and power settings. These can be further adjusted by the user through selection of the time selector 6006 and power selector 6004. Selection of the start button 6008 causes the cooking function to commence.

Figure 60:
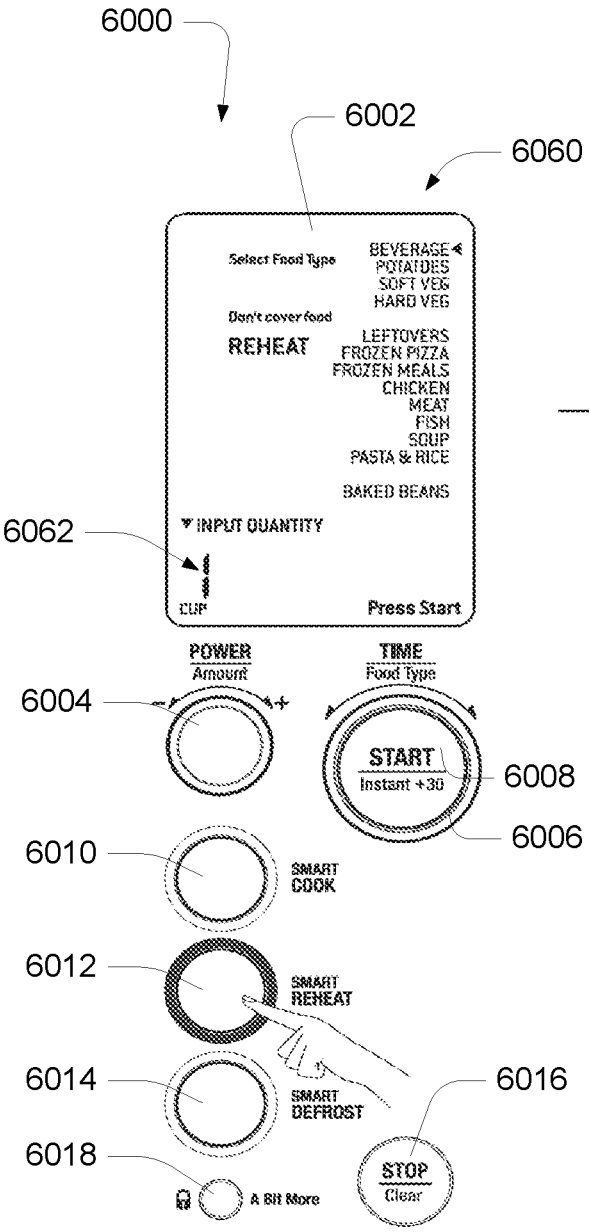
Figure 61:
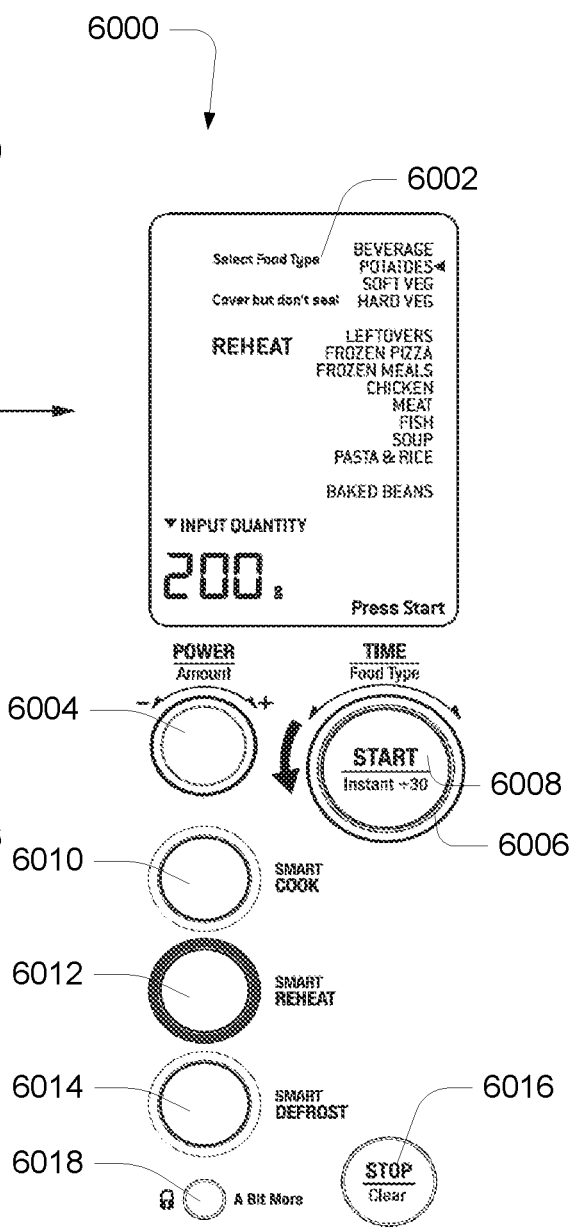
Figure 62:
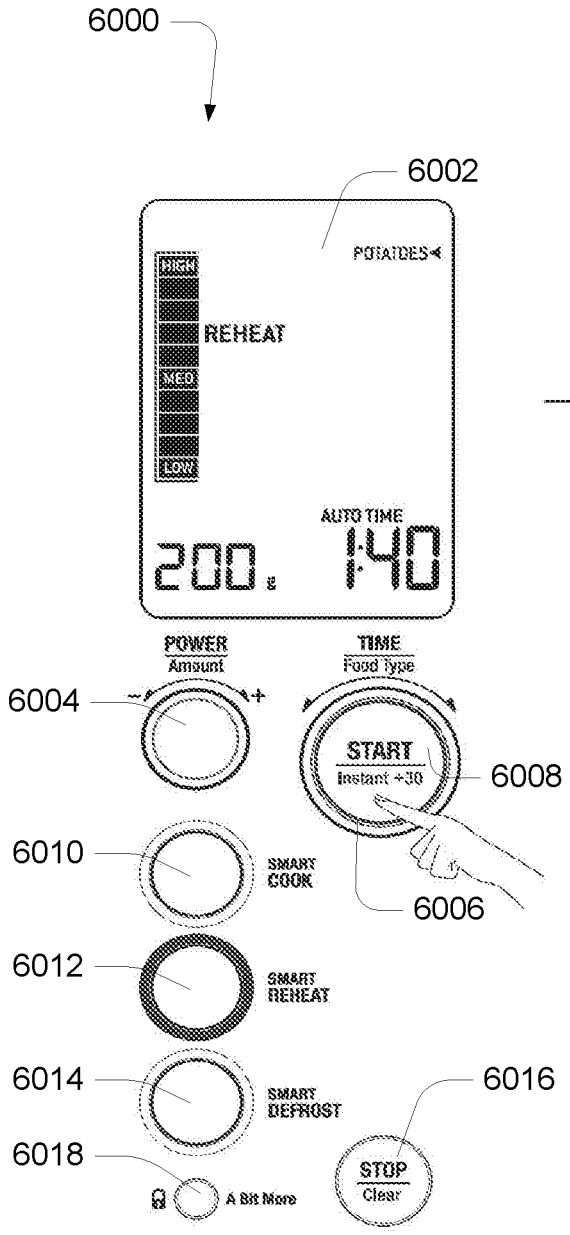
Figure 63:
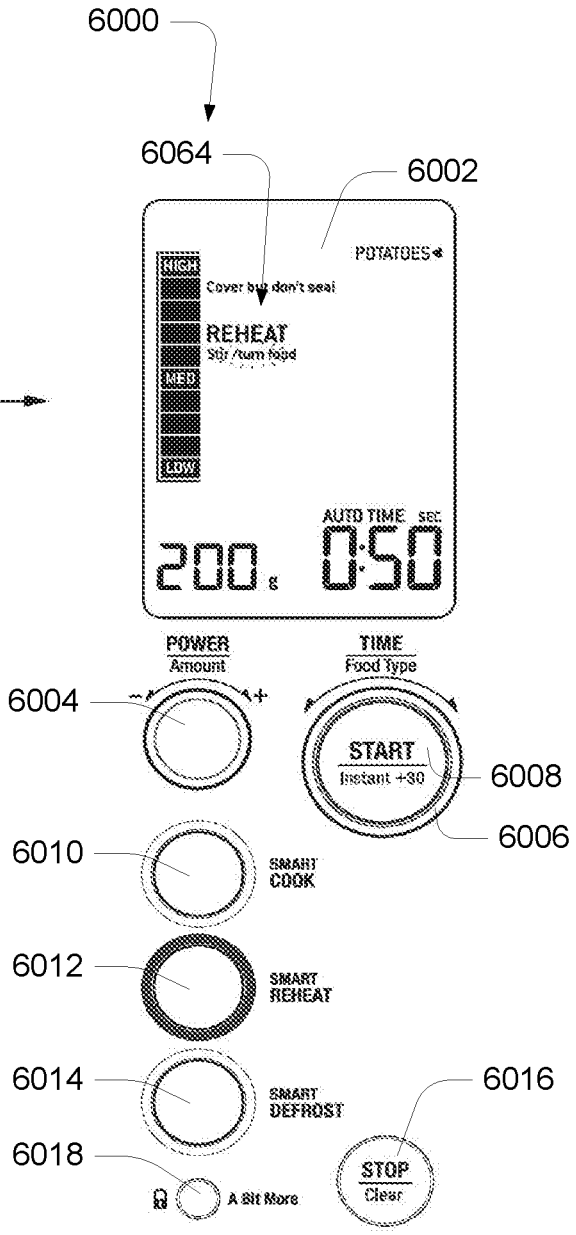

Referring to FIG. 60, initial operation of the "Smart Reheat" function can commence through user selection of function selector 6012. The display element 6002 presents food type options (at 6060) and available quantities (at 6062). The food type and quantity can be selected/adjusted as discussed above, through operation of the user selectors 6006 and 6004 respectively (for example, as shown in FIG. 61). FIG. 62 shows selection of the start button 6008, causes the display element to present a predetermined cooking time and power setting. The cooking time and power setting can be adjusted through operation of the selectors 6006 and 6004 respectively. FIG. 63 shows an intermediate operation of the reheat function could include a gesture (at 6064) for the used to stir or turn the food. The oven can pause or continue cooking at this time.

Figure 64:
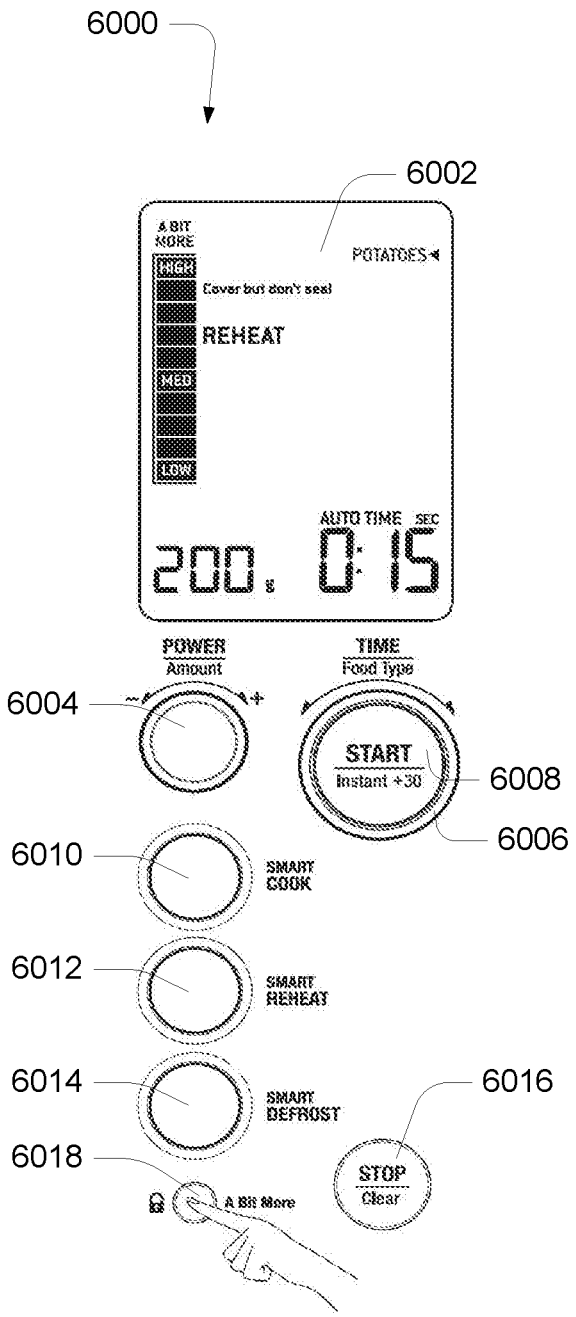

Referring to FIG. 64, user selection of a "a bit more" function selector 6018 recalls the previous cooking setting (for example including the cooking mode, food type, power level, power level, cooking time, food gesture and food quantity) and the provides a predetermined calculation of cooking time (for example 15% of the previous total cooking time)—to suggest a cooking mode and cooking time, and may automatically commence operation of the oven.

Figure 65:
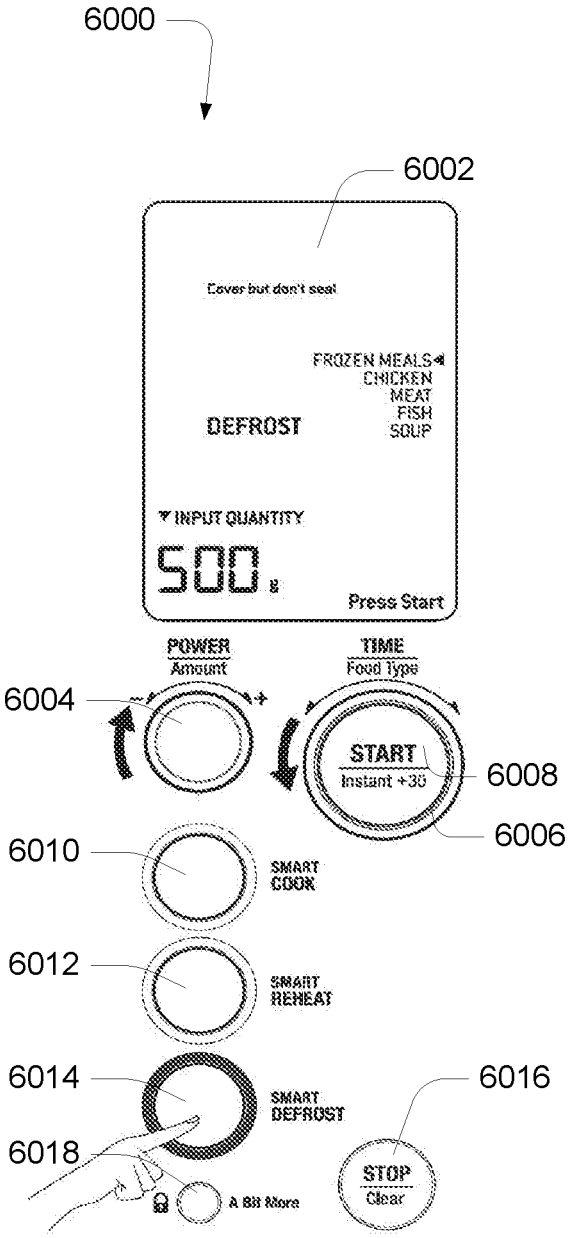

Referring to FIG. 65, user selection of a "Smart Defrost" function selector 6014, presents a list of predetermined food types (at 6070) and food quantities (at 6072) for user selection using the input selectors 6006 and 6004 respectively.

FIG. 66 through FIG. 68 show a plurality of "shortcut" utility selectors 6500, and their respective user interface displays.

Referring initially to FIG. 66:

user selection of the "reheat" utility selector 6510 can cause the display element to present a predetermined "auto time" and wait selection of the start selector (referring to 6512).

user selection of a "cook" utility selector 6520 causes the display element to present a list of predetermined food types that can be user selected (referring to 6522), wherein, in this embodiment, the cooking time is configured as an "Auto Time".

user selection of a time "defrost" utility selector 6530 causes the display element to present a predetermined defrost power level and a predetermined defrost time (referring to 6532).

user selection of a "favourite" utility selector 6540 causes the display element to gesture that selection of the selector is to be maintained for a period of time (referring to 6542), which then progresses to cause the display element to present the current setting as the stored "favourite" setting (referring to 6544).

user selection of a "popcorn" utility selector 6550 causes the display element to present a selected food type of popcorn, with an associated predetermined power setting and food quantity setting (referring to 6552).

Referring initially to FIG. 67:

user selection of a "baked beans" utility selector 6560 causes the display element to present a food type "baked beans" with a nominal food quantity (referring to 6562).

user selection of a "melt chocolate" utility selector 6570 causes the display element to present a predetermined power setting and input food quantity (referring to 6572).

user selection of a "soften butter" utility selector 6580 causes the display element to present a predetermined power setting and nominal food quantity (referring to 6582).

user selection of a "timer" utility selector 6590 causes the display element to present a timer (referring to 6592).

user selection of a "set clock" utility selector 6600 causes the display element to present a time (referring to 6602).

Referring initially to FIG. 68:

user selection of a "beep volume" utility selector 6610, enables user selection of a beep volume through repeated selection of the selector, or maintaining action on the selector (referring to 6612, 6614, 6616).

user selection of a "units" selection utility selector 6620 enables toggling between metric or imperial measurement (referring to 6622).

FIG. 69 and FIG. 70 show alternate embodiment ovens (7000, 7001), in which each use a pull down door (2010, 2011 respectively). It will be appreciated that each of these ovens (microwave or conventional) can be used as either a free-standing unit or a built-in unit. According to the configuration of the oven, the user interface may be located above the door (for example 7020), or to the side of the door (for example 7021). The user interface and display element can be constructed according to any one of the embodiments disclosed herein.

FIG. 71 shows an oven (microwave or conventional) 7050 having a pull down door 7052. The pull down door 7052 is hinged to open into a horizontal configuration (as shown). It will be appreciated that the central view opening provides a glass surface 7054. This glass surface can be integrated with a weigh module (scales). For example, load cells in the door assembly of the oven door can allow for food items placed on the glass surface to be weighed without the aid of an external portable scale. The weight measurement can then be display visually through the display element 7056 of the user interface, or through a secondary display/interface 7058. It will be appreciated that the weight module can be integrated, typically through a control module interface, to the cooking functions of the oven for providing weight measurements in determining cooking time and cooking power/temperature.

FIG. 72 shows an example embodiment door assembly 7060. This embodiment includes a locating gasket 7062 that surrounds a glass door insert 7064, which defines a substantially planar surface to operate as a scale surface. For a microwave embodiment, a conventional mesh screen 7066 is provided to prevent microwave energy from emitting through the door. External/facing glass 7068 is provided for the front of the oven door. A door housing 7070 enables assembly of the abovementioned components, and inclusion of four load cells 7072—a respective load cell located in each corner of the door. Each load cell can be located in an individual housing/casing 7074 and can include a capacitive sensor 7076 with an insulation seal. The door assembly can further include an independent display module 7080, typically located in an insulated enclosure and operates with a LCD type display and insulation cover 7082. It will be appreciated that the load modules can be coupled to a processor module for display of weight information through a display element. The weight measurement can be further used in cooking functions for calculating any one of cooking time, power settings or cooking temperature.

It will be appreciated that typical microwaves doors do not have an inner glass surface—commonly using a plastic sheeting that is adhered to the perforated metal barrier. It will be further appreciated that an outer glass surface on the door is on the wrong side of the perforated metal barrier to perform as a scale surface.

FIG. 73 shows a plan view of the door assembly, showing the scale surface 7064 and corner located load cells 7072. With a vessel or food items 7080 located on the glass surface, load mass is distributed to each of the load cells 7072. The processor module can then receive the four independent load cell signals/measurements and calculate/provide an average weight measurement, which can then be displayed on a display element (7080, 7082).

FIG. 74 shows an example function 7090 for determining a cooking time for a food item having a specific predetermined measured weight. In this example, the cooking time is determined by the formula: T (time)=30×W (weight in grams)/50). In the example (at 7082), a food mass weight of 225 grams has a calculates cooking time of 2:15 minutes.

FIG. 75 shows, by way of example only, a cooking function 7100 that uses an integrated weight measurement module (scales) in determining cooking time or oven power settings. In this example, a user selects a function type (for example "reheat") by rotating a function dial 7110, which is then confirmed by pushing the dial/button. After confirmation, depending on the function type selected, further food types may be presented. The user then can select a food type (for example selecting chicken) by rotation of the dial 7112, which is then confirmed by pressing the dial or central button. The display element can then prompt the user to place a food item on the integrated scales to allow auto detection of the quantity relevant to the cooking function and food type selected. The user may be further prompted by a gesture of "place food of scale surface". A separate calibration (tare weight) button 7116 can be provided to zero the scales prior to weighing a food item. With the food item placed on the scales, the oven can automatically determine a quantity, which is then presented in the display element 7118. The total weight can flash (on and off) for a predetermined time period. The display element may gesture to "press start" to indicate that a set-up is complete, and to prompt the user to commence cooking operation. Based on the inputs above (function type, food type and weight) the oven can determine or calculate a cooking time and power/temperature setting. The display element 7120 displays the food type, predetermined cooking time, food quantity, function type, predetermined power setting for confirmation or adjustment by the user.

Figure 76:
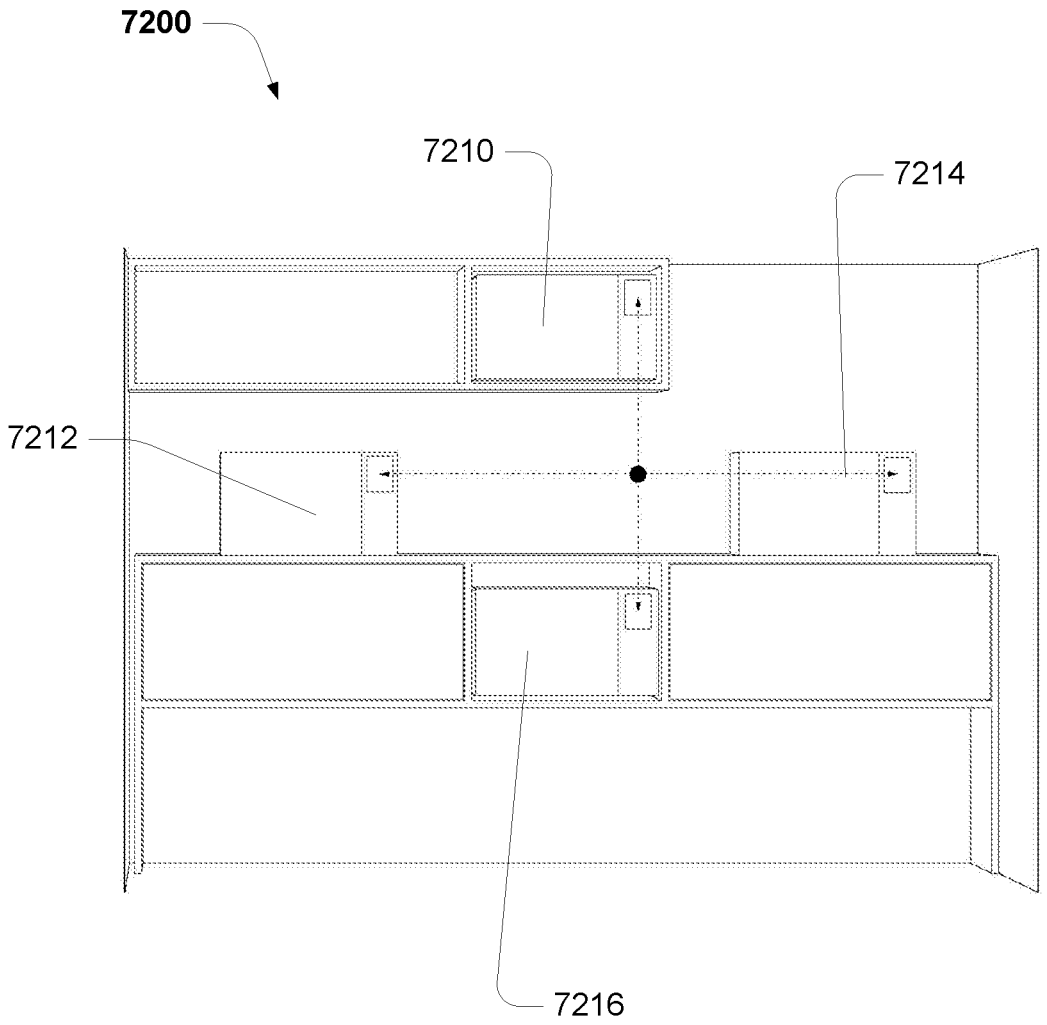
Figure 77:
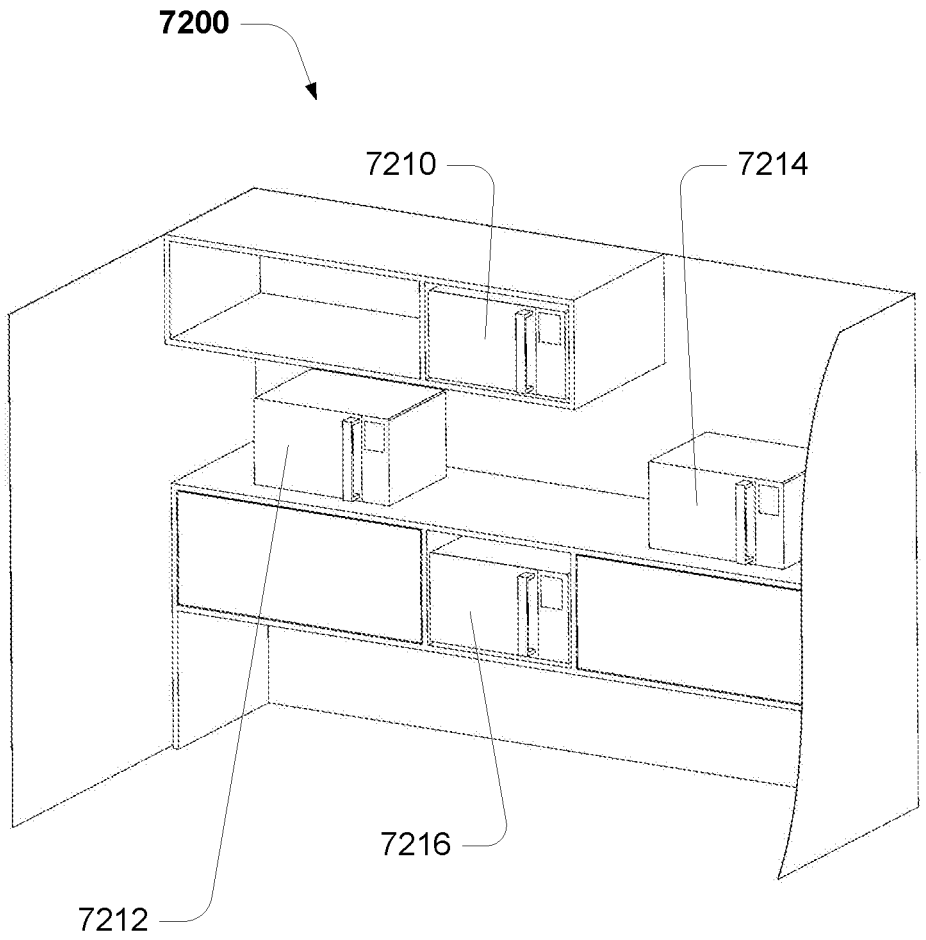

FIG. 76 and FIG. 77 show an example kitchen environment in which an oven is typically located. It will be appreciated that the location of the oven will vary viewing angles for any display elements, thereby affecting display quality for the type of liquid crystal display (LCD) used (for example, being FSTN —Film compensated super-twisted nematic display, Formulated super-twisted nematic display or Filtered super-twisted nematic display). The nature of this type of display means that no all four viewing angles or sides are not equal in viewing quality. It will be further appreciated that viewing angles of displays can be orientated such that directions with lower viewing angles can be associated with the direction of typical sight obstructions (for example the door), thereby reserving the three improved viewing angles for directions that are more likely to be viewed by the user. In typical configurations, an oven (microwave or conventional) can be located above the counter bench top 7210, to the left of a typical user position 7212, to the right of a typical user position 7214, or beneath the counter bench top 7216.

Figure 78:
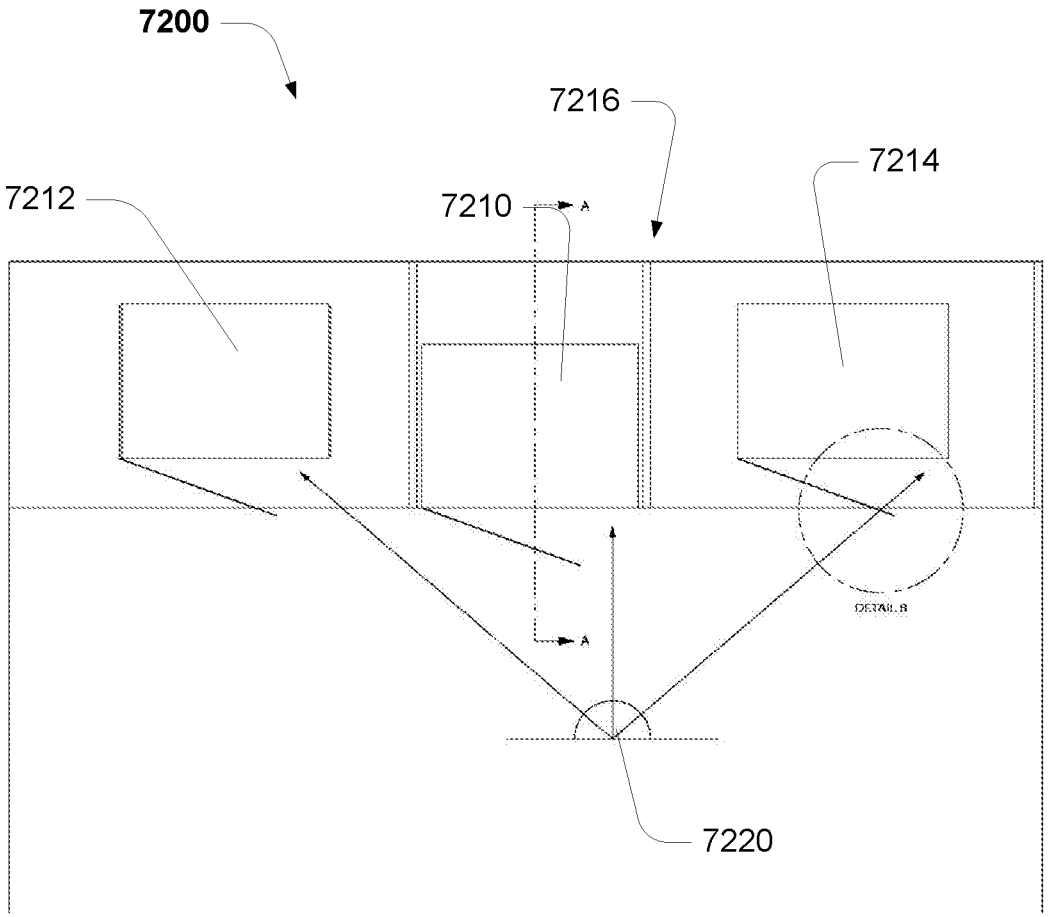
Figure 79:
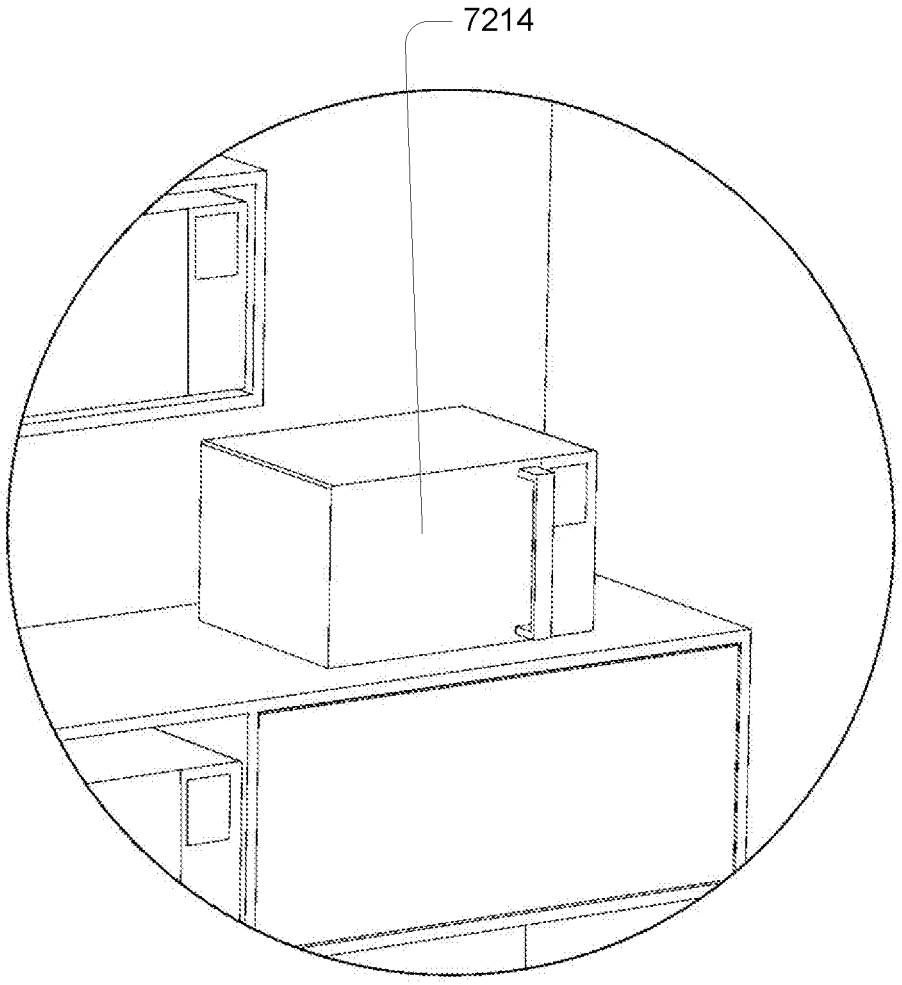
Figure 80:
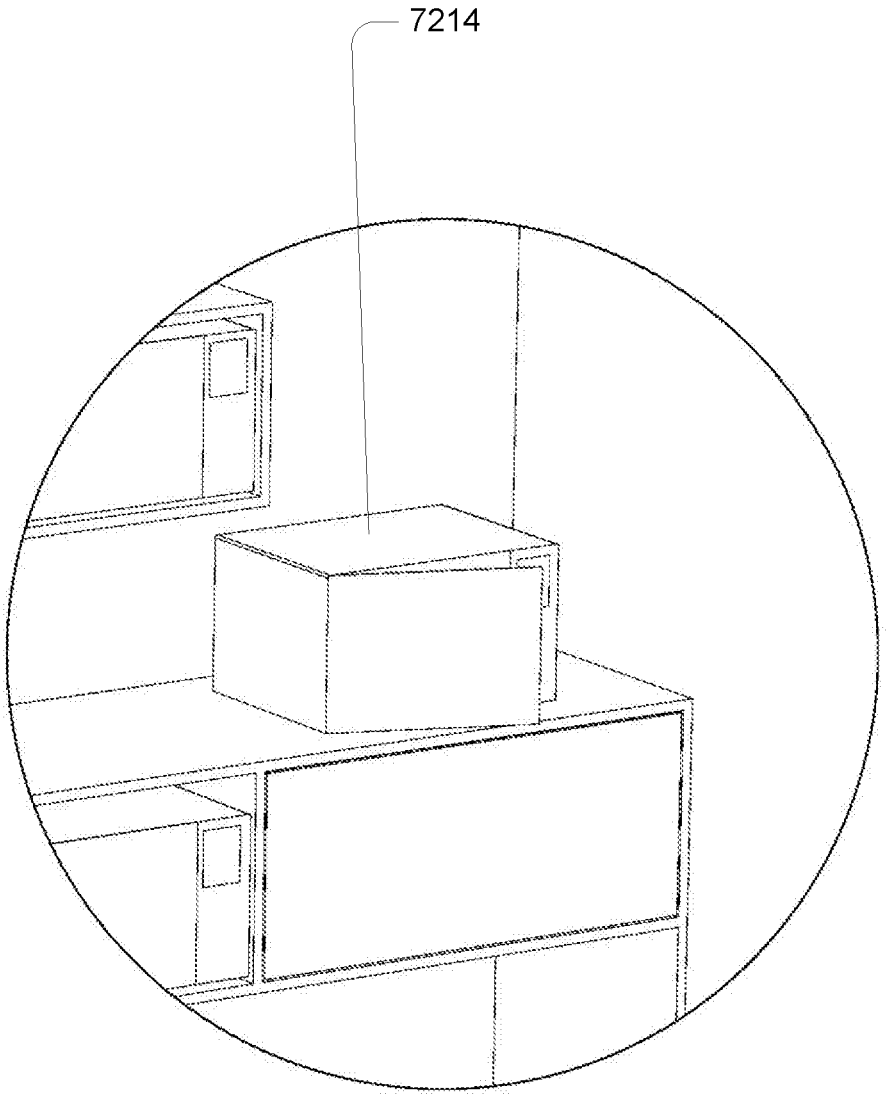

FIG. 78 shows a plan view of the configuration 7200, showing an example user location 7220. In this example, from a central location, the user has a clear undisrupted view of the upper and lower microwaves 7210, 7216. The display element on the left hand microwave 7212 is viewed from the left hand side, while the display element on the microwave on the right hand side 7214 is obstructed by an open door (as shown in FIG. 79 or 80).

It would be appreciated that any preferred orientation of a LCD display unit should bias best viewing angles to those typically used by a user, and deliberately orientate the worst viewing angle to the view least likely to be used within the kitchen environment (for example as shoe in FIG. 81).

FIG. 82A through FIG. 90 show a soft close door mechanism 8000 for use in an oven (microwave or conventional). The soft close door mechanism is used to reduce/remove door slamming that is typically experienced with ovens due to mechanical lever design, and contact between parts when the door is being closed.

FIG. 82A shows a partial mechanism in an open configuration, prior to the door being closed. In this example embodiment the body/housing 8010 receives an elongate door catch element 8012. The catch element 8012 has one or more downwardly directed fingers 8014, which when inserted in the housing are received by apertures 8016 defined in a movable slide 8018. Further closing of the door moves the slide, with a bias 8020, to a closed configuration (as shown in FIG. 82B).

Figure 83:
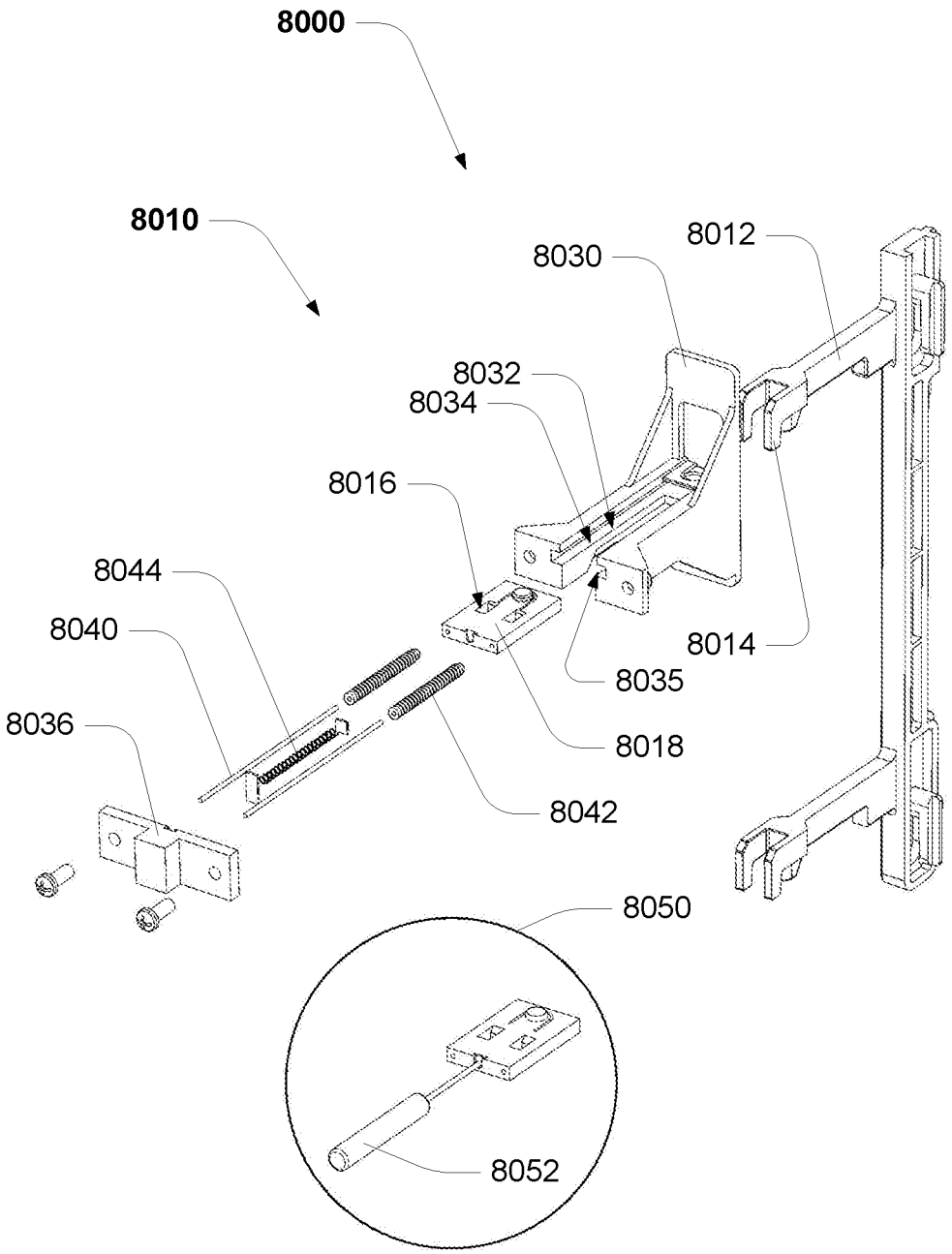

FIG. 83 shows the housing 8010 being in line for assembly. In this example embodiment, the housing includes a fixture bracket 8030 that defines a central aperture 8032 having a pair of space apart longitudinal opposing slide grooves (8034, 8035) for receiving the slide element 8016. The slide element is biased toward an end plate 8036 that is releasably fixed to the fixture bracket 8030. In this example embodiment, the slide is located on a pair of rails (or rods) 8040 for maintaining orientation of the slide and reducing the chance of jamming. The rails or rods are typically made of metal or plastic. The rods are then associated with a silicone compression tube 8042, which can aid in the soft close nature of the damping mechanism when under compression. A compression spring 8044 is located between the end plate and the slide to bias the slide into the closed configuration.

Insert 8050 shows an alternative soft close slide mechanism that uses a hydraulic piston 8052 to dampen movement of the configuration. This hydraulic piston may be used independently or in conjunction with other spring or hydraulic piston.

Figure 84A:
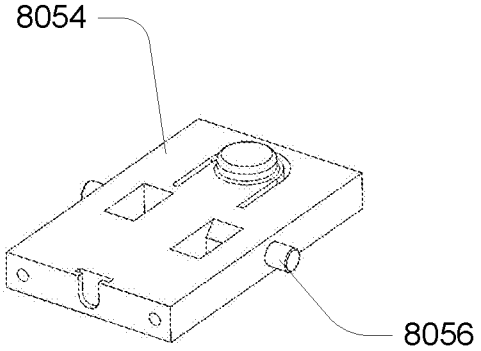
Figure 84B:
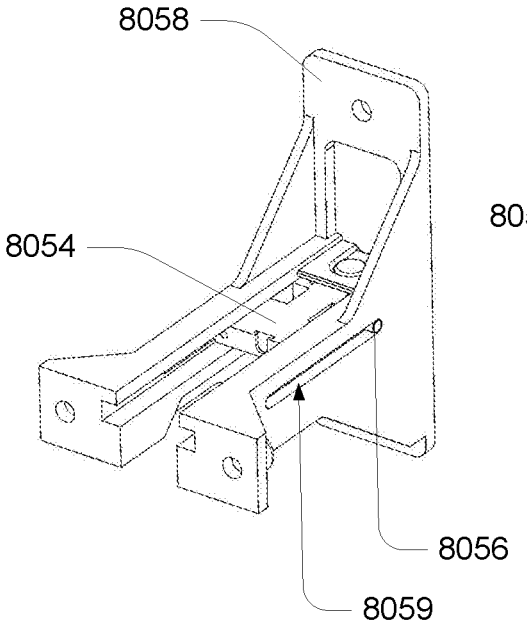
Figure 84C:
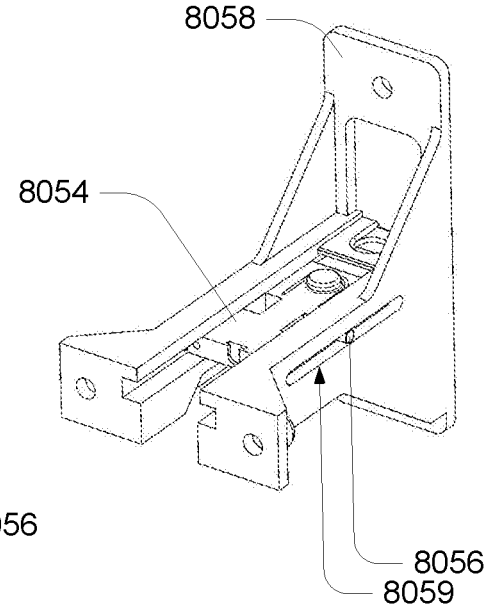

FIG. 84A shows a further alternative slide component/element 8054 with side protrusion 8056 that engage the longitudinal guides or slots. FIG. 84B shows the slide 8054 located within a respective housing bracket 8058, shown in the open configuration. FIG. 84C shows the slide element 8054 in the closed configuration. It would be appreciated that the protrusions 8056 to the sides of the slide element 8054 are received by slots 8059 in the housing bracket 8058.

Figure 85A:
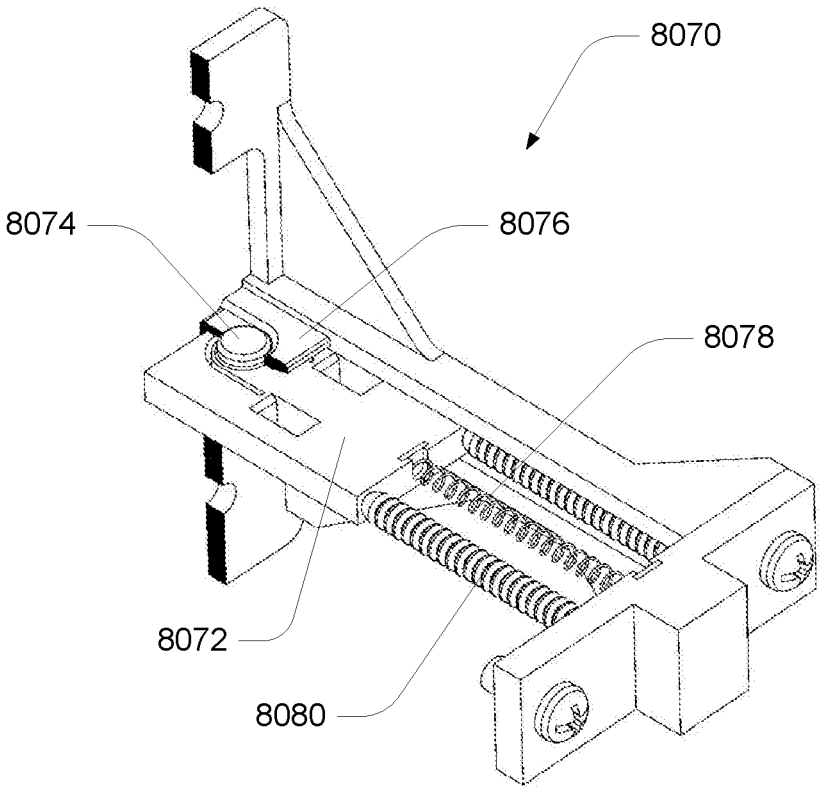
Figure 85B:
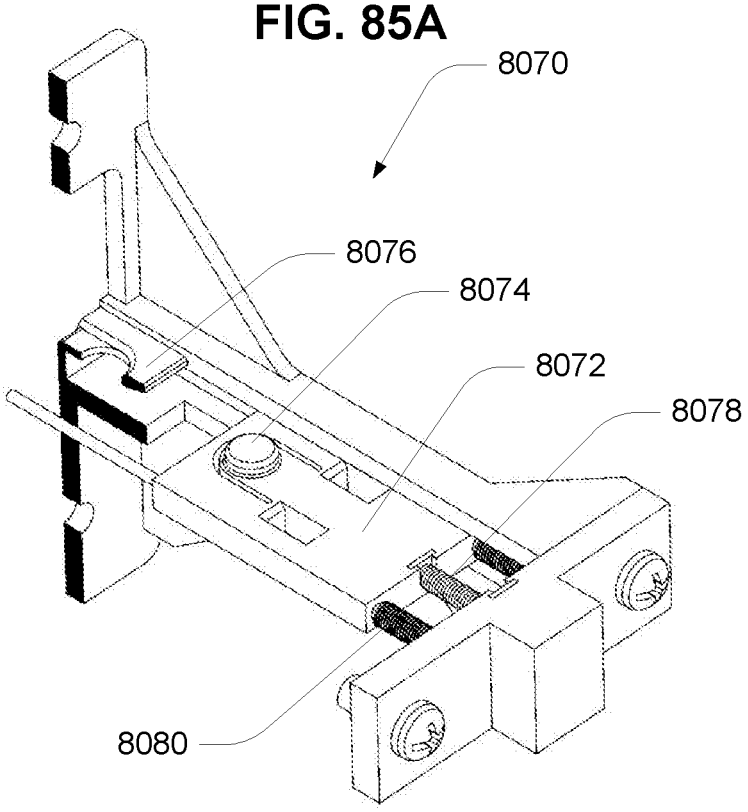

FIG. 85A and FIG. 85B show an embodiment soft close mechanism 8070. In this example embodiment the slide element 8072 has an upper domed protrusion 8074, which in the open configuration is retained by a receiving snap fit detail 8076 (as shown in FIG. 85A). In the open configuration shown in FIG. 85A the spring 8078 is in tension, for biasing the slide to the closed configuration. The damping element 8080 (for example silicon compression tubes) dampen movement of the slide element from the open configuration to the closed configuration. FIG. 85B shows the soft close mechanism 8070 with the slide in a closed configuration. In this configuration, the spring and damping mechanisms are compressed.

Figure 86A:
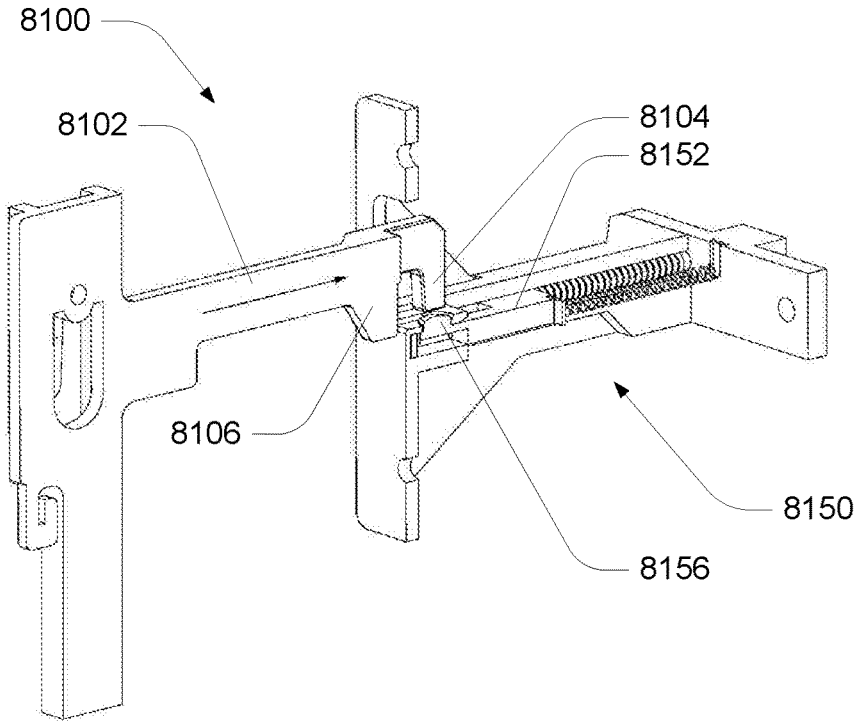
Figure 86B:
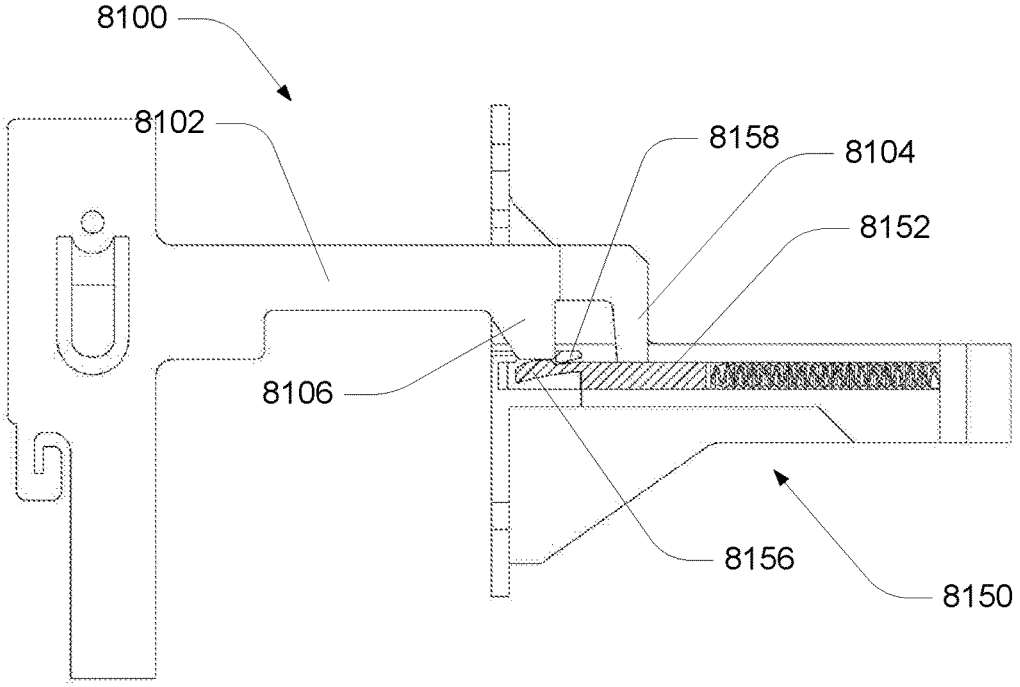
Figure 87:
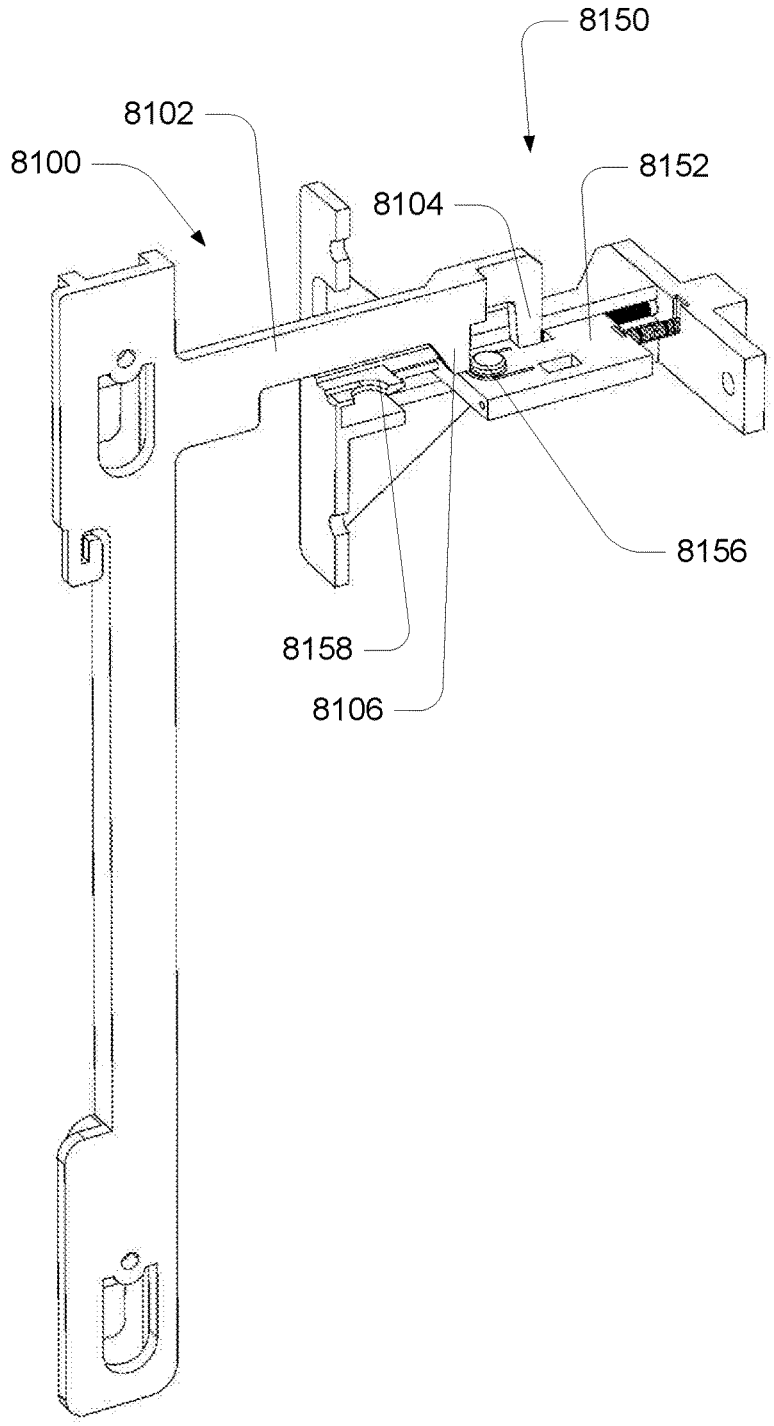

FIG. 86A and FIG. 86B show a door mechanism 8100 engaging a soft close mechanism 8150. FIG. 86A shows the door mechanism being first received by the soft close body while the door is being closed. The arm 8102 of the door mechanism is biased to a downward lock position, such that when the fingers 8104 ARE located within the aperture 8154 of the slide 8152 a rear protrusion 8106 is located to depress a slide dome 8156 and release it from a snap fit retaining element 8158, thereby allowing the slide to retract into the enclosed configuration. The front pair of finger elements 5104 are captured by the slide element and moved to the closed configuration (as best shown in FIG. 87). It would be appreciated that, as the door is pulled open, the reverse operation would commence.

In an embodiment, when the door is pulled open the spring when under tension would comply with pull force standards to prevent microwave leakage from emitting during operation. Typically pull force standards require an equivalent 1 kg force to open the door.

Figure 88:
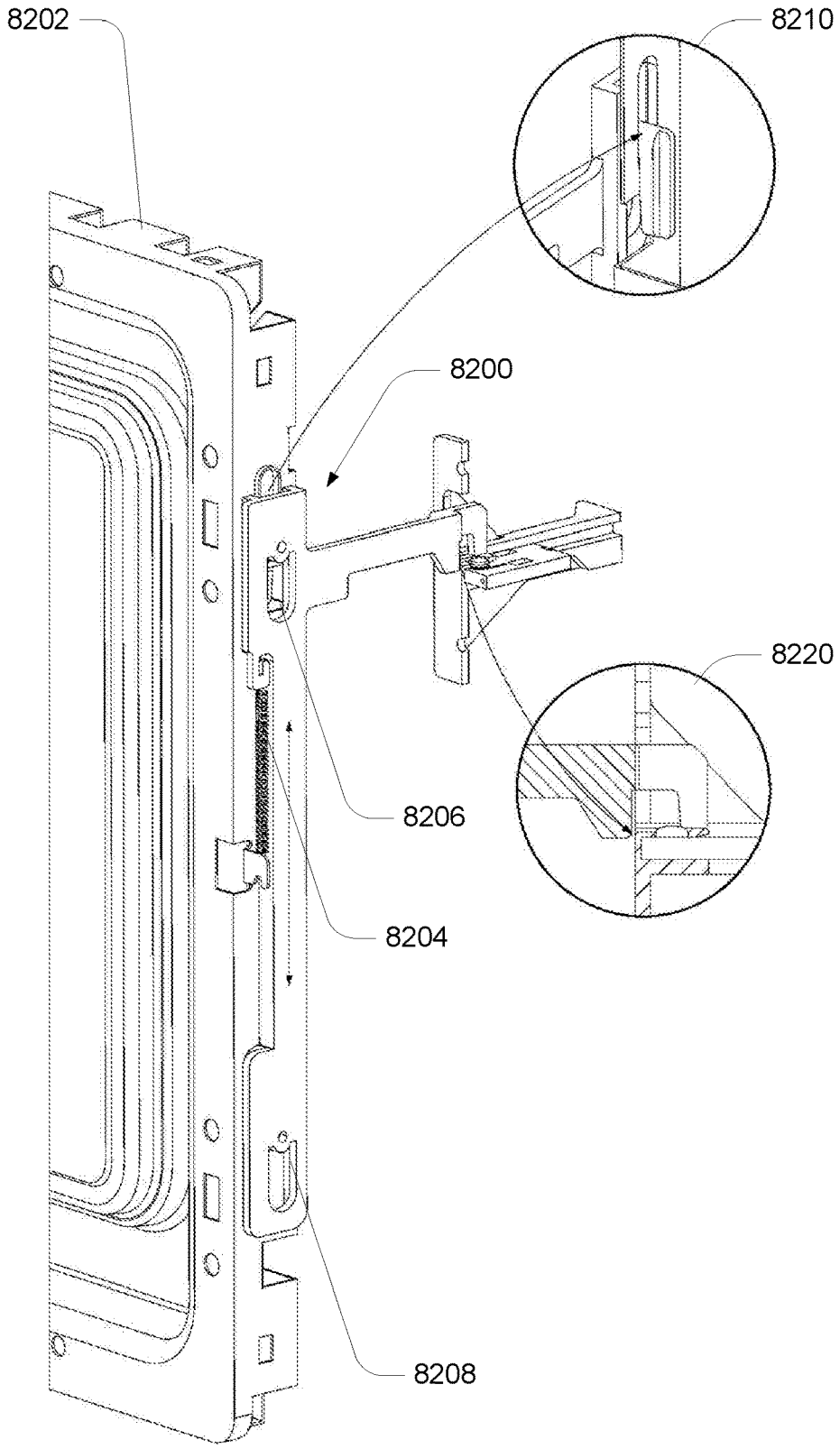

FIG. 88 shows an embodiment a lock mechanism 8200 coupled to a door assembly 8202. The lock mechanism is coupled to the door mechanism such that it can slide vertically, and is biased in a downward configuration by the tension spring 8204. For example, the door catch mechanism can move independently vertically along guides 8206, 8208, for example as shown in insert 8210. The vertical movement enables the door catch mechanism to move upwardly when engaging the housing of the soft close mechanism, such that the downward bias then enables the release of the slide mechanism (for example as shown in insert 8220).

Figure 89:
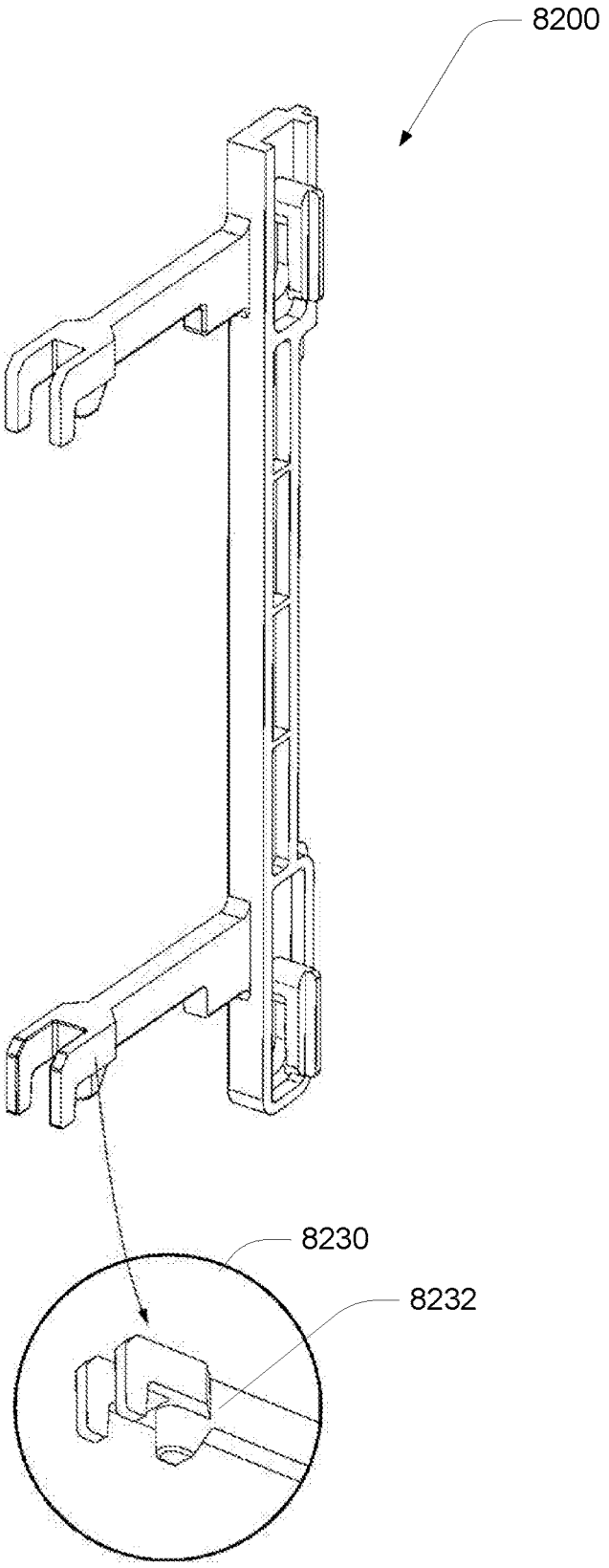

FIG. 89 shows a door catch mechanism 8200, with insert 8230 showing the underside of the door catch mechanism arm 8232. While the present embodiment includes three prongs/protrusions located at the end of the arm, alternative embodiments can include arms having two or one protrusion.

FIG. 90 shows an inside rear view of a typical microwave metal body 8500 whereby fixture brackets 8510 are held in position shown in the top and bottom locations. The fixture locations are depicted in a vertical configuration.

FIG. 91 shows an embodiment configuration 9000 in which an oven 9010 communicating within a wireless environment to other devices.

The oven 9010 (microwave oven or conventional oven) can act as a primary device, whereby a number of external/portable devices can connect to it through various communication mediums (for example a wireless communication or near field communication)

By way of example only, a wireless communication can include WiFi and a near field communication can include Bluetooth.

By way of example, external/portable devices can include any one or more of the following:

- a base server device 9020 coupled to the communication medium that can act as a home or base device that outputs data/information to a connected appliances (for example, an oven)—wherein data can also be retrieved once outputted base server to recall information such as software updates, recipes, troubleshoot information;
- a third party device 9030 (for example smart phone device, tablet device or the like) coupled to the communication mediums can include a number of portable devices that, when connected to a primary device, can communicate through the communication mediums, and which may also communicate with a data server 9032;
- a second appliance 9040 is coupled to the communication mediums, and can enable intercommunication between devices for sharing data/information, and which may also communicate with a data server 9042; and
- a third appliance 9050, such as a scales appliance, is coupled to the communication mediums, and can enable intercommunication between devices or appliances for sharing data/information.

Advantages of this interconnectivity between devices and appliances can include any one or more of the following:

- scales appliances can wirelessly communicate with either a controller of a microwave or a third party device—providing weight information to be used by the microwave to set a cooking power and a cooking time; or suggest recipe portioning;
- a third party device can communicate with a microwave to upload new cooking profiles or to update existing ones;
- a third party device can communicate with a microwave to provide operating instructions such as food type, cooking task, power and time, frozen or fresh;
- a microwave can communicate with a third party device to receive user feedback on the cooking progress of the food/beverage item, which may include power, time remaining;
- a microwave can communicate with a third party device to enable the device to make real time amendments to the cooking profile—for example, depending on the progress of the cooking cycle, modifying cooking power and/or cooking time;
- a microwave can communicate with other appliances—for example when the cooking of a food type is complete in the microwave, the microwave can communicate to an appliance to perform a different task to enable a meal preparation to finish at a specific end time;
- a third party device can remotely communicate with an appliance to pre-heat;
- a microwave can communicate back to a server (for example a service department of the company that produces the product) to: provide feedback on performance, help resolve troubleshoot problems raised by a consumer;
- a microwave can communicate to a third party device to provide an alert for an identified problem;
- a microwave can communicate with an appliance or device to remotely present a predetermined screen layout, thereby providing a shared interface between appliances.

It would be appreciated that an oven (microwave or convention) can comprise any one of the interfaces disclosed herein—with or without a soft close module and with or without a weigh module. The door being configured to either hinge horizontally or vertically. The display element being configured to provide preferred particular viewing angles. The microwave oven includes a microwave transmitter controlled by a processor module for heating food within a cooking cavity of the microwave.

In an embodiment, there is provided a user interface as described herein. It will be appreciated that any one of the disclosed user interfaces can be implemented with one or more user input element removed and/or one or more user inputs further included based on any user input elements disclosed herein.

In an embodiment, there is provided a weigh module as described herein.

In an embodiment, there is provided a soft close mechanism as described herein.

In an embodiment, there is provided is a microwave cover as described herein.

Although the invention has been described with reference to specific examples, it will be appreciated by those skilled in the art that the invention may be embodied in many other forms.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Any claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. Embodiments have features that can be combined in any combination or permutation.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention.

While the present invention has been disclosed with reference to particular details of construction, these should be understood as having been provided by way of example and not as limitations to the scope or spirit of the invention.

The invention claimed is:

1. A microwave oven having:

a door; and a user interface, the user interface including:

a first input selector element for receiving user input;

a second input selector element for receiving user input;

a display element;

a processor module coupled to the display element; and a first user interface area comprising:

a plurality of mode selector elements, wherein user selection of one of the plurality of mode selector elements causes the user interface to toggle from a first operating mode to a second operating mode;

a power selector for selecting a cooking power of the microwave oven;

a time selector for selecting a cooking time of the microwave oven;

a start selector for initiating a cooking cycle of the microwave oven; and a stop selector for interrupting and/or terminating the cooking cycle of the microwave oven;

a second user interface area comprising a plurality of shortcut selectors, the second user interface area being located such that the plurality of shortcut selectors are hidden from view behind the door of the microwave oven when the door is in a closed position, wherein the door comprises:

a planar internal surface that, when the door is in the closed position, closes a cavity of the microwave oven; and an external surface opposite the planar internal surface of the door, wherein the second user interface area is offset from the first user interface area by an offset distance that is equal to a distance between the planar internal surface and the external surface;

wherein each of the plurality of shortcut selectors is co-linearly aligned in a single column that is parallel with an adjacent edge of an opening of the cavity, and each of the plurality of shortcut selectors is associated with a predetermined cooking profile having predetermined cooking settings;

wherein the first user interface area is viewable when the door is in the closed position, and the first user interface area is located such that the plurality of mode selector elements, the power selector, the time selector, the start selector, and the stop selector are selectable when the door is in the closed position; and wherein when the processor module receives a shortcut signal from a respective one of the plurality of shortcut selectors, the processor module retrieves the respective cooking profile and causes the display element to present the associated predetermined cooking settings.

2. The microwave oven according to claim 1 wherein, with the user interface in the first operating mode:

the power selector is configured to receive user input to adjust a cooking power setting;

the time selector is configured to receive user input to adjust a cooking time setting;

the display element is adapted to display the cooking power setting and the cooking time setting; and the processor module receives a signal from the power selector that is indicative of an adjustment to the cooking power setting and a signal from the time selector that is indicative of an adjustment to the cooking time setting; the processor causing the display element to present the user selected cooking power setting and the user selected cooking time setting.

3. The microwave oven according to claim 2 wherein, with the user interface in the second operating mode:

the power selector is configured to receive user input to adjust a food quantity setting;

the time selector is configured to receive user input to adjust a food type setting;

the display element is adapted to display the food quantity setting and the food type setting; and the processor module receives a signal from the power selector that is indicative of an adjustment to the food quantity setting and a signal from the time selector that is indicative of an adjustment to the food type setting; the processor causing the display element to present the user selected food quantity setting and the user selected food type setting.

4. The microwave oven according to claim 2, wherein, upon commencing a cooking cycle, user input applied to the power selector causes the cooking power setting to be adjusted.

5. The microwave oven according to claim 2, wherein, the cooking power setting and the cooking time setting can each be adjusted in real time during the cooking cycle.

6. The microwave oven according to claim 2, wherein the display element displays the cooking power setting and the cooking time in real time during the cooking cycle.

7. The microwave oven according to claim 1, the cooking profile being specifically configured for a predetermined food or beverage type.

8. The microwave oven according to claim 1, the user interface further including:

an additional cooking selection element;

wherein the processor module receives an additional cooking selection signal from the selection element; the processor retrieves the previous cooking setting, calculates a supplemental cooking setting for continually cooking a proportional amount with respect to the previous cooking setting, and causes the display element to present the supplemental cooking setting.

9. The microwave oven according to claim 8, the supplemental cooking setting having a cooking time setting that is a percentage of a previously set cooking time setting.

10. The microwave oven according to claim 8, the supplemental cooking setting having a cooking power setting that is calculated from a previously set cooking power setting.

11. The microwave oven according to claim 10, wherein the cooking power setting of the supplemental cooking setting is equal to a previously set cooking power setting.

12. The microwave oven according to claim 2, wherein, upon commencing a cooking cycle in the second operating mode, user input applied to the power selector causes the user interface to toggle back to the first operating mode, enabling the user to adjust the cooking power setting.

13. The microwave oven according to claim 2, wherein, upon commencing a cooking cycle in the second operating mode, user input applied to the time selector causes the user interface to toggle back to the first operating mode, enabling the user to adjust the cooking time setting.

14. The microwave oven according to claim 1, wherein, in the second operating mode, the display element presents the selected food quantity setting above the power selector and presents the selected food type setting above the time selector.

15. The microwave oven according to claim 1, wherein, in the first operating mode, the display element presents the selected power setting above the power selector and presents the selected time setting above the time selector.

16. The microwave oven according to claim 1, wherein the plurality of shortcut selectors are visible from view when the door is in an open position.

17. The microwave oven according to claim 1, wherein the second user interface area is adjacent to an opening of the microwave.

18. The microwave oven according to claim 1, wherein the second user interface area is recessed relative to the first user interface area.

19. The microwave oven of claim 1, wherein the associated predetermined cooking settings include a power level corresponding to a predetermined power level associated with the shortcut selector emitting the shortcut signal.

20. The microwave oven of claim 1, wherein the associated predetermined cooking settings include a frequently used predetermined cooking setting.

* * * * *